US005895157A

United States Patent [19]

Morimura et al.

[11] Patent Number: 5,895,157

[45] Date of Patent: Apr. 20, 1999

[54] PRINTING APPARATUS AND AUTOCHANGER THEREOF

[75] Inventors: Jinichi Morimura; Kazuhiro Sato; Hidehiko Funayama, all of Kanagawa; Hiroshi Dohi, Tokyo; Shojiro Asami, Kanagawa, all of Japan; Masato Nakamura; Akio Hitachi, both of Dusseldorf, Germany

[73] Assignees: Sony Corporation, Tokyo, Japan; Sony Deutschland GmbH, Cologne, Germany

[21] Appl. No.: 08/454,176

[22] PCT Filed: Nov. 1, 1994

[86] PCT No.: PCT/JP94/01838

§ 371 Date: Aug. 21, 1995

§ 102(e) Date: Aug. 21, 1995

[87] PCT Pub. No.: WO95/12538

PCT Pub. Date: May 11, 1995

[30] Foreign Application Priority Data

| | | | |
|---|---|---|---|
| Nov. 1, 1993 | [JP] | Japan | 5-296052 |
| Nov. 1, 1993 | [JP] | Japan | 5-296053 |
| Nov. 1, 1993 | [JP] | Japan | 5-296054 |
| Nov. 1, 1993 | [JP] | Japan | 5-296062 |
| Nov. 1, 1993 | [JP] | Japan | 5-297287 |
| Nov. 1, 1993 | [JP] | Japan | 5-297289 |
| Sep. 22, 1994 | [JP] | Japan | 6-254625 |

[51] Int. Cl.[6] ..... B41J 35/22

[52] U.S. Cl. ..... 400/206.2; 400/208; 400/605; 271/9.05

[58] Field of Search ..... 400/206, 206.1, 400/206.2, 207, 208, 605, 624, 625, 629; 271/9.01, 9.03, 9.04, 9.05, 9.06, 9.07

[56] References Cited

U.S. PATENT DOCUMENTS 5,080,343 1/1992 Kushima et al. ..... 271/5

FOREIGN PATENT DOCUMENTS 57-41651 3/1982 Japan .
62-27206 2/1987 Japan .
4-3732 1/1992 Japan .

OTHER PUBLICATIONS

JP-A-60 253578, Patent Abstract of Japan, vol. 010, No. 126 (M-477), May 10, 1986.

JP-A-61 158492, Patent Abstract of Japan, vol. 010, No. 360 (M-541), Dec. 3, 1986.

*Primary Examiner*—Christopher A. Bennett
*Attorney, Agent, or Firm*—Jay H. Maioli

[57] ABSTRACT

An autochanger which can continuously operate a video printing apparatus without having recourse to intervention by an operator which includes a paper feed tray for containing a plurality of recording media and/or an ink ribbon cartridge are loaded in the video printer device to selectively change them as the occasion demands, a magazine which can contain a plurality of paper feed trays and/or ink ribbon cartridges and a conveyance means of paper feed tray and/or ink ribbon cartridge for conveying the paper feed tray and/or the ink ribbon cartridge between the video printer device and the magazine. Therefore, the paper feed tray and the ink ribbon cartridge of the video printer device can be changed by the conveyance means as the occasion demands, so as to realize an autochanger which can continuously operate a video printer device without having recourse to intervention by an operator.

17 Claims, 25 Drawing Sheets

| ADDRESS INFO. | MEDIA TYPE INFORMATION | USED AMOUNT INFO. |
|---|---|---|
| MAGAZINE 1 | MEDIA 1 (IMAGE REC MEDIUM 1, INK RIBBON 1) | 0 |
| MAGAZINE 2 | MEDIA 1 (IMAGE REC MEDIUM 1, INK RIBBON 1) | 42 |
| MAGAZINE 3 | MEDIA 1 (IMAGE REC MEDIUM 1, INK RIBBON 1) | 100 |
| MAGAZINE 4 | MEDIA 1 (IMAGE REC MEDIUM 1, INK RIBBON 1) | 100 |
| MAGAZINE 5 | MEDIA 2 (IMAGE REC MEDIUM 2, INK RIBBON 2) | 0 |
| MAGAZINE 6 | MEDIA 2 (IMAGE REC MEDIUM 2, INK RIBBON 2) | 78 |
| MAGAZINE 7 | MEDIA 2 (IMAGE REC MEDIUM 2, INK RIBBON 2) | 100 |
| MAGAZINE 8 | MEDIA 3 (IMAGE REC MEDIUM 3, INK RIBBON 3) | 60 |
| MAGAZINE 9 | MEDIA 3 (IMAGE REC MEDIUM 3, INK RIBBON 3) | 100 |
| MAGAZINE 10 | MEDIA 4 (IMAGE REC MEDIUM 4, INK RIBBON 4) | 90 |
| MAGAZINE 11 | MEDIA 5 (IMAGE REC MEDIUM 5, INK RIBBON 5) | 100 |

FIG. 31

PRINTING APPARATUS AND AUTOCHANGER THEREOF

TECHNICAL FIELD

The present invention relates to a printing apparatus and autochanger thereof, and more particularly, is applicable to an autochanger for changing, for example, the paper feed tray and the ink ribbon cartridge of a video printer device as the occasion demands, in a printing apparatus for printing images on the basis of the supplied video signal on a recording media such as sheets of printing paper.

BACKGROUND ART

Heretofore, there have been proposed an apparatus shown in FIG. 1 as this type of a video printer device by way of example. In the video printer device 1, a paper feed tray insertion opening 3A is provided, including a power supply switch 4, on the lower portion of the front panel 3 of a main housing 2, and sheets of printing paper are supplied by inserting a paper feed tray 5 into the paper feed tray insertion opening 3A.

There is also provided an ink ribbon cartridge insertion opening 3B which is inclined at a predetermined angle and arranged in parallel with the paper feed tray insertion opening 3A on the front surface of the front panel 3. After an ink ribbon cartridge 6 has been inserted into the ink ribbon cartridge insertion opening 3B, an operation panel 7 which rotates freely in the lower end and is supported on the front panel 3 is closed so that the ink ribbon cartridge 6 is loaded in a predetermined state.

The video printer device 1 has a video signal input terminal (not shown) in the main housing body 2, and a video signal is input to a signal processing circuit (not shown) housed inside of the main housing body 2 via the video signal input terminal.

Further, on the front surface of the operation panel 7, a plurality of operation switches (not shown) are provided. By operating the operation switches, the image to be printed is selected from a series of images based on the input video signal.

In the video printer device 1, a printing switch is turned on after the paper feed tray 5 and the ink ribbon cartridge 6 have been loaded and an image to be printed has been selected, so that the printing paper contained in the paper feed tray 5 is conveyed by means of a printing paper conveyance mechanism (not shown) to a predetermined position at which the printing surface of the printing paper is brought into contact with the ink surface of the ink ribbon 6A of the ink ribbon cartridge 6. Thereafter, the selected image is printed on the printing paper by means of a printing mechanism (not shown) provided inside of the main housing 2, and then the printing paper is discharged by the printing paper conveyance mechanism into a paper discharge compartment 8 provided upward of the paper feed tray 5 (hereinafter, a series of these operations is referred to as "printing operation").

By the way, it has recently been proposed to construct a compact photographic studio with a video camera and a video printer device, like a photographic studio supplying a photographic self-portrait of a person within several minutes, and to install this photographic studio along the street.

However, in the video printer device 1, the number of sheets of printing paper that can be stored in the paper feed tray 5 is presently limited to about several sheets to a hundred sheets, and it is therefore necessary to change the paper feed tray 5 and the ink ribbon cartridge 6 each time printing is performed several times to a hundred times.

Therefore, in order to realize a photographic studio which can be operated continuously without having recourse to intervention by an operator for a long period of time, an autochanger is needed which is capable of automatically changing the paper feed tray 5 and the ink ribbon cartridge 6 in sequence as the occasion demands.

Further, there are a plurality of types of image recording medium on which images are printed, such as sheets of printing paper. If images can be printed on a plurality of types of image recording medium automatically depending on the user's demand, it is considered that the limits of use of image recording medium can be extended practically.

As a matter of fact, for example, an image recording medium for color printing, monochrome printing, OHP, lamination printing (sheets for lamination is provided in the corresponding ink ribbon cartridge in addition to three colors (yellow, magenta, and cyan)), label (which has the construction that is possible to be peeled from a sheet as a label, which has pre-cutting and is possible to be peeled from a sheet as a plurality of labels, or the like), copy (which can copy, such as a mag cup, shirts, or the like), and opaque plastics (identification card, etc.), normal paper, or post card can be considered as an image recording medium.

The present invention has been made in consideration of the point described above, and an object of the invention is to provide an autochanger by means of which a video printer device can be operated continuously without having recourse to intervention by an operator for a long period of time.

Further, another object of the invention is to provide an autochanger in which an optional paper feed tray and ink ribbon cartridge can be contained.

Further, in the autochanger according to the present invention, the trouble previously encountered in conveyance can be prevented.

Furthermore, the present invention provides a printing apparatus which can selectively print a desired type of recording media among a plurality of types of recording media by using the autochanger.

DISCLOSURE OF INVENTION

To solve the above-described problem, the present invention provides an autochanger for changing a paper feed tray 27 and/or an ink ribbon cartridge 28 loaded in a video printer device 24 as the occasion demands, and the autochanger comprises a magazine 26 having a plurality of tray compartments 26A each corresponding to the shape of the paper feed tray 27 and/or a plurality of cartridge compartments 26B each corresponding to the ink ribbon cartridge 28, and conveyance means 32, 34 for conveying the paper feed tray 27 and/or the ink ribbon cartridge 28 between the video printer device 24 and the magazine 26.

In this way, there is provided conveyance means 32, 34 for conveying the paper feed tray 27 and the ink ribbon cartridge 28 between the video printer device 24 and the magazine 26, so that the paper feed tray 27 and the ink ribbon cartridge 28 of the video printer device 24 can be changed as the occasion demands, by the conveyance means 32.

Further, to solve the above problem, the autochanger according to this invention for changing the paper feed tray 27 and the ink ribbon cartridge 28 which are loaded in the video printer device 24 as the occasion demands, has a plurality of tray compartments 26A for containing the paper feed tray 27 and a plurality of cartridge compartments 26B for containing the ink ribbon cartridge 28, and comprises: the magazine 26 for supporting the paper feed tray 26A and the ink ribbon cartridge 26B while keeping the same position as the position when they are loaded in the video printer device 24, in the tray compartments 26A and the cartridge compartments 26B corresponding to the tray compartments 26A; and conveyance means 32, 34 for conveying the paper feed tray 27 and the ink ribbon cartridge 28 between the video printer device 24 and the magazine 26, while keeping the positional relationship that the paper feed tray 27 and the ink ribbon cartridge 28 are loaded in the video printer device 24 or are contained in the magazine 26.

Further, the conveyance means 32, 34 convey the paper feed tray 27 and the ink ribbon cartridge 28 between the video printer device 24 and the magazine 26 simultaneously.

Furthermore, the conveyance means 32, 34 convey the paper feed tray 27 and the ink ribbon cartridge 28 corresponding to the paper feed tray 27 to be loaded in the video printer device together with the paper feed tray 27, between the video printer device 24 and the magazine 26.

In this way, the paper feed tray 27 and the ink ribbon cartridge 28 are conveyed between the video printer device 24 and the magazine 26, while keeping the positional relationship that the paper feed tray 27 and the ink ribbon cartridge 28 are loaded in the video printer device 24, or are contained in the magazine 26, so that when the paper feed tray 27 and the ink ribbon cartridge 28 are loaded in the video printer device 24, and are contained in the magazine 26, the complicated operation to determine the position is not necessary.

Further, to solve the above problem, the autochanger according to this invention for changing the paper feed tray 27 and the ink ribbon cartridge 28 which are loaded in the video printer device 24 as the occasion demands, comprises: a magazine 26 having a plurality of tray compartments 26A for containing paper feed tray 27 and a plurality of cartridge compartments 26B for containing the ink ribbon cartridge 28; and conveyance means 32, 34 for conveying the paper feed tray 27 and the ink ribbon cartridge 28 between the magazine 26 and the video printer device 24. In the magazine 26, a plurality of magazine units 60 are piled up by fitting a plurality of projections 60CX, 60CY of a first magazine unit 60 with a plurality of fitting holes 60DX, 60DY of a second magazine unit 60, among a plurality of magazine units 60 in which a plurality of projections 60CX, 60CY are formed at the upper surface and a plurality of engagement holes 60DX, 60DY are formed at the bottom surface.

In addition, the magazine 26 has a conveyance confirming means 71, in which a projection 71B is provided at the outer surface of an axis 71A supported to rotate freely on each magazine unit 60, at the gateway of each tray compartment 26A and/or each cartridge compartment 26B. In accordance with the condition of the conveyance confirming means 71, it is judged whether or not the paper feed tray 27 contained in each tray compartment 26A and/or the ink ribbon cartridge 28 contained in each cartridge compartment 26B which are corresponding to each conveyance confirming means 71 are conveyed.

Further, the autochanger 20 provides a position determination fixing means 66 which is engaged with each projection 60CX, 60CY of the magazine unit 60 at the uppermost stage which constitutes the magazine 26, and which is fixed to an outer frame 65 of the autochanger 20, so that the upper side of the magazine 26 is positionally determined by the position determination fixing means 66.

Further, the autochanger 20 provides, in the upper surface of the magazine unit 60 at the uppermost stage which constitutes the magazine 26, an elasticity means 67 which urges the magazine unit 60 toward the lower stage with the outer frame 65 of the autochanger 20.

In this way, the magazine 26 is formed by sequentially piling a plurality of magazine units 60, so as to constitute the magazine 26 having desired number of stages.

Further, to solve the above problem, the autochanger according to this invention for changing the paper feed tray 27 and the ink ribbon cartridge 28 which are loaded in the video printer device 24 as the occasion demands, comprises: a magazine 26 having a plurality of tray compartments 26A for containing paper feed tray 27 and a plurality of cartridge compartments 26B for containing the ink ribbon cartridge 28; conveyance means 32 for conveying the paper feed tray 27 and the ink ribbon cartridge 28 between the magazine 26 and the video printer device 24; and discharge means 41, which is allocated in a paper discharge compartment 24C discharging a printed sheet of printing paper of the video printer device 24, for discharging sheets of printing paper to the outside of the video printer device 24 via a shooter 42, by conveying sheets of printing paper discharged into a paper discharge compartment 24C from the paper discharge outlet of the video printer device 24 to slide it into the shooter 42 provided in the conveyance means 32, based on a driving power which is supplied from the conveyance means 32 when the printed sheet of printing paper of the video printer device 24 is discharged to the paper discharge compartment 24C of the video printer device 24 in the state that the conveyance means 32 is positioned at the predetermined position corresponding to the video printer device 24.

In this way, the paper feed tray 27 and the ink ribbon cartridge 28 are conveyed between the magazine 26 and the video printer device 24 by the conveyance means 32, so that the paper feed tray 27 and the ink ribbon cartridge 28 which are loaded in the video printer device 24 can be changed as the occasion demands.

Further, a discharge means 41 is provided, for discharging sheets of printing paper to the outside of the video printer device 24 via a shooter 42, by conveying sheets of printing paper discharged into a paper discharge compartment 24C from the paper discharge outlet of the video printer device 24 to slide it into the shooter 42 provided in the conveyance means 32, based on a driving power which is supplied from the conveyance means 32 when the printed sheet of printing paper of the video printer device 24 is discharged into the paper discharge compartment 24C of the video printer device 24 in the state that the conveyance means 32 is positioned at the predetermined position corresponding to the video printer device 24. Therefore, the printed sheet of printing paper discharged into the paper discharge compartment 24C of the video printer device 24 can be discharged to the outside of the autochanger 20 if necessary.

Further, to solve the above problem, the autochanger according to this invention for changing the paper feed tray 27 and the ink ribbon cartridge 28 which are loaded in the video printer device 24 as the occasion demands, comprises: the magazine 26 having a plurality of tray compartments 26A for containing the paper feed tray 27 and a plurality of cartridge compartments 26B for containing the ink ribbon cartridge 28; and conveyance means 32, 34 for conveying the paper feed tray 27 and the ink ribbon cartridge 28 between the magazine 26 and the video printer device 24. The conveyance means 32, 34 provides: an engagement supporting means 230 for engaging the paper feed tray 27 with the ink ribbon cartridge 28 in the conveyance of the paper feed tray 27 and the ink ribbon cartridge 28; first urging means 232, 234, which are provided in the engagement supporting means 230, for urging the paper feed tray 27 loaded in the video printer device 24 toward the video printer device 24; and second urging means 242, 244, which are provided in the engagement supporting means 230, for urging the ink ribbon cartridge 28 loaded in the video printer device 24 toward the video printer device 24.

In addition, the conveyance means 32, 34 provides: a discharge means 41 for discharging the printed sheet of printing paper from the paper discharge compartment 24C to the outside of the video printer device 24, when the printed sheet of printing paper of the video printer device 24 is discharged into the paper discharge compartment 24C of the video printer device 24; a shooter 42 for discharging the printed sheet of printing paper, which is discharged from the paper discharge compartment 24C to the outside of the video printer device 24 by the discharge means 41, to the outside of the autochanger 20.

In this way, the conveyance means 32, 34 for conveying the paper feed tray 27 and the ink ribbon cartridge 28 between the magazine 26 and the video printer device 24 are provided, so that the paper feed tray and the ink ribbon cartridge can be changed as the occasion demands.

Further, by providing first urging means 232, 234 for urging the paper feed tray 27 loaded in the video printer device 24 toward the video printer device 24, and second urging means 242, 244 for urging the ink ribbon cartridge 28 loaded in the video printer device 24 toward the video printer device, the paper feed tray 27 and the ink ribbon cartridge 28 are loaded into the video printer device 24 while their positions are fixed at the autochanger 20 side.

Further, to solve the above problem, the autochanger according to this invention for changing the paper feed tray 27 and/or the ink ribbon cartridge 28 which are loaded in the video printer device 24 as the occasion demands, comprises: the magazine 26 for containing the paper feed tray 27 and/or the ink ribbon cartridge 28; conveyance means 32, 34 for conveying the paper feed tray 27 and the ink ribbon cartridge 28 between the magazine 26 and the video printer device 24; and control means 43 for controlling the drive of the conveyance means 32, 34 based on the output signal representing the operation state of the video printer device 24. Therefore, the conveyance means 32, 34 are drive-controlled in response to the operation of the video printer device 24.

In this way, the conveyance means 32, 34 are controlled to drive based on the output signal representing the operation state of the video printer device 24, so that the existing video printer device can be used for the autochanger 20.

Further, to solve the above problem, the autochanger according to this invention for changing the paper feed tray 27 and the ink ribbon cartridge which are loaded in the video printer device 24 as the occasion demands, comprises: the magazine 26 having a plurality of tray compartments 26A for containing the paper feed tray 27 and a plurality of cartridge compartments 26B for containing the ink ribbon cartridge 28; conveyance means 32 for conveying the paper feed tray 27 and the ink ribbon cartridge 28 between the magazine 26 and the video printer device 24; and guide frame 30, 31 for guiding the conveyance means 32 between the magazine 26 and the video printer device 24. Therefore, in the conveyance of the autochanger 20, fixing screws 119BX, 119BY are put through holes 30A, 31A which are formed through the guide frame 30, 31 with adjuster screws 119AX, 119AY, to fix the conveyance means 32 to the guide frame 30, 31 by the fixing screws 119BX, 119BY.

In this way, the conveyance means 32 conveys the paper feed tray 27 and the ink ribbon cartridge 28 between the magazine 26 and the video printer device 24, so that the paper feed tray 27 and the ink ribbon cartridge 28 which are loaded in the video printer device 24 can be changed if necessary.

Further, in the conveyance of the autochanger 20, the fixing screws 119BX, 119BY are put through the through holes 30A, 31A which are formed through the guide frame 30, 31 with the adjuster screws 119AX, 119AY, to fix the conveyance means 32 to the guide frame 30, 31 by the fixing screws 119BX, 119BY, so that the trouble in conveyance due to the unnecessary operation of the conveyance means 32 can be prevented.

Further, to solve the above problem, a printing apparatus 351 having a video printer device 24 for printing an image on the basis of image information supplied from a predetermined image information supplying means 354 on a recording media consisting of an image recording medium and an ink ribbon, the printing apparatus 351 comprises: containing means 26 for containing various types of recording media; selecting means 357 for selecting a desired type of recording media out of the various types of recording media; and supplying means 20 for supplying the selected recording media to the video printer device 24 by pulling it from the containing means 26 to convey it to the video printer device 24.

In addition, the printing apparatus 351 having a video printer device 24 for printing the image on the basis of the image information supplied from the predetermined image information supplying means 354 on the image recording medium of the recording media consisting of the image recording medium and the ink ribbon, the printing apparatus 351 comprises: containing means 26 for containing various types of recording media; selecting means 357 for selecting a desired type of recording media out of the various types of recording media; memory means 420 for memorizing the data relating to the type of each recording media contained in the containing portions 26A, 26B of the containing means 26; recording media conveyance means 32, 34 for conveying the recording media between the containing means 26 and the video printer device 24; and control means 43 (411) for supplying the selected recording media from the containing means 26 to the video printer device 24 by controlling the drive of the recording media conveyance means 32, 34 based on the data and the output from the selecting means 357.

In this way, the desired type of recording media, which is selected in accordance with the operation of user from various types of recording media, is pulled out of the containing means 26 to convey it to the video printer device 24, so that the recording media can be supplied to the video printer device 24. Therefore, the desired type of recording media can be selected and printed from various types of recording media.

Also, the data relating to the type of each recording media which is contained in each containing portion 26A, 26B of the containing means 26 is memorized in the memory means 420, the data in the desired type of recording media selected in accordance with the operation of the user from various types of recording media is read, and the recording media conveyance means 32, 34 are drive controlled based on the data. Therefore, the selected recording media can be supplied from the containing means 26 to the video printer device 24, so that the desired type of recording media can be selected and printed from various types of recording media.

BRIEF DESCRIPTION OF DRAWINGS

FIG. 31 is a plan view and a table explaining the operation processing by a CPU.

BEST MODE FOR CARRYING OUT THE INVENTION

Figure 1:
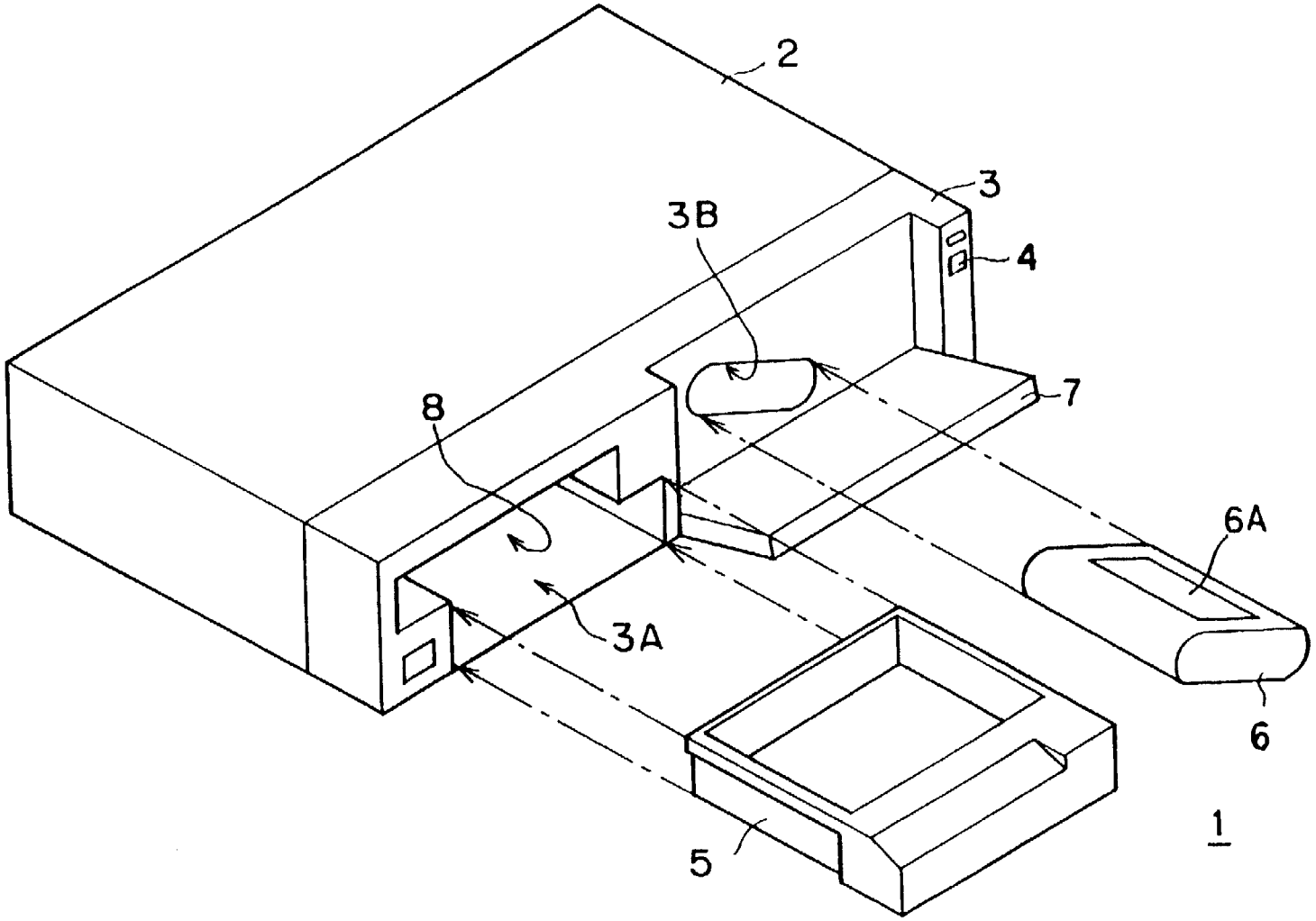
FIG. 1 is a schematic perspective view showing one embodiment of a conventional video printer device.

An embodiment of the present invention will be hereinafter described in detail with reference to the drawing.

Figure 2:
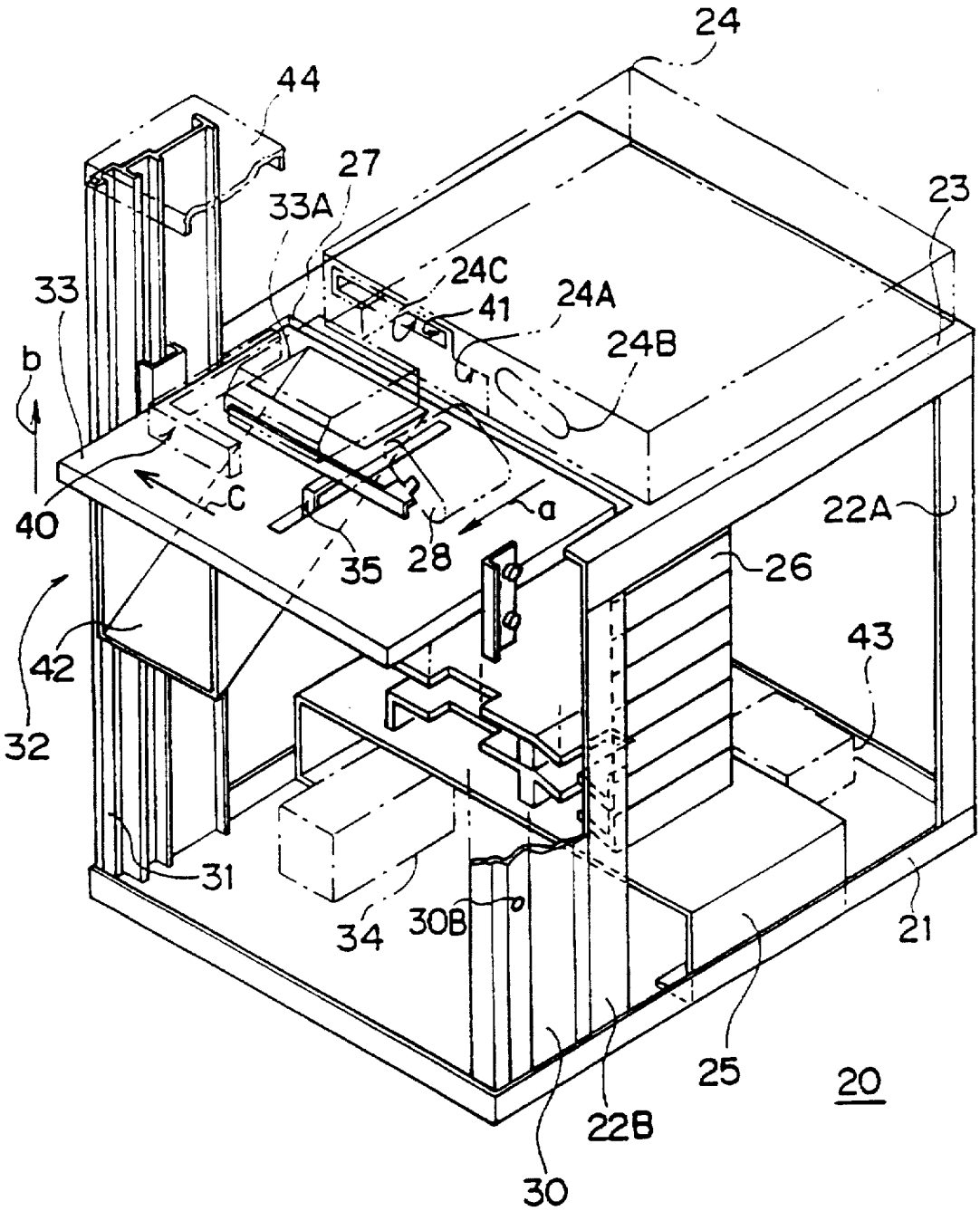
FIG. 2 is a schematic perspective view showing the overall construction of one embodiment of an autochanger according to the present invention.

[1] First Embodiment (1) Construction of Autochanger (1-1) Overall Construction of Autochanger In FIG. 2, reference numeral 20 denotes an autochanger, which is constructed so that a video printer device can be operated continuously without having recourse to intervention by an operator for a long period of time.

More particularly, in the autochanger 20, on the upper ends of four supporting frame components 22A and 22B installed in a plate-shaped base member 21, a top plate 23 is provided in parallel with the base member 21, and a video printer device 24 having the same construction as the video printer device 1 shown in FIG. 1 from which the front panel 3 is removed is installed on the top plate 23 so that the loading direction of the paper feed tray 27 and the ink ribbon cartridge 28 becomes consistent with the forward direction of the autochanger 20 as indicated by arrow "a".

In this case, a plurality of through holes (not shown) is provided in the top plate 23. Thus, in the autochanger 20, the video printer device 24 can be held in a predetermined position on the top plate 23 by means of screws or pins inserted through the through holes from the bottom surface side of the top plate 23.

Figure 3:
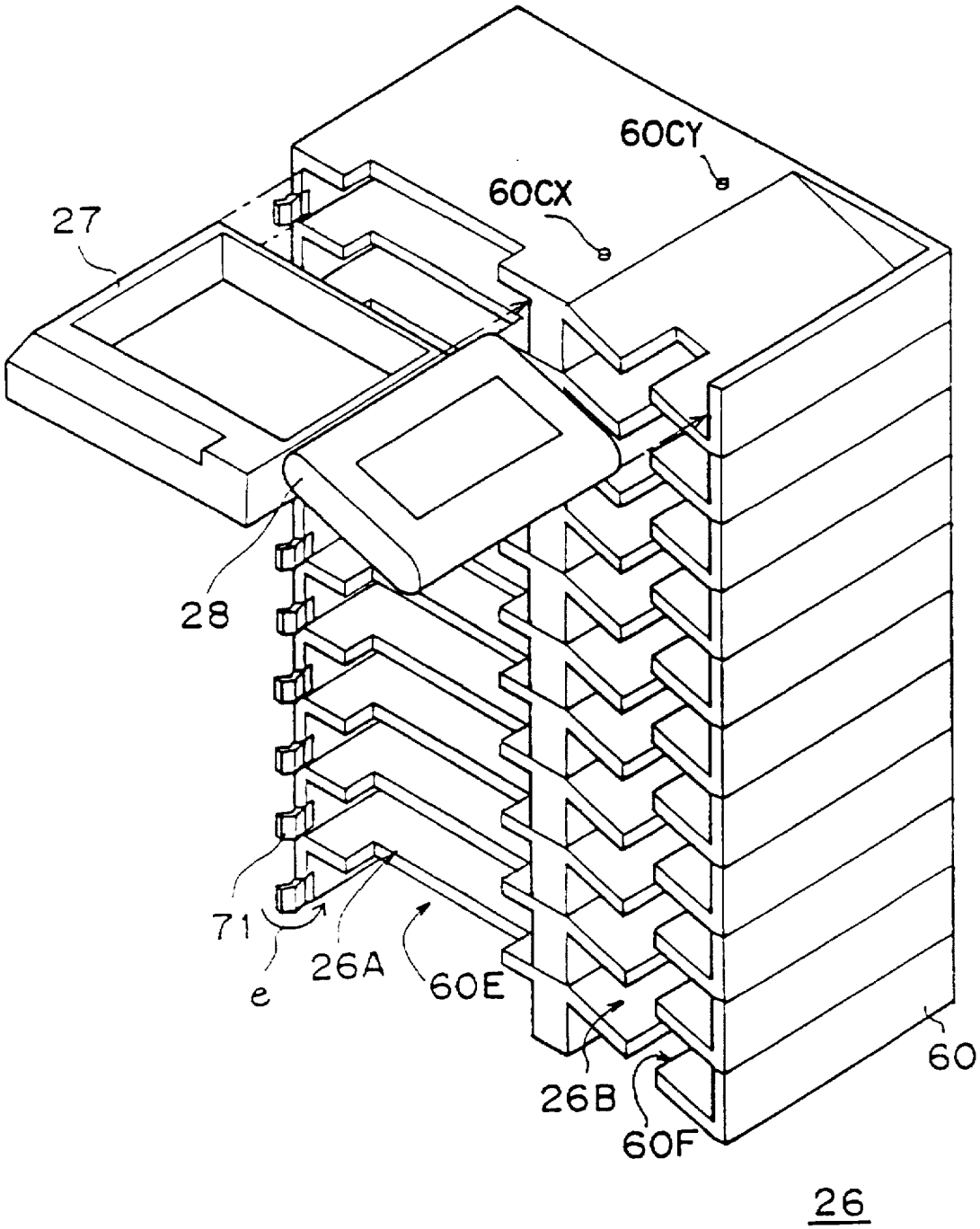
FIG. 3 is a perspective view showing the construction of a magazine.

A magazine 26 is installed through a magazine fixing component 25 on the upper surface of the base member 21. The magazine 26 comprises a plurality of paper feed tray compartments 26A and a plurality of ink ribbon cartridge compartments 26B which are disposed in sequence in the direction of the height of the magazine 26, as shown in FIG. 3. The paper feed tray 27 and the ink ribbon cartridge 28 can be housed in the paper feed tray compartments 26A and ink ribbon cartridge compartments 26B with the same positional relationship as that of the tray 27 and the cartridge 28 which have been loaded into the video printer device 24.

The magazine 26 is positioned and secured on the upper surface of the magazine fixing component 25 so that the housing direction of the paper feed tray 27 and the ink ribbon cartridge 28 becomes consistent with the forward direction of the autochanger 20.

Therefore, in the autochanger 20, the paper feed tray 27 and the ink ribbon cartridge 28 pulled out of the magazine 26 can be loaded together into the video printer device 24 by simply moving them in forward and backward direction of the autochanger 20, or the upward and downward direction shown by an arrow "b" (FIG. 2), while maintaining the positional relationship between the tray 27 and the cartridge 28. In addition, the paper feed tray 27 and the ink ribbon cartridge 28 taken out of the video printer device 24 can be housed together in the magazine 26 by simply moving them in the forward and backward directions and in the upward and downward directions of the autochanger 20, while maintaining the positional relationship between the tray 27 and the cartridge 28.

For this reason, in the autochanger 20, as a means for moving the paper feed tray 27 and the ink ribbon cartridge 28 in the forward and backward directions and in the upward and downward directions of the autochanger 20 while maintaining the positional relationship between the tray 27 and the cartridge 28, a pair of column-shaped guide frame components 30 and 31 is vertically installed in the front ends of the base member 21, and an elevator plate 33 of a movable pickup 32 engages with the guide frame components 30 and 31 so that it can slide along the frame members 30 and 31 in the upward and downward directions of the autochanger 20.

In this case, the elevator plate 33 is moved along the guide frame components 30 and 31, based on the output of an elevator-plate drive unit 34.

The elevator plate 33 also has a loading unit 35 for conveying the paper feed tray 27 and the ink ribbon cartridge 28 together in the forward and backward directions of the autochanger 20. By means of the loading unit 35, the paper feed tray 27 and the ink ribbon cartridge 28 housed in the magazine 26 are together pulled out onto the elevator plate 33, while maintaining the positional relationship between the tray 27 and the cartridge 28, and then they are loaded together into the video printer device 24, while maintaining that positional relationship. Likewise, by means of the loading unit 35, the paper feed tray 27 and the ink ribbon cartridge 28 loaded in the video printer device 24 are together pulled out onto the elevator plate 33, while maintaining the positional relationship between the tray 27 and the cartridge 28, and then they are together housed in the magazine 26, while holding that positional relationship.

Therefore, in the autochanger 20, by driving and controlling the elevator-plate drive unit 34 and the loading unit 35 as the occasion demands, the paper feed tray 27 and the ink ribbon cartridge 28 loaded into the video printer device 24 are pulled out onto the elevator plate 33. The paper feed tray 27 and the ink ribbon cartridge 28 on the elevator plate 33 are then conveyed to a height (hereinafter, referred to as "a housing and pullout height position") at which they can be housed in or pulled out of a corresponding paper feed tray compartment 26A and a corresponding ink ribbon cartridge compartment 26B of the magazine 26 by lowering the elevator plate 33 and simply moving the paper feed tray 27 and the ink ribbon cartridge 28 in the forward and backward directions of the autochanger 20. Finally, the tray 27 and cartridge 28 conveyed to the housing and pullout height position are housed by forcibly moving them into the corresponding paper feed tray compartment 26A and the corresponding ink ribbon cartridge compartment 26B (a series of these operations will hereinafter be referred to as "a housing operation").

Also, in the autochanger 20, by driving and controlling the elevator-plate drive unit 34 and the loading member 35 as the occasion demands, the paper feed tray 27 and the ink ribbon cartridge 28 housed in the magazine 26 are pulled out onto the elevator plate 33, and they are then conveyed to a position (hereinafter, referred to as "a loading height position") at which they can be loaded into or pulled out of the video printer device 24 by raising the elevator plate 33 and simply moving the paper feed tray 27 and the ink ribbon cartridge 28 in the forward and backward directions of the autochanger 20. Finally, the tray 27 and cartridge 28 conveyed to the loading height position are loaded into the video printer device 24 by forcibly moving them into a paper feed tray insertion hole 24A and an ink ribbon cartridge insertion hole 24B of the video printer device 24 (a series of these operations will hereinafter be referred to as "a loading operation"). Thus, the paper feed tray 27 and the ink ribbon cartridge 28 loaded in the video printer device 24 can be changed together by consecutively executing the housing operation and the loading operation.

Further, in the movable pickup 32, according to the position of the paper discharge compartment 24C of the video printer device 24, a printing paper discharge unit drive means 40 is provided at the left of the autochanger 20 indicated by arrow c on the upper surface of the elevator plate 33.

The printing paper discharge unit drive means 40 engages with a printing paper discharge unit 41 attached within the paper discharge compartment 24C of the video printer device 24, when the elevator plate 33 is in the loading height position. When the printing paper discharge unit 41 is engaged by the printing paper discharge unit drive means 40, it is driven and discharges the printing paper discharged within the paper discharge compartment 24C of the video printer device 24 from the paper discharge compartment to outside of the video printing device 24 (this operation will hereinafter be referred to as "a paper discharge operation").

For this reason, in the movable pickup 32, the elevator plate 33 is constructed with an opening (hereinafter referred to as "a paper discharge opening") 33A at a position corresponding to the paper discharge compartment 24C of the video printer device 24, and also a chute 42 is attached to the under side of the elevator plate 33 so as to be connected to the paper discharge opening 33A. Therefore, the printing paper discharged from the paper discharge compartment 24C of the video printer device 24 by means of the printing paper discharge unit 41 can be discharged through the paper discharge opening 33A of the elevator plate 33 and the chute 42 to outside of the autochanger 20.

It is to be noted that, in the case of this autochanger 20, the elevator-plate drive unit 34, the loading unit 35, and the printing paper discharge unit drive means 40 are driven based on a drive signal that is supplied from a controller 43 disposed on the base 21.

In this case, the controller 43 is constructed so as to send the drive signal to the elevator-plate drive unit 34, the loading unit 35, and the printing paper discharge unit drive means 40 as the occasion demands, based on information obtained by communicating with the video printer device 24, an operation command input by operating an operation switch of an operation panel for service (not shown) (hereinafter referred to as "a service operation panel") disposed on the front end of the base member 21, or an operation command input by operating an operation switch of an operation panel for users (not shown) (hereinafter referred to as "a user operation panel") disposed on the top plate 44 disposed between the guide frame components 30 and 31. Therefore, the movable pickup 32 is caused to execute the above-described housing operation or loading operation, and the printing paper discharge unit 41 is also caused to execute the above-described paper discharge operation.

(1-2) Construction of Magazine

Figure 4:
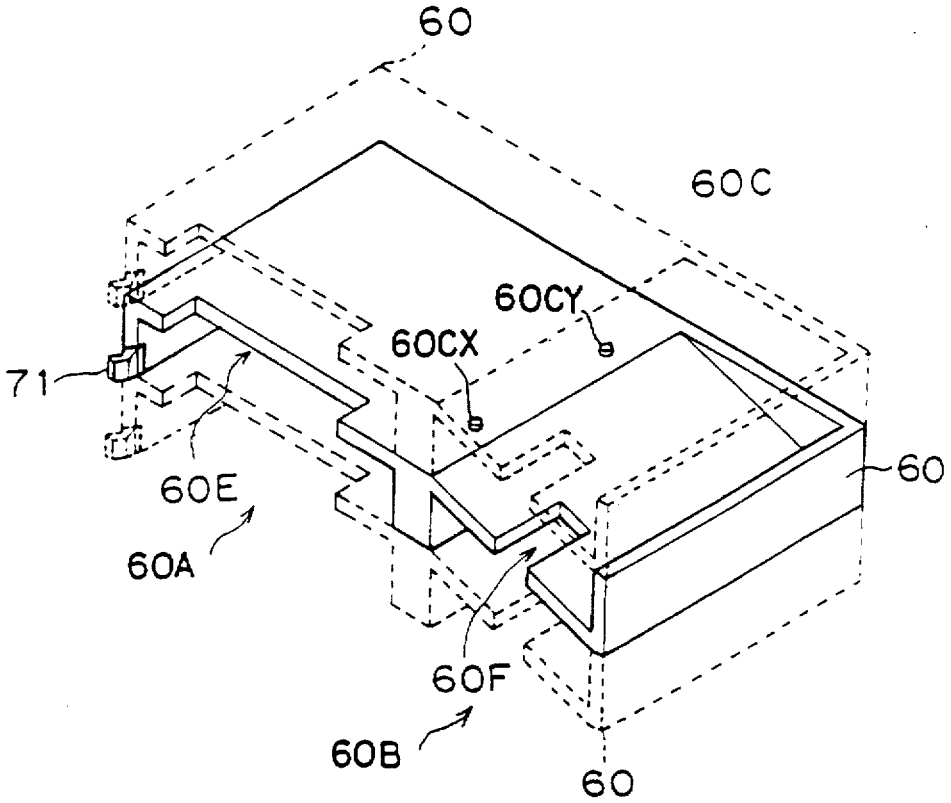
FIG. 4 is a perspective view showing the construction of a magazine unit.
Figure 5:
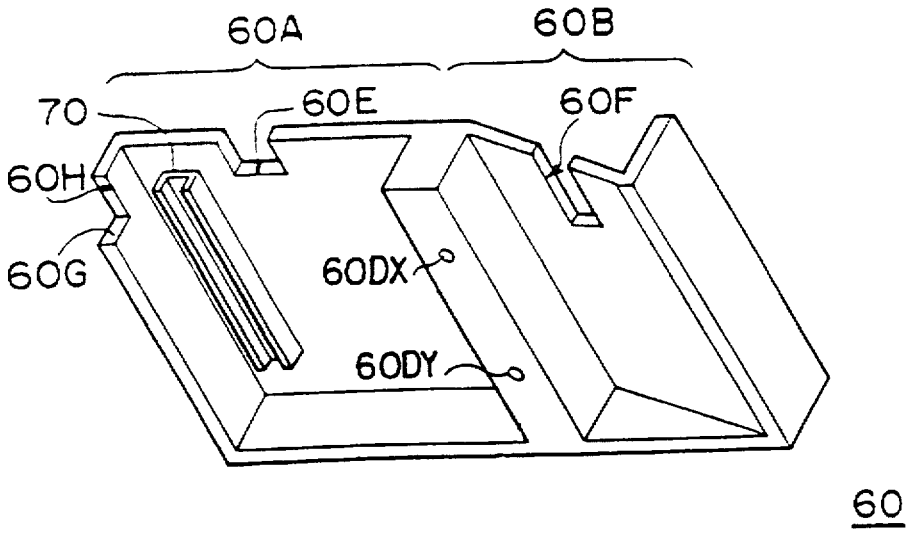
FIG. 5 is a perspective view showing the construction of a magazine unit.

Here, the magazine is constructed by stacking a plurality of magazine units 60 such as that shown in FIG. 4 or 5.

More specifically, each magazine unit 60 comprises a paper feed tray compartment structure 60A with a generally U-shape in the transverse cross plane,and an ink ribbon cartridge compartment structure 60B with a generally N-shape in the transverse cross plane. The magazine unit 60 is constructed so that the paper feed tray compartment 26A (FIG. 3) of the magazine 26 is constructed from the inner side surfaces and the under side of the top wall of the paper feed tray compartment structure 60A of a first magazine unit 60, and the upper surface of the top wall of the paper feed tray compartment structure 60A of a second magazine unit 60 underlying the first magazine unit 60.

Further, the magazine unit 60 is also made so that the ink ribbon cartridge compartment 26B (FIG. 3) corresponding to that paper feed tray compartment 26A is formed by the upper surface and the inner side surface of the ink ribbon cartridge compartment structure 60B of the first magazine unit 60, and the under side and the side surface of the ink ribbon cartridge compartment structure 60B of the second magazine unit 60 overlying the first magazine unit 60.

For this reason, the magazine unit 60 is formed at predetermined positions of the upper surface with engagement projections 60CX and 60CY (FIG. 4) and at predetermined positions of the under side with the engagement holes 60DX and 60DY (FIG. 5). The magazine units 60 are stacked in sequence by inserting the engagement projections 60CX and 60CY of the first magazine unit 60 into the engagement holes 60DX and 60DY of the second magazine unit 60, and also inserting the engagement projections 60CX and 60CY of a third magazine unit 60 into the engagement holes 60DX and 60DY of the first magazine unit 60. Therefore, each paper feed tray compartment 26A and each ink ribbon cartridge compartment 26B can be formed with accuracy.

Figure 6:
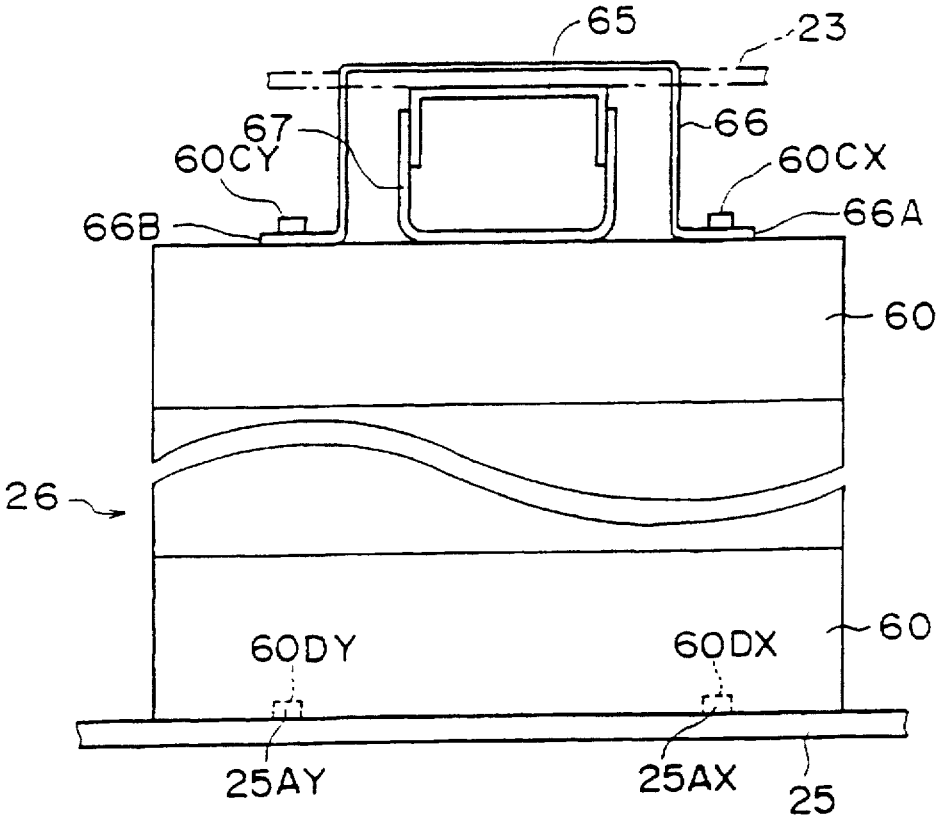
FIG. 6 is a schematic side view explaining the position determination of a magazine.
Figure 7:
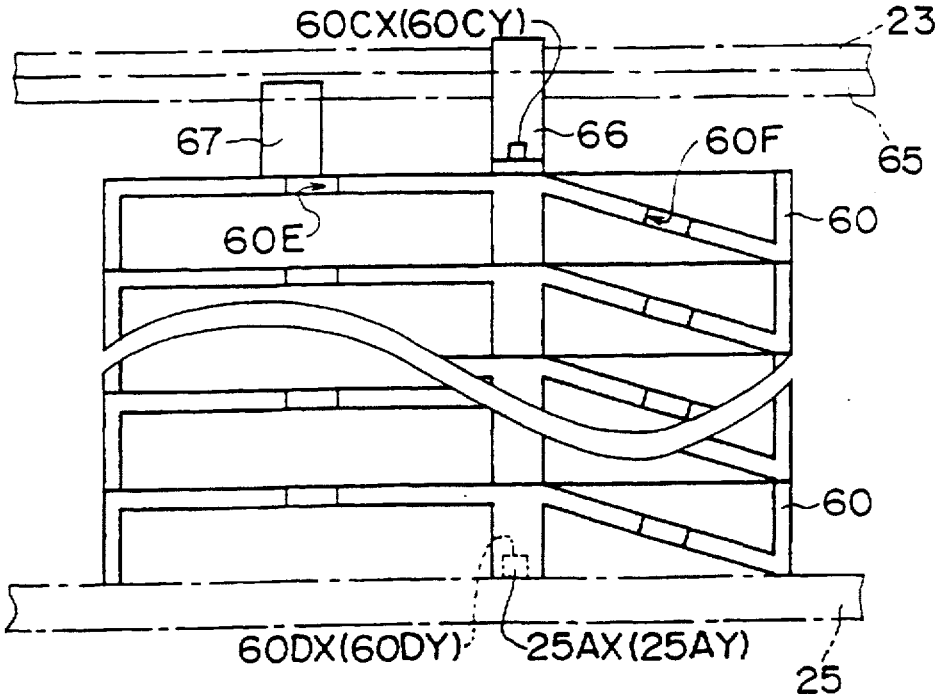
FIG. 7 is a schematic front view explaining the position determination of a magazine.

As shown in FIGS. 6 and 7, by inserting projections 25AX and 25BY formed at predetermined positions on the upper surface of the magazine fixing table 25 into engagement holes 60DX and 60DY of the lowermost magazine unit 60 of the magazine units 60 forming the magazine 26, the magazine 26 is positioned so that the housing direction of the paper feed tray 27 and the ink ribbon cartridge 28 becomes consistent with the forward direction of the autochanger 20.

To a frame component 65 for reinforcing the top plate 23 from the under side thereof is attached a supporting component 66 formed by bending a parallel plane to generally U-shape, in such a manner that the through holes (not shown) formed in the central portions of the flanges 66A and 66B of the supporting component 66 are engaged by engagement projections 60CX and 60CY of the uppermost magazine unit 60 of the magazine 26. Therefore, the upper end of the magazine 26 is positioned and supported in a fixed manner by means of the supporting component 66.

Further, a generally U-shaped plate spring 67 is attached to the frame component 65. The plate spring 67 is attached at the flanges of the frame component 65 and at the under side thereof to the upper surface of the magazine 26. Therefore, the magazine 26 is elastically urged against the magazine fixing table 25 by means of the elastic force of the plate spring 67, so the accurately positioned state of the magazine 26 can be held regardless of changes in the temperatures of the magazine units 60.

In this embodiment, the paper feed tray compartment structure 60A of the magazine unit 60 is formed at the front end thereof with a generally U-shaped cutout 60E, as clearly shown in FIGS. 4 and 5. Likewise, the ink ribbon cartridge compartment structure 60B of the magazine unit 60 is formed at the front end thereof with a generally U-shaped cutout 60F. Therefore, in the magazine 26, when the loading unit 35 of the movable pickup 32 pulls out the paper feed tray 27 and the ink ribbon cartridge 28 loaded in the paper feed tray compartment 26A and the ink ribbon cartridge compartment 26B, the loading unit 35 can engage with the paper feed tray 27 and the ink ribbon cartridge 28 through the cutouts 60E and 60F.

Also, in this embodiment, a generally U-shaped bar component 70 comprising an elastic material such as rubber is attached to the under side of the paper feed tray compartment structure 60A of the magazine unit 60 in parallel with the inner side wall of the magazine unit 60, as will be seen from FIG. 5. Therefore, in the magazine 26, the printing paper in the paper feed tray 27 contained in the paper feed tray compartment 26A can be urged by means of the bar component 70, so that the printing paper can be prevented from separating.

Figure 8:
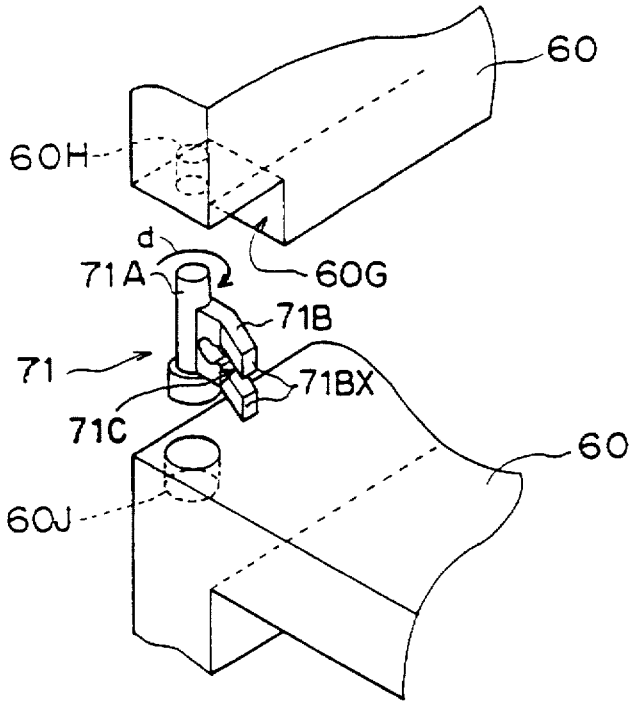
FIG. 8 is a schematic perspective view explaining the installation state of a mechanical flag.

Further, in this embodiment, as shown in FIG. 8, a rectangular cutout 60G is formed in the lower end of the side wall forming the paper feed tray compartment structure 60A (FIGS. 4 and 5) of the magazine unit 60, and a first mechanical flag engagement hole 60H is formed in the lower end surface of the cutout 60G.

Also, a second mechanical flag engagement hole 60J is formed at a predetermined position corresponding to the first mechanical flag engagement hole 60H in the upper surface of the magazine unit 60.

Therefore, in the magazine unit 60, a mechanical flag 71 is supported with the first mechanical flag engagement hole 60H of a first magazine unit 60 and the second mechanical flag engagement hole 60J of a second magazine unit 60 underlying the first magazine unit 60 so as to rotate freely.

Actually, in the mechanical flag 71, the upper end of the axial section 71A formed with a circular cylinder shape is inserted into the first mechanical flag engagement hole 60H of the first magazine unit 60, while the lower end of the axial section 71A is inserted into the second mechanical flag engagement hole 60J of the second magazine unit 60 underlying the first magazine unit 60, so as to attach to the magazine 26.

On the outer peripheral surface of the axial section 71A of the mechanical flag 71 is formed a plate-shaped projection 71B in parallel with the center axis of the axial section 71A. Viewing the mechanical flag 71 from upward, the projection 71B is formed with a bifurcated section 71BX slightly bent in the clockwise direction indicated by arrow "d".

When the paper feed tray 27 has been loaded into the paper feed tray compartment 26A of the magazine 26, the projection 71B of the mechanical flag 71 is rotated in the counterclockwise direction indicated by arrow "e" in FIG. 3 until it faces the front surface of the paper feed tray 27.

When the paper feed tray 27 has been pulled out of the paper feed tray compartment 26A, the projection 71B of the mechanical flag 71 is rotated along the front surface and side surface of the paper feed tray 27 in the counterclockwise direction and projected in the forward direction of the autochanger 20.

Therefore, in this magazine 26, by visually checking the state of the mechanical flag 71, it can be determined easily if the content of the paper feed tray 27 and the ink ribbon cartridge 28 corresponding to that mechanical flag 71 is used up or not.

Further, in this embodiment, a plurality of projections (not shown) is formed on the lower surface of the cutout 60G (FIG. 8) of the magazine unit 60. The projections are sized to the extent that they interfere with the rotation of the mechanical flag 71 and so that the upper end section of the projection 71B of the mechanical flag 71 is hung in sequence on the projections. Also, a cutout 71C is formed at the middle stage in the height direction in the projection 71B of the mechanical flag 71B.

Therefore, in the magazine 26, the mechanical flag 71 catches as it rotates, causing clicks, so that the mechanical flag 71 is prevented from rotating easily.

(1-3) Construction of Movable Pickup

Figure 9:
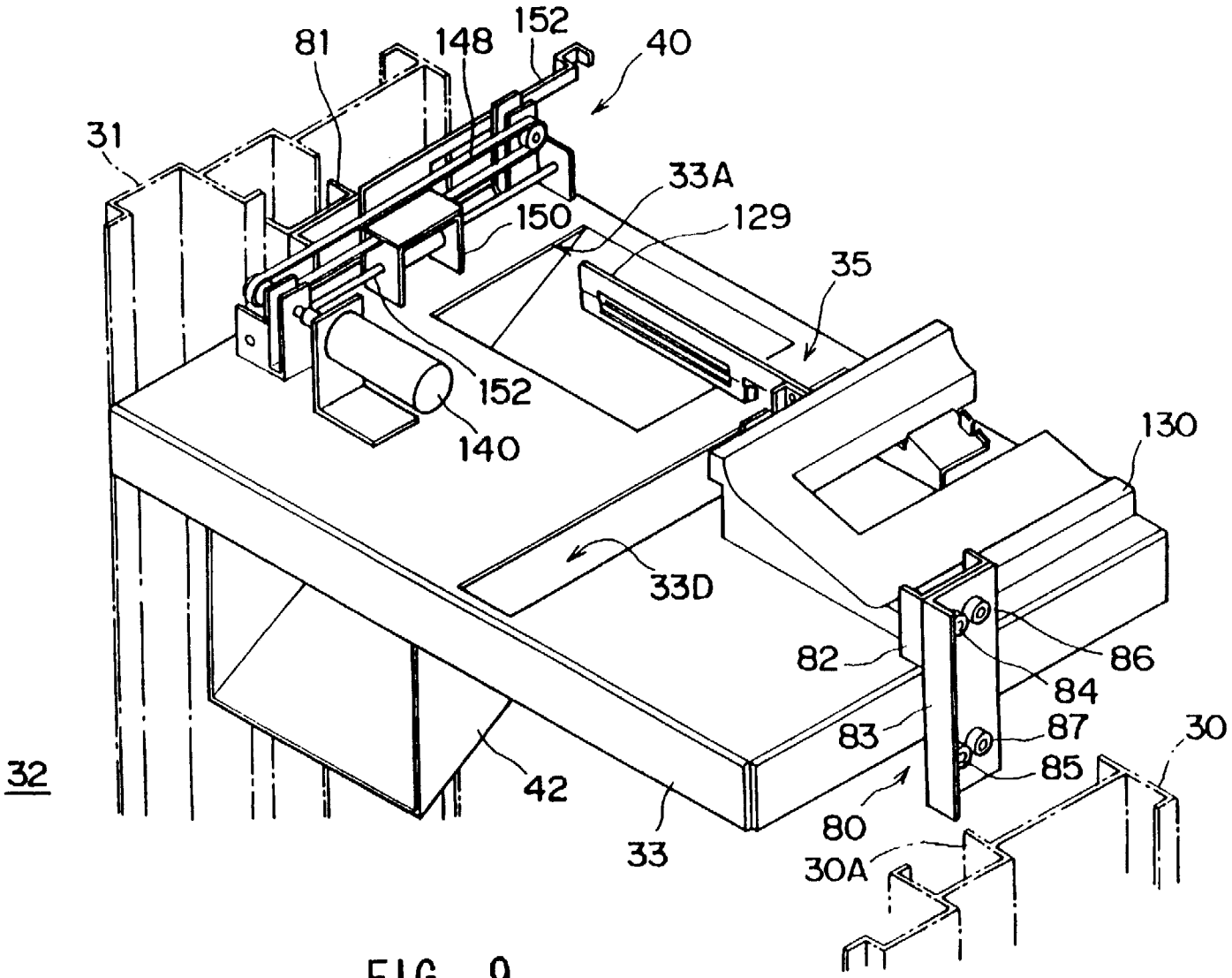
FIG. 9 is a schematic perspective view showing the construction of a movable pickup.

In the movable pickup 32, as shown in FIG. 9, the elevator plate 33 engages with the guide frame components 30 and 31 to carrier guides 80 and 81 installed on the side ends in the width direction of the elevator plate 33.

The carrier guide 80 is so constructed that, on the surface of roller plate 83 fixed on the elevator plate 33 with the fixing component 82 confronting to the guide frame component 30 to be put in line in vertical direction with the upper plane of the elevator plate 33, the rollers 84 and 85 are installed to rotate freely, and rollers 86 and 87 are installed to rotate freely installed to be input in line in parallel direction with the upper plane of the elevator plate 33 and the rollers 84 and 85.

This carrier guide 80 engages tfirough the rollers 84, 86 and the other rollers 85, 87 with a longitudinally extending guide projection 30A formed on the inner surface of the guide frame component 30, so that the carrier guide 80 can move smoothly along the guide projection 30A of the guide frame component 30.

The carrier guide 81 is substantially identical in construction to the carrier guide 80 and engages with the guide frame component 31 in the same manner as that of the carrier guide 80.

Therefore, the elevator plate 33 is supported in a state horizontal with the base member 21 by means of the carrier guides 80 and 81 and the guide frame components 30 and 31, and, based on a driving power supplied from the elevator-plate drive unit 34, the elevator plate 33 can be moved smoothly along the guide frame components 30 and 31 in the upward and downward directions of the autochanger 20, while it is being supported horizontally.

Figure 10:
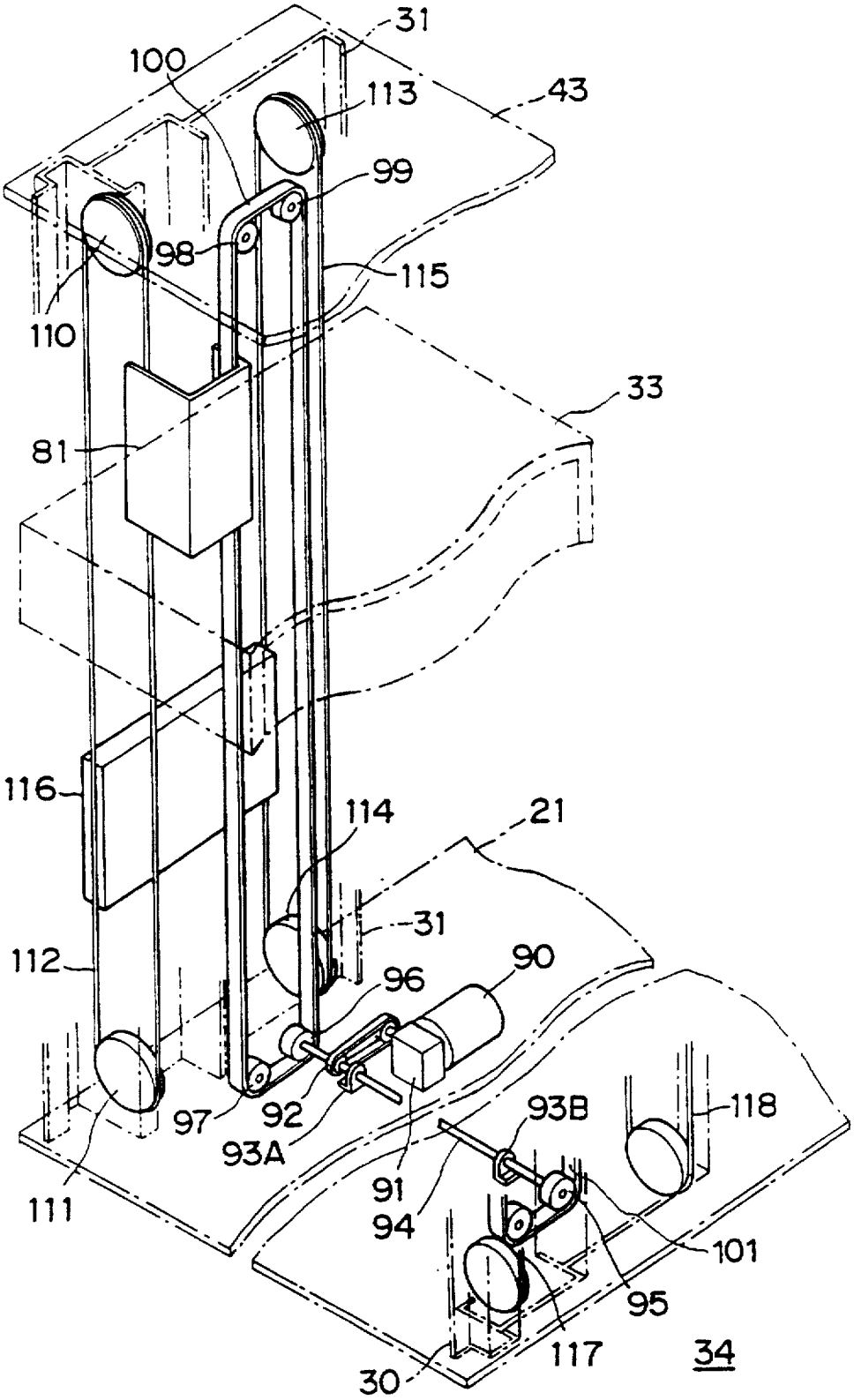
FIG. 10 is a schematic perspective view showing the construction of an elevator-plate drive unit.

The elevator-plate drive unit 34 has, as the source of its drive, a motor 90 disposed on the upper surface of the base member 21, as shown in FIG. 10. The output shaft of the motor 90 is connected through gears (not shown) of a gear box 91 and a belt 92 with a shaft 94 which can rotate freely and which is supported by L-shapes supporting components 93A and 93B. Therefore, in the elevator-plate drive unit 34, the shaft 94 can be rotated by the amount of rotation corresponding to the amount of rotation of the output shaft of the motor 90.

The shaft 94 is connected at one end with a gear 95 which can rotate freely and which is installed on the upper surface of the base member 21 in the vicinity of the guide frame component 30 and at the other end with a gear 96 which can rotate freely and which is installed on the upper surface of the base member 21 in the vicinity of the guide frame component 31, and the gears 95 and 96 are rotated at the same angular velocities in the same directions by the amount of rotation corresponding to that of the output shaft of the motor 90.

A timing belt 100 is provided so that its inner teeth engage with the gear 96, a gear 97 which can rotate freely and which is installed on the upper surface of the base 21 in parallel with the gear 96, and gears 98 and 99 which can rotate freely and which are installed on the under side of the top plate 43 bridging between the guide frame members 30 and 31 in the vicinity of the guide frame component 31. Therefore, the timing belt 100 can be rotated at the same rotational speed in the same direction, based on the rotational driving power supplied through the shaft 94 from the motor 90.

Likewise, the gear 95 engages with a timing belt 101 arranged along the guide frame component 30 in the same manner as the timing belt 100 and having the same construction as that of the timing belt 100, and the timing belt 101 is rotated at the same rotational speed in the same direction, based on the rotational driving power supplied through the shaft 94 from the motor 90.

Therefore, in the elevator-plate drive unit 34, the timing belts 100 and 101 can be rotated at the same rotational speed in the same direction, based on the rotational drive of the motor 90.

The timing belt 100 is fixed on the carrier guide 81 between the gears 96 and 99. The other timing belt 101 is also fixed on the carrier guide 80 (FIG. 9) in the same manner as the timing belt 100.

Therefore, the elevator-plate drive unit 34 can drive the elevator plate 33 to move upward and downward along the guide frame components 30 and 31 for a distance corresponding to the amount of rotation of the output shaft of the motor 90, by means of the timing belts 100 and 101. Consequently, the paper feed tray 27 and the ink ribbon cartridge 28 pulled out on the elevator plate 33 by means of the loading unit 35 (FIG. 2) can be conveyed in the upward and downward directions of the autochanger 20.

Further, there is fixed on the carrier guide 81 a wire 112 extending between a pulley 110 which can rotate freely and which is installed on the upper end of the guide frame component 31 and a pulley 111 which can rotate freely and which is installed on the lower end of the guide frame component 31.

There is fixed to the end of the elevator plate 33 on the side of the guide frame component 31 a wire 115 extending between a pulley 113 which can rotate freely and which is installed on the upper end of the guide frame component 31 and a pulley 114 which can rotate freely and which is installed on the lower end of the guide frame component 31.

Further, there is attached to the wires 112 and 115 a predetermined weight 116 at the outside of the guide frame component 31.

In the same manner as the wire 112, there is connected to the carrier guide 80 a wire 117 disposed along the guide frame component 30. In the same manner as the wire 115, there is connected to the end of the elevator plate 33 on the side of the guide frame component 30, a wire 118 disposed along the guide frame component 30. Further, there is attached to the wires 117 and 118 a predetermined weight (not shown) in the same manner as the wires 112 and 115.

Therefore, in the elevator-plate drive unit 34, each weight 116 goes down when the elevator plate 33 goes up, and each weight 116 goes up when the elevator plate 33 goes down, so that the plate 33 can be easily moved up and down with a small drive force without being subjected to the influence of gravity.

In this embodiment, the weight 116 is set so as to become almost equal to the weight of the elevator plate 33 when the paper feed tray 27 having about a hundred sheets of printing paper therein and the ink ribbon cartridge 28 are installed.

Figure 11:
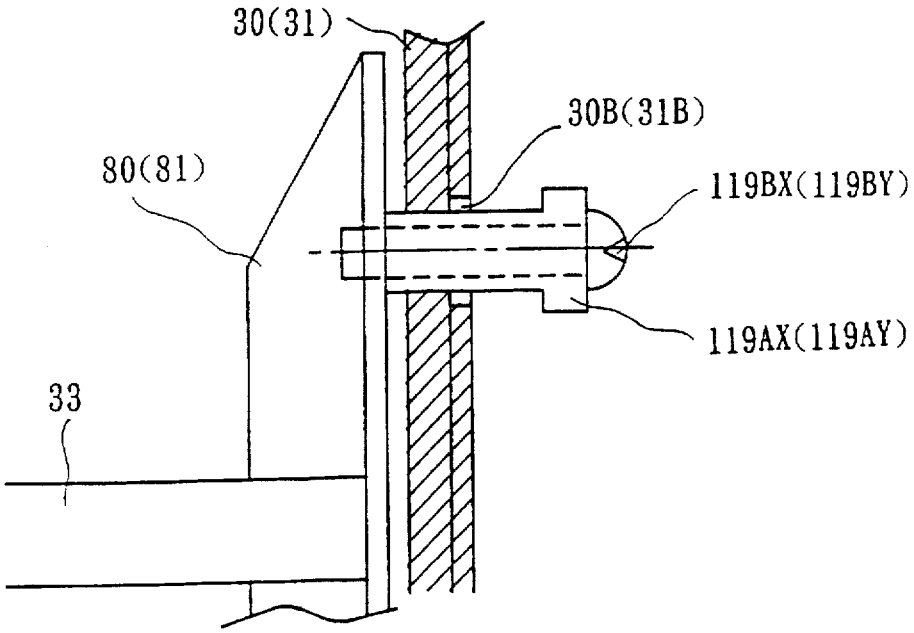
FIG. 11 is a sectional view explaining the method for fixing the elevator plate during conveyance.

In this embodiment, the guide frame components 30 and 31 are constructed at predetermined opposite height positions with screw holes 30B and 31B, as shown in FIGS. 2 and 11.

Therefore, in the autochanger 20, after the elevator plate 33 has been moved by the opposite surfaces of the guide frame members 30 and 31 of the roller mounting plate 83 consisting of the carrier guides 80 and 81 to the height position opposing the screw holes 30B and 31B, screws 119BX and 119BY are forcibly inserted through cylindrical adjustment screws 119AX and 119AY into the screw holes 30B and 31B so that they are brought into engagement with the elevator plate 33, so the elevator plate 33 can be fixed on the guide frame components 30 and 31 and problems which would otherwise occur because of the movement of the elevator plate 33 during the conveyance of the autochanger 20 can be prevented.

Figure 12:
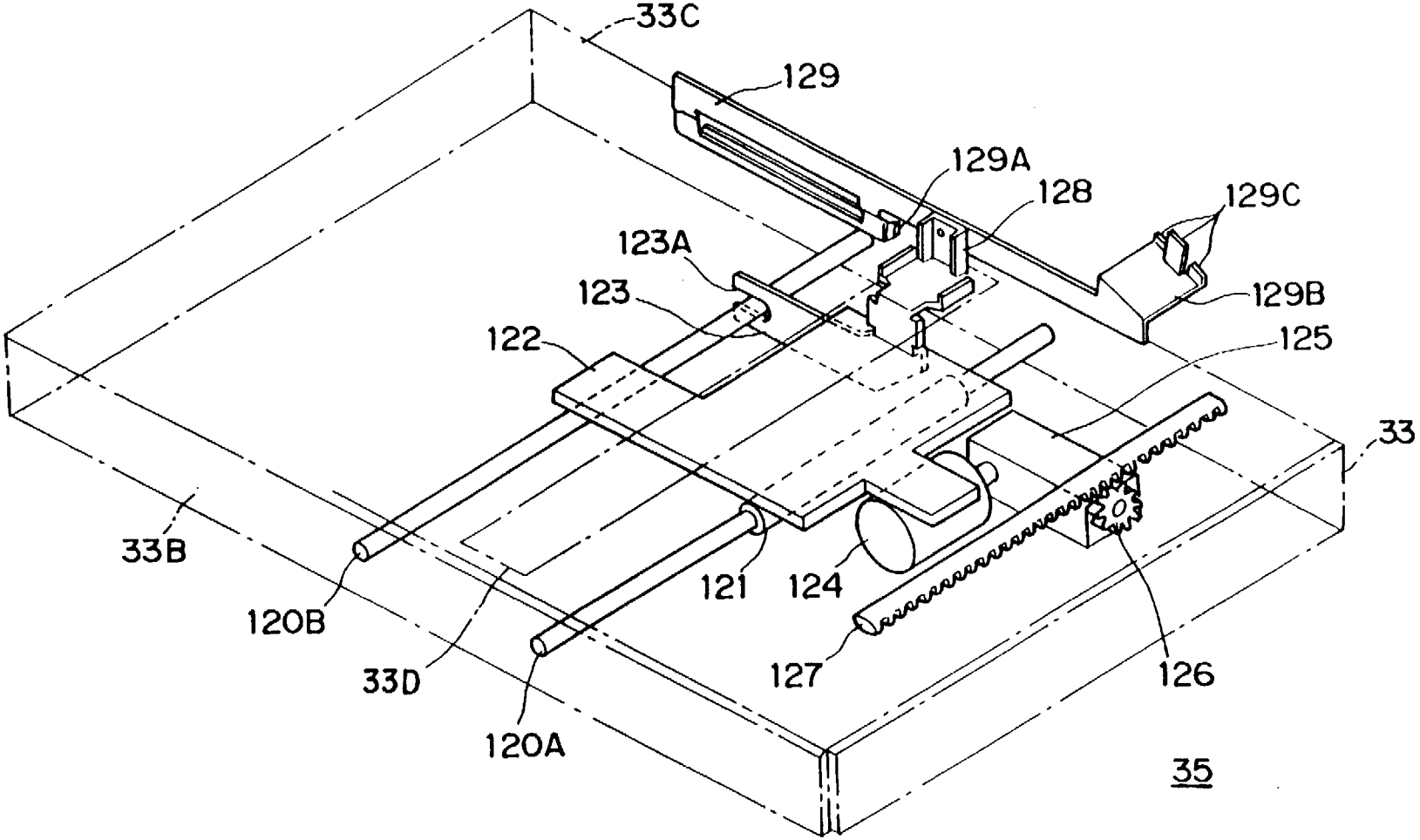
FIG. 12 is a schematic perspective view showing the construction of a loading unit.

In the loading unit 35, as shown in FIG. 12, are disposed a pair of shafts 120A and 120B which extend in parallel with the forward and backward directions of the autochanger 20 between a front wall 33B and a back wall 33C extending downwardly from the front and back ends of the elevator plate 33.

The shaft 120A has a cylindrical guide component 121 which can slide and which is installed thereon, and a movable plate 122 installed in a fixed manner on the cylindrical guide component 121.

The movable plate 122 has at its front end an L-shaped shaft engagement section 123 formed with a U-shaped cutout 123A, and the U-shaped cutout 123A, which can slide, engages with the shaft 120B.

The movable plate 122 also has installed thereon a motor 124 which is connected through the gears (not shown) of a gear box 125 and a pinion gear 126 to a rack 127 which is installed in a fixed manner on the under side of the elevator plate 33.

Therefore, based on the drive of the motor 124, the movable plate 122 of the loading unit 35 can be moved along the shafts 120A and 120B in the forward and backward directions of the autochanger 20.

At this time, the elevator plate 33 is formed at a position adjacent to the paper discharge opening 33A with an opening (hereinafter referred to as "a loading opening") 33D which is elongated in the forward and backward directions of the autochanger 20, as is clearly shown in FIG. 9.

As is shown in FIG. 12, the movable plate 122 further has a Z-shaped loading-arm mounting component 128 installed on the back end thereof. On the upper portion of the component 128 projecting from the loading opening 33D is installed a plate-shaped engagement member 129 comprising an elastic material.

Figure 13:
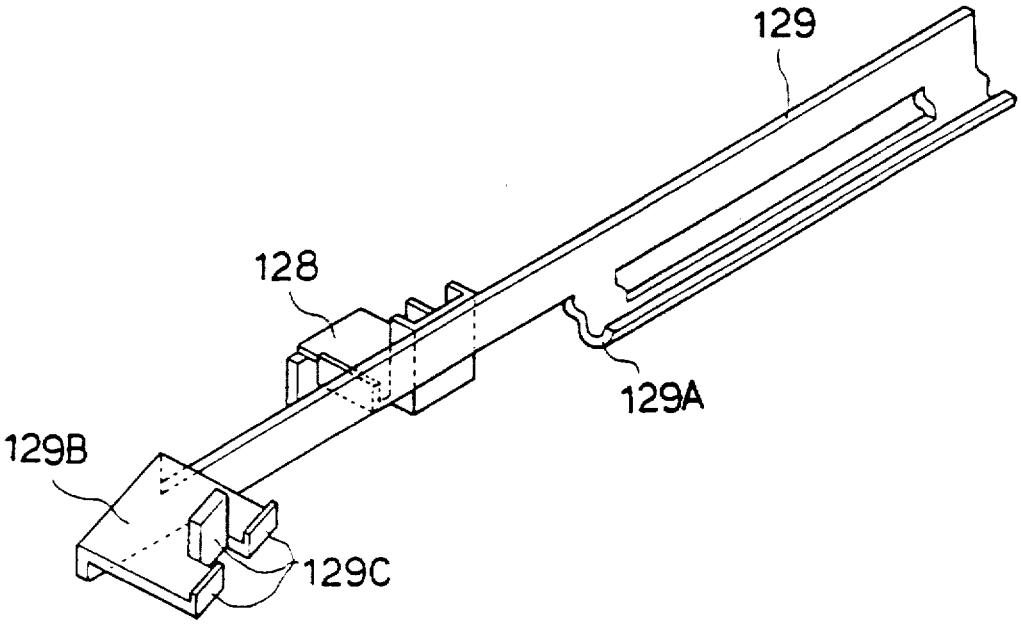
FIG. 13 is a perspective view showing the engagement member of the loading unit.
Figure 14:
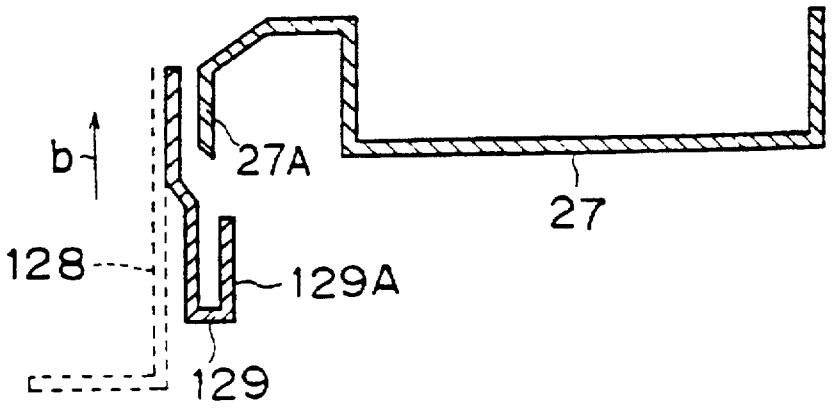
FIG. 14 is a sectional view explaining the engagement between the paper feed tray engagement pawl of the engagement member of the loading unit and a paper feed tray.

As will seen from FIGS. 12 and 13, the engagement member 129 has an engagement pawl 129A for the U-shaped paper feed tray protruding backward to the autochanger 20 at its end in the longitudinal direction facing the paper feed tray 27 loaded in the magazine 26. As shown in FIG. 14, the engagement member 129 engages with a paper feed tray 27 to be pulled out of the magazine 26 in such a manner that, in a state in which the movable plate 122 is held in a predetermined position (hereinafter referred to as "the back-end loading position") set at the back end of the elevator plate 33, when the elevator plate 33 is raised from a position slightly lower than that of the paper feed tray 27, the engagement pawl 129A is hung on the lower end of the front wall 27A of that paper feed tray 27 exposed through the cutout 60A (FIGS. 3 to 4) of the magazine unit 26.

Figure 15:
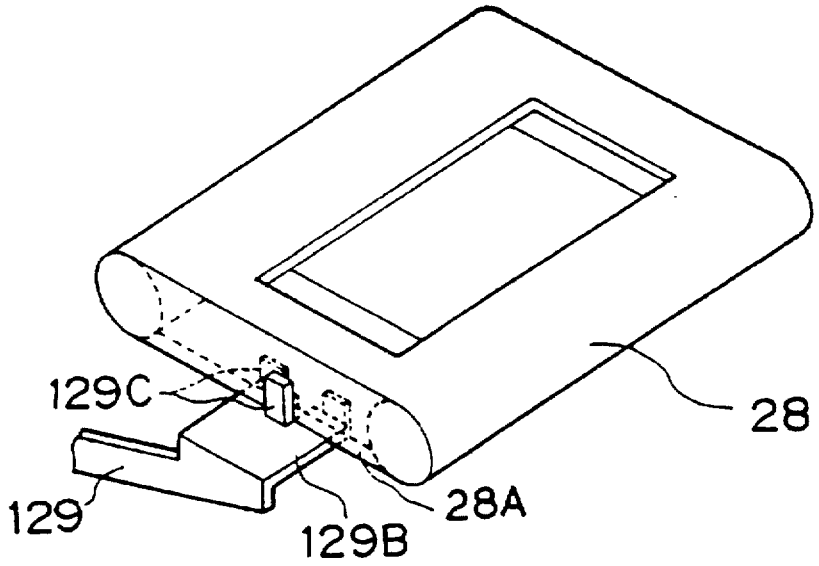
FIG. 15 is a schematic perspective view explaining the engagement between the ink ribbon cartridge engagement pawl of the engagement member of the loading unit and an ink ribbon cartridge.

As shown in FIGS. 12 and 13, the engagement member 129 also has an L-shaped bent section 129B at the other end parallel facing the ink ribbon cartridge 28 loaded in the magazine 26, and the bent section 129B is formed with engagement pawls 129C for engaging with the ink ribbon cartridge. As shown in FIG. 15, the engagement member 129 engages with an ink ribbon cartridge 28 to be pulled out of the magazine 26, in such a manner that, in the state in which the movable plate 122 (FIG. 12) is held in the back-end loading position, when the elevator plate 33 is raised from a position slightly lower than that ink ribbon cartridge 28, the ink ribbon cartridge engagement pawl 129C is hung on the lower end of the front wall 28A of that ink ribbon cartridge 28 exposed through the cutout 26B of the magazine unit 26.

Therefore, in the loading unit 35, in the state in which the movable plate 122 is held in the back-end loading position, when the elevator plate 33 is raised from a position slightly lower than a paper feed tray 27 and an ink ribbon cartridge 28 to be pulled out of the magazine 26, the engagement pawl 129A engage with the paper feed tray 27 and the engagement pawls 129C of the engagement member 129 engage with the ink ribbon cartridge 28 so that the paper feed tray 27 and the ink ribbon cartridge 28 can be pulled out of the magazine 26 together by moving the movable plate 122 in the forward and backward directions by driving the motor 124 in this state.

In this case, the paper feed tray 27 is pulled out to a predetermined position (hereinafter referred to as "a front-end loading position") provided in the front end of the elevator plate 33, while the state of the tray 27 loaded in the magazine 26 is being held and a section of the tray 27 is being slid between the paper discharge opening 33A and the loading opening 33B. The ink ribbon cartridge 28 is also pulled out to the above-described front-end loading position, while the cartridge 28 is being slid on the U-shaped upper surface of an ink ribbon cartridge holding component 130 (FIG. 9) disposed on the elevator plate 33.

The upper surface of the ink ribbon cartridge supporting component 130 is inclined at an angle corresponding to the angle of inclination of the ink ribbon cartridge 28 loaded in the magazine 26, so that the ink ribbon cartridge 28 can be maintained at the same angle of inclination as that of the ink ribbon cartridge 28 loaded in the magazine 26.

Therefore, in the loading unit 35, the paper feed tray 27 and the ink ribbon cartridge 28 pulled out of the magazine 26 can be held on the elevator plate 33, while the positional relationship of the tray 27 and cartridge 28 loaded in the magazine 26 is being maintained.

Figure 16:
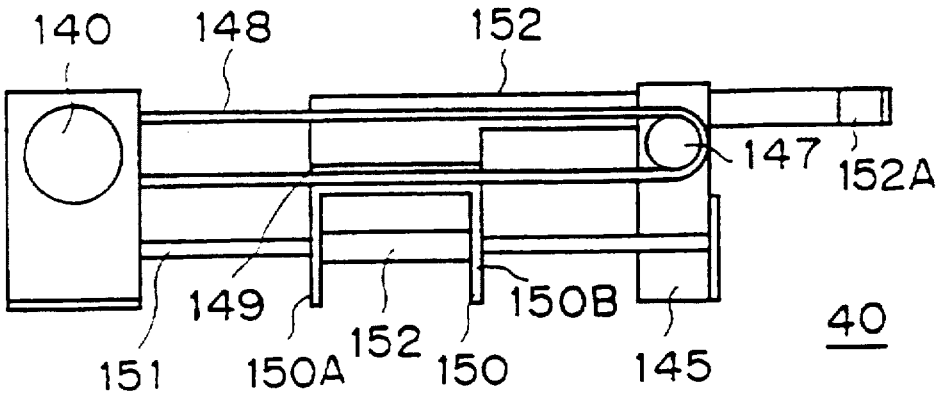
FIG. 16 is a schematic side view showing a printing paper discharge unit drive means.
Figure 17:
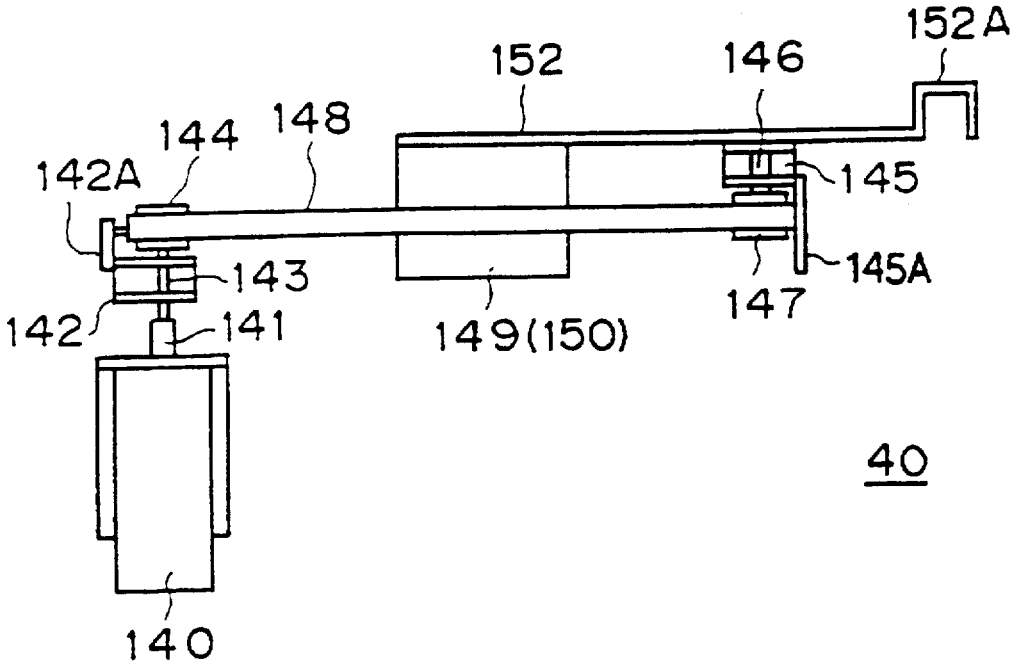
FIG. 17 is a schematic top view showing the printing paper discharge unit drive means.
Figure 18:
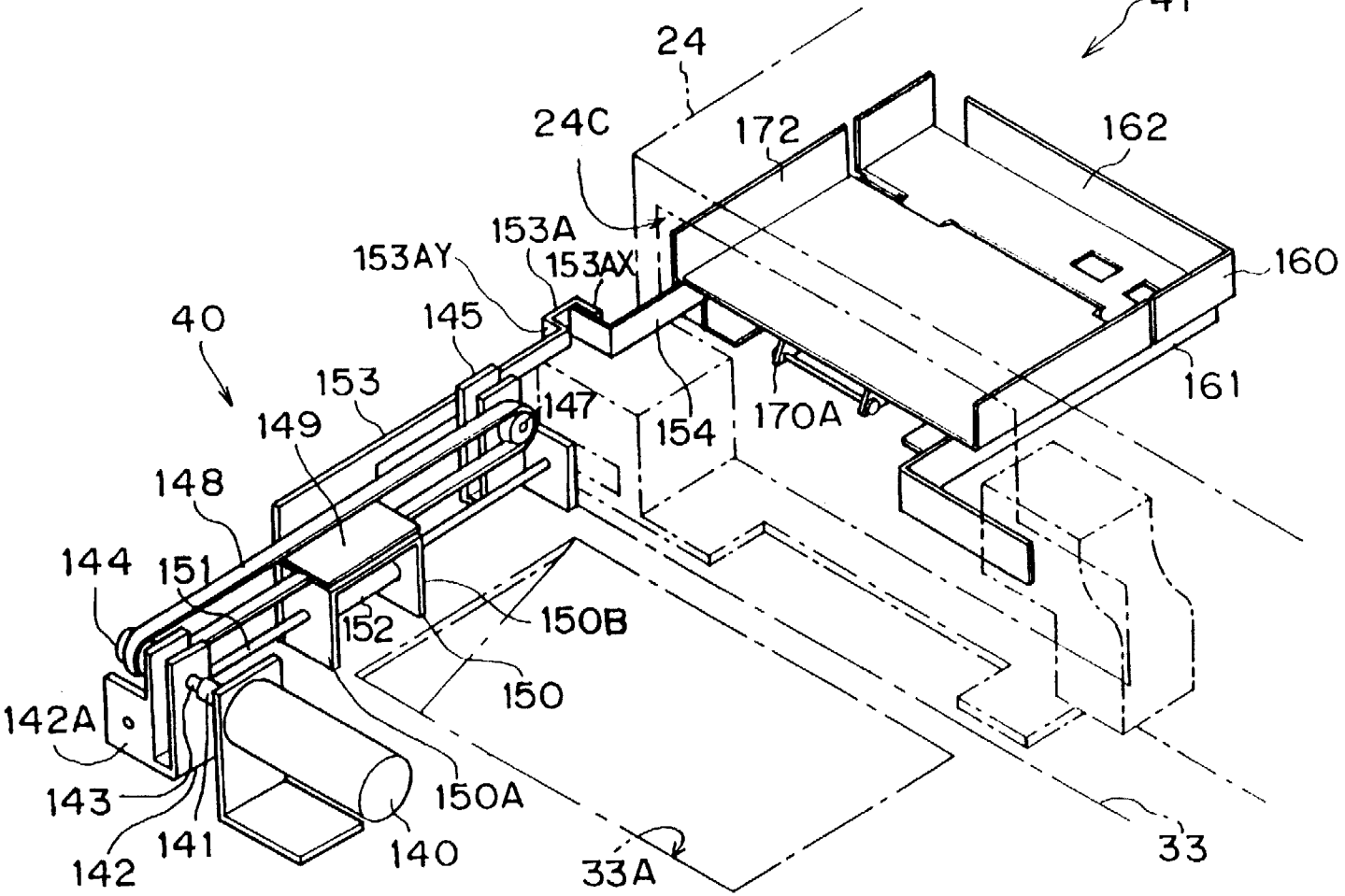
FIG. 18 is a schematic perspective view explaining the engagement between the printing paper discharge unit drive means and the printing paper discharge unit.

The above-described printing paper discharge unit drive means 40 has, as a drive source, a motor 140 disposed in front of the paper discharge opening 33A of the elevator plate 33, as shown in FIG. 9. The output shaft (not shown) of this motor 140 is connected through a coupling component 141 and a shaft component 143 freely rotatively supported on a generally U-shaped support component 142 to a roller 144, as shown in FIGS. 16, 17, and 18.

On the back end of the elevator plate 33 is disposed a shaft component 146 supported on a generally U-shaped support member 145 and able to rotate freely. The shaft component 146 extends in a direction vertical to the forward and backward directions of the autochanger 20. A roller 147 is installed on one end of the shaft component 146 in an opposing relationship with the roller 144. An endless belt 148 is disposed between the rollers 144 and 147.

Therefore, in the printing paper discharge unit drive means 40, the belt 148 is rotated in the forward and backward directions of the autochanger 20 as the motor 140 is driven.

A generally U-shaped guide-holding component 150 and a plate 149 are attached in a fixed manner on the belt 148 so that the belt 148 is sandwiched between the component 150 and the plate 149. Between the front wall 150A and the back wall 150B of the guide-holding component 150, a cylindrical guide component 152 is installed on a shaft 151 extending through the front wall 150A and the back wall 150B of the guide-holding component 150.

The shaft 151 is supported in a direction parallel to the forward and backward directions of the autochanger 20 by means of a shaft support component 142A projecting from the support component 142 and a shaft support component 145A projecting from the support component 145 (FIG. 17).

Therefore, in the printing paper discharge unit drive means 40, the guide-holding component 150 can be moved along the shaft 151 in the forward and backward directions of the autochanger 20 by rotating the belt 148.

On the guide-holding component 150 is installed, in a fixed manner, an L-shaped engagement member 153 having one end directed in the backward direction of the autochanger 20.

The engagement member 153 has a generally U-shaped bent section 153A at one end thereof. When the elevator plate 33 is held in the above-described loading height position and the engagement member 153 is held in a predetermined reference position (hereinafter referred to as "a paper discharge operation starting-point position"), the length of the engagement member 153 is selected so that the forward end of a lever component 154 of the above-described printing paper discharge unit 41 housed in the video printer device 24 is interposed between the front wall 153AX and the back wall 153AY of the bent section 153A, as shown in FIG. 18.

Therefore, in the printing paper discharge unit drive means 40, when the motor 140 is driven to rotate, the engagement member 153 is moved in the forward and backward directions of the autochanger 20 together with the guide-holding component 150, so that the lever component 154 can be moved in the forward and backward directions with respect to the printing paper discharge unit 41 by means of the bent section 153A of the engagement member 153.

(1-4) Construction of Photographic Paper Discharge Unit

Figure 19:
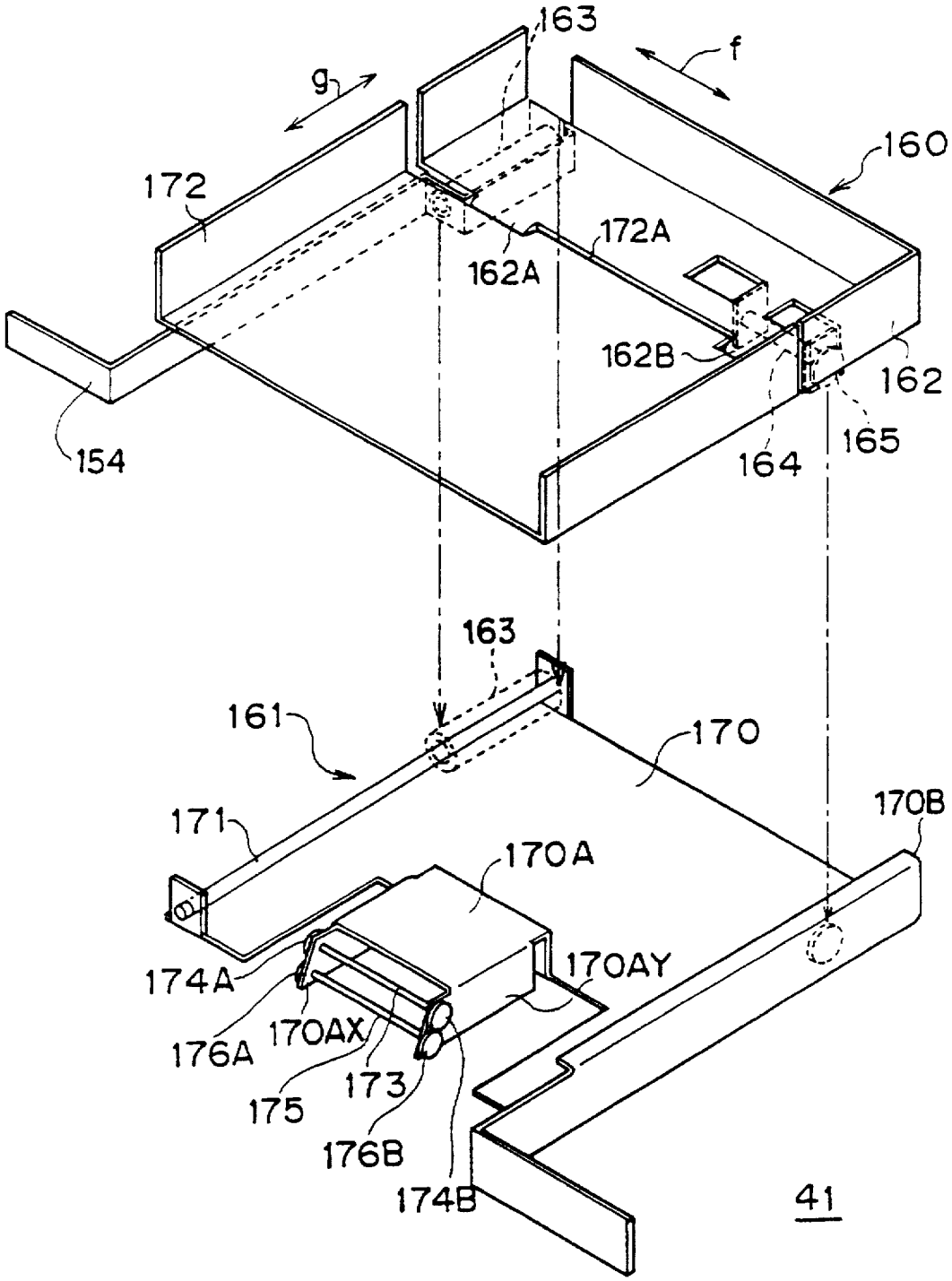
FIG. 19 is an exploded perspective view showing the printing paper discharge unit.

The printing paper discharge unit 41 comprises a paper discharge unit 160 and a tray guide plate unit 161, as shown in FIG. 19.

On the under side of an engagement plate 162 constituting the back of the paper discharge tray unit 160, at one side (hereinafter referred to as "the left side") of the printing paper discharge unit 41 indicated by arrow "f" is installed a cylindrical guide component 163 in the direction parallel to the forward and backward directions of the printing paper discharge unit 41 indicated by arrow "g". At the other side (hereinafter referred to as "the right side") of the printing paper discharge unit 41, a roller 165 which rotates freely is installed on the under side of the engagement plate 163 through a shaft component 164 supported in the lateral direction of the printing paper discharge unit 41.

On a tray guide plate 170 constituting the tray guide plate unit 161, a shaft 171 is installed, which extends parallel in the forward and backward directions of the printing paper discharge unit 41 and passes through the through hole of the cylindrical engagement member 163 of the paper discharge tray unit 160.

Therefore, in the printing paper discharge unit 41, when the above-described lever component 154 installed on the under side of the paper discharge tray unit 160 and installed adjacent to the guide component 163 is pulled in the forward direction or pushed in the backward direction of the printing paper discharge unit 41, the paper discharge tray unit 160 can slide on the tray guide plate unit 161 along the shaft 161 in the forward and backward directions of the printing paper discharge unit 41.

For this reason, the tray guide plate 170 of the tray guide plate unit 161 is constructed with a roller guide 170B, by bending the other end of the plate 170 in U-shape in parallel with the shaft 171. Therefore, the roller 165 of the paper discharge tray unit 160 which rolls on the tray guide plate 170 can be prevented from moving up and down by means of the roller guide 170B of the tray guide plate unit 161.

On the front end of the engagement plate 162 of the paper discharge tray unit 160, a generally U-shaped inclinable tray 172 is installed, which rotates freely and which constitutes the front of the paper discharge tray unit 160.

The inclinable tray 172 is connected with the engagement plate 162 of the paper discharge tray unit 160 in a hinged relationship by interposing a cylindrical engagement projection 172A of the tray 172 between the first and second engagement projections 162A and 162B of the engagement plate 162 and passing a shaft component (not shown) between the projections 162A and 162B, so the inclinable tray 172 can be rotated on the shaft component in a direction perpendicular to the forward and backward directions of the printing paper discharge unit 41.

The tray guide plate 170 of the tray guide plate unit 161 is constructed with a convex section 170A. The convex section 170A is constructed by bending a section projecting from the front end of the tray guide plate 170 into a substantially Z shape. The convex section 170A has side walls 170AX and 170AY on which a shaft 173 is supported. The shaft 173 has installed thereon rollers 174A and 174B which project slightly from the upper surface of the convex section 170A.

Therefore, when the paper discharge tray unit 160 slides on the tray guide plate unit 161 in the forward direction of the printing paper discharge unit 41, the inclinable tray 172 slides while the parallel relationship of the tray 172 with the engagement member 162 is being maintained and the tray 172 is being supported on the rollers 174A and 174B, until the position of the center of gravity of the tray 172 goes beyond the rollers 174A and 174A. After the position of the center of gravity has gone beyond the rollers 174A and 174B, the inclinable tray 172 can be inclined on the rollers 174A and 174B along the front inclined section of the convex section 170A of the tray guide plate unit 161.

Also, in the state in which the inclinable tray 172 has been inclined along the front inclined section of the convex section 170A of the tray guide plate unit 161, when the paper discharge tray unit 160 slides on the tray guide plate unit 161 in the backward direction of the printing paper discharge unit 41, the inclinable tray 172 is rotated on the rollers 174A and 174B until the position of the center of gravity of the tray 172 goes beyond the rollers 174A and 174A, and then the inclinable tray 172 becomes parallel to the engagement plate 162. After the position of the center of gravity has gone beyond the rollers 174A and 174B, the inclinable tray 172 can slide while it is being supported on the rollers 174A and 174B and the parallel relationship of the tray 172 with the engagement member 162 is being maintained.

Furthermore, in the tray guide plate unit 161, the convex section 170A further has a shaft 175 supported on the side walls 170AX and 170AY at the lower portion of the side plate of the front inclined section. The shaft 175 has rollers 176A and 176B installed thereon.

Therefore, in the printing paper discharge unit 41, when the inclinable tray 172 of the paper discharge tray unit 160 is rotated on the rollers 174A and 174B as a fulcrum so as to become parallel to the front inclined section of the convex section 170A of the tray guide plate unit 161, the under side of the inclinable tray 172 can be prevented from sliding on the front inclined section of the convex section 170A of the tray guide unit 161.

Actually, in the printing paper discharge unit 41 constructed as described above, the tray guide plate unit 161 is installed in a fixed manner on the video printer device 24 so that the forward direction of the unit 41 becomes consistent with the forward direction of the video printer device 24 (i.e., the forward direction of the autochanger 20), and the printing paper discharged within the paper discharge compartment 24C of the video printer device 24 is received on the inclinable tray 172 of the paper discharge tray unit 160.

Therefore, in the printing paper discharge unit 41, in the state in which the elevator plate 33 is in the above-described loading height position and also the engagement member 153 of the printing paper discharge unit drive means 40 is in the above-described paper discharge operation starting-point position, if the engagement member 153 is moved to a predetermined position (hereinafter referred to as "a paper discharge operation front-end position") provided on the front end of the elevator plate 33, the lever component 154 will be pulled by the engagement member 153 and the paper discharge tray unit 160 will slide in the forward direction of the autochanger 20. Consequently, the inclinable tray 172 is inclined along the front inclined section of the convex section 170A of the tray guide plate unit 161, so the printing paper discharged on the inclinable tray 172 slides along the upper surface of the inclinable tray 172 and can be discharged outside the video printer device 24.

Also, in the printing paper discharge unit 41, if the engagement member 153 of the printing paper discharge unit drive means 40 is moved to a predetermined position (hereinafter referred to as "a paper discharge operation back-end position") provided slightly ahead of the paper discharge starting-point position, the lever component 154 will be pushed by the engagement member 153 and the paper discharge tray unit 160 will slide in the backward direction of the autochanger 20, so the inclinable tray 172 can return back to the above-described initial state.

In this embodiment, since the front inclined section of the convex section 170A of the tray guide plate unit 161 is inclined at an angle substantially equal to that of the chute 42 (FIG. 2), the printing paper discharged from the inclinable tray 172 can slide smoothly along the upper surface of the chute 42.

(1-5) Construction of Controller

Figure 20:
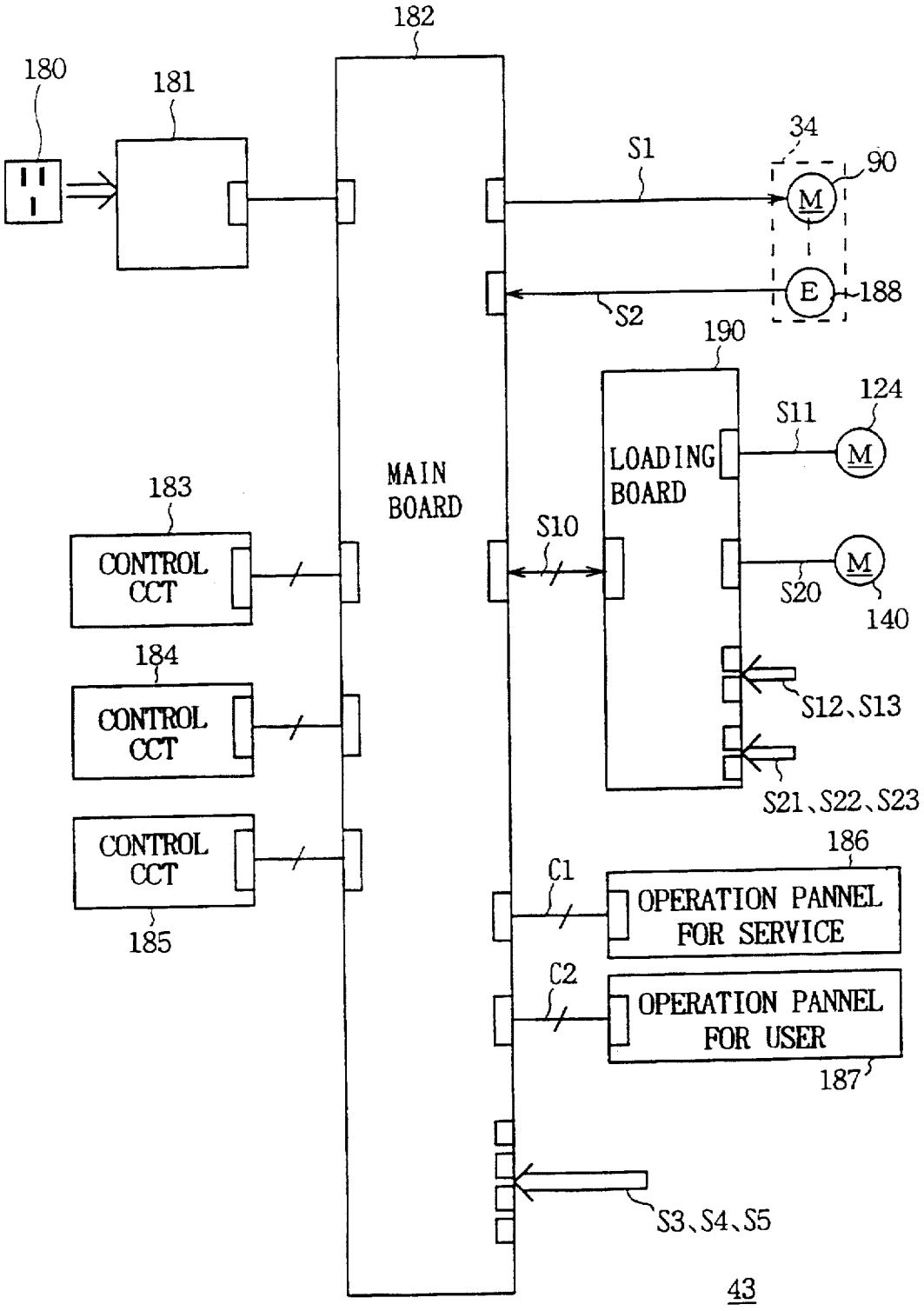
FIG. 20 is a block diagram showing a controller.

As shown in FIG. 20, in the controller 43, after a drive voltage supplied by a power supply 180 has been transformed into a predetermined voltage by a power-supply board 181, the predetermined voltage is supplied to a main board 182.

The main board 182 can communicate with a control circuit 183 of the video printer device 24 and with control circuits 184 and 185 of peripheral devices by means of, for example, RS232C communication.

Command C1 input from the above-described service operation panel 186 provided at the front end of the base 21 member (FIG. 2) and command C2 input from the above-described user operation panel 187 are supplied to the main board 182.

The main board 182 communicates with the video printer device 24, and sends a drive signal S1 to the motor 90 of the elevator-plate drive unit 34 based on commands C1 and C2, so that the motor 90 is driven and the elevator plate 33 is moved along the guide frame components 30 and 31 in the upward and downward directions of the autochanger 20, if necessary.

At this time, information on the rotation of the motor 90 is supplied as a rotation information signal S2 from an encoder 188 provided in the motor 90 of the elevator-plate drive unit 34 to the main board 182.

Also, an output S3 (hereinafter referred to as "first elevator-plate position information") of a position sensor (not shown) for sensing a reference section provided on the elevator plate 33 which is located in the starting-point position of the up and down operations (hereinafter referred to as "an elevator-plate starting-point position") provided on the lower end sections of the guide frame components 30 and 31, and an output S4 (hereinafter referred to as "second elevator-plate position information") of the position sensor (not shown) for sensing the reference section provided on the elevator plate 33 which is located in the above-described loading height position provided on the upper end sections of the guide frame components 30 and 31, are supplied to the main board 182 successively.

Reference plates (not shown) which are constructed with generally U-shaped cutouts are installed on the insides of the guide frame components 30 and 31, so that the cutouts correspond to the height positions of the paper feed tray compartments 26A (FIG. 3) of the magazine 26 and, a light emitting element (not shown) and a light receiving element (not shown) which are opposed through the reference plate are installed on the elevator plate 33. The light emitting element sends its output to a counter circuit (not shown). The counter circuit counts the number of pulses which appear on the output of the light receiving element each time the light beam emitted from the light emitting element, upon the upward and downward movements of the elevator plate 33, passes through each cutout of the reference plate. The count result is successively supplied as a count value information signal S5 to the main board 182.

Therefore, when the elevator plate 33 moves upward and downward, the main board 182 can drive and control the motor 90 of the elevator-plate drive unit 34, based on the rotation information signal S2 supplied by the encoder 188 of the elevator-plate drive unit 34. At the same time, the main board 182 references the rough position information of the elevator plate 33 that is obtained based on first elevator-plate position information S3, second elevator-plate position information S4, and the count value information signal S5. Consequently, the amount of movement of the elevator plate 33 can be controlled with accuracy.

Further, the main board 182 sends a control signal S10 to a loading board 190 as the occasion demands, based on communication with the video printer device 24 and commands C1 and C2 supplied from the service operation panel 186 or the user operation panel 187.

Based on the control signal S10 supplied by the main board 182, the loading board 190 sends a drive signal S11 to the motor 124 of the loading unit 35, when necessary, so that the motor 124 is driven and therefore the movable plate 122 (FIG. 12) of the loading unit 35 is moved from the above-described front-end loading position provided on the front end of the elevator plate 33 to the above-described back-end loading position provided on the back end of the elevator plate 33, or from the back-end loading position to the front-end loading position.

At this time, the loading board 190 is supplied with output S12 (hereinafter referred to as "first movable-plate position information") of a position sensor (not shown) for sensing a reference section provided on the movable plate 122 in the back-end loading position, and output S13 (hereinafter referred to as "second movable-plate position information") of the position sensor (not shown) for sensing the reference section provided on the movable plate 122 in the front-end loading position.

Therefore, the loading board 190 drives and controls the motor 124 of the loading unit 35, based on the control signal S10 supplied by the main board 182, first movable-plate position information S12, and second movable-plate position information S13. Consequently, the paper feed tray 27 and the ink ribbon cartridge 28 can be pulled out by the loading unit 35 onto the elevator plate 33 with reliability. The paper feed tray 27 and the ink ribbon cartridge 28 pulled out on the elevator plate 33 can also be reliably housed in the paper feed tray compartment 26A and the ink ribbon cartridge compartment 26B of the magazine 26, or loaded into the video printer device 24.

The loading board 190 sends drive signal S20 to the motor 140 of the printing paper discharge unit drive means 40 (FIGS. 16 to 18) as the occasion demands, based on the control signal S10 supplied from the main board 182. Thereby, the engagement member 153 (FIG. 18) of the printing paper discharge unit drive means 40 is moved in sequence from the above-described paper discharge operation starting-point position provided on the front end of the elevator plate 33 to the above-described paper discharge operation front-end position provided in front of the starting-point position, or from the paper discharge operation front-end position to the above-described paper discharge operation back-end position provided on the back end of the elevator plate 33, or from the paper discharge operation front-end position to the paper discharge operation starting-point position. Therefore, the paper discharge operation of the printing paper discharge unit 41 (FIG. 19) is thus executed by the loading board 190.

In addition to this, an output S21 (hereinafter referred to as "first engagement-member position information") of a position sensor (not shown) for sensing a reference section provided on the engagement member 153 in the paper discharge operation back-end position, an output S22 (hereinafter referred to as "second engagement-member position information") of the position sensor (not shown) for sensing the reference section provided on the engagement member 153 in the paper discharge operation starting-point position, and an output S23 (hereinafter referred to as "third engagement-member position information") of the position sensor (not shown) for sensing the reference section provided on the engagement member 153 in the paper discharge operation front-end position, are supplied to the loading board 190.

The loading board 190 thus drives and controls the motor 124 of the printing paper discharge unit drive means 40 40 40, based on the control signal S10 supplied by the main board 182, first engagement-member position information S21, second engagement-member position information S22, and third engagement-member position information S23. Therefore, the paper discharge operation of the printing paper discharge unit 41 can be executed with reliability.

(2) Construction of Main Board (2-1) Construction of Main Board

Figure 21:
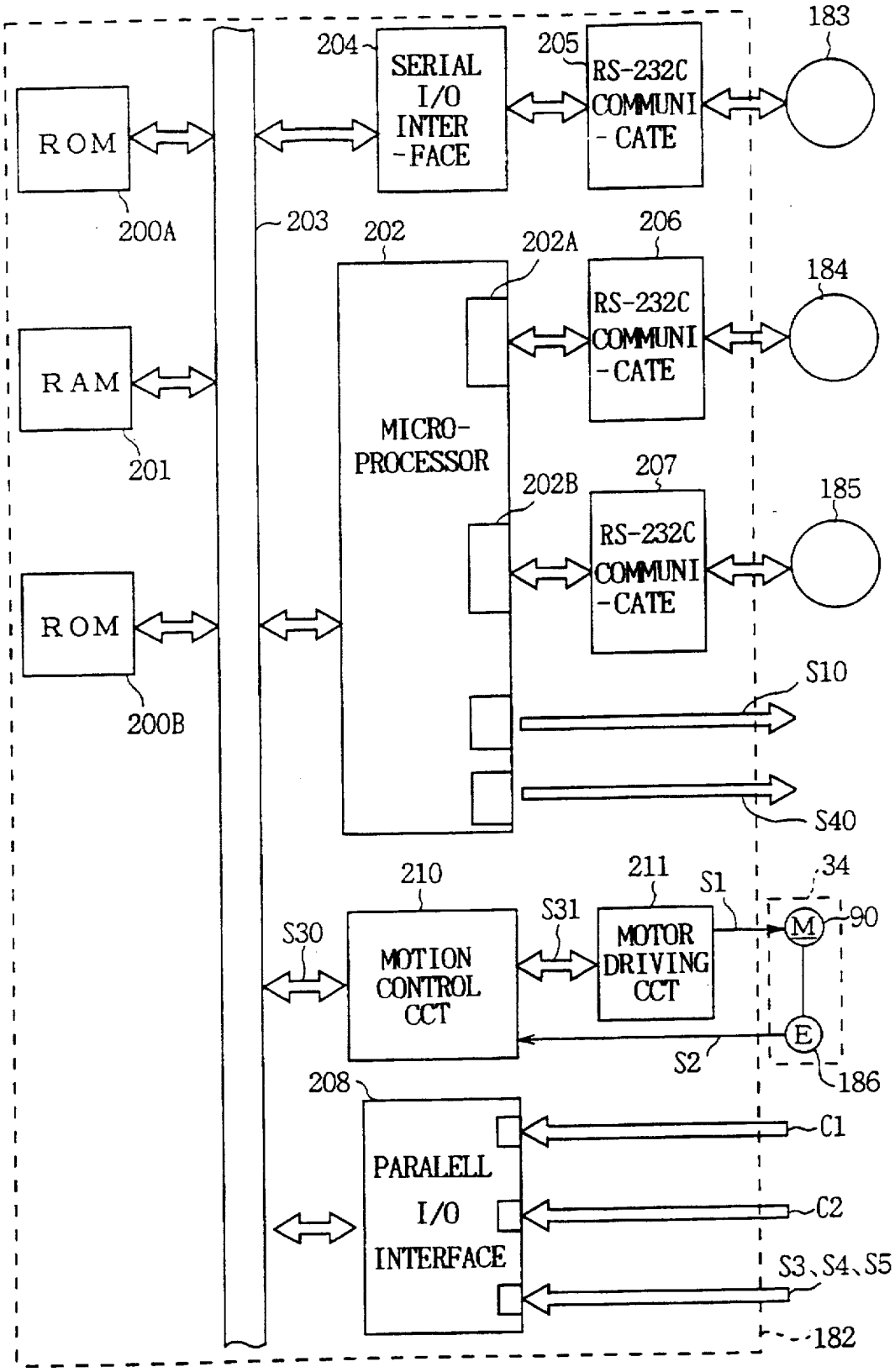
FIG. 21 is a block diagram showing the detailed main board.

The main board 182 comprises a ROM 200A, a ROM 200B, a RAM 201, and a microcomputer including a microprocessor 202, as shown in FIG. 21.

This microprocessor 202 sends various pieces of information through an internal bus 203 and a serial input-output interface 204 to a RS232C communication circuit 205, based on a program stored in the RAM 201. In the communication circuit 205, the various pieces of information are converted to an RS232C communication data format and then supplied to the control circuit 183 of the video printer device 24.

In the microprocessor 202, after information constituted in an RS232C communication data format which is supplied by the control circuit 183 of the video printer device 204 has been converted to an internal data format of the controller 43, this is input through the serial input-output interface 204 and the internal bus 203 to the microprocessor 202. Therefore, the microprocessor 202 can communicate with the control circuit 183 of the video printer device 24.

In the same manner, the microprocessor 202 communicates through an RS232C communication circuit 206 with the control circuit 184 of the peripheral device and through an RS232C communication circuit 207 with the control circuit 185 of the peripheral device.

Further, operation command C1 input from the service operation panel 186 (FIG. 20) and operation command C2 input from the user operation panel 187 (FIG. 20) are input through a parallel input-output interface 208 and the internal bus 203 to the microprocessor 202.

When, based on the information obtained by communication with the control circuits 183, 184, 185 and on operation commands C1 and C2 supplied by the user and service panels 186 and 187, if it is determined that it is necessary to move the elevator plate 33 up and down, the microprocessor 202 pulls out the programs stored in the ROM 200A and the ROM 220B and sends, to a motion control circuit 210, a target pulse signal S30 (hereinafter referred to as "a target pulse signal") comprising a predetermined number of pulses obtained based on the programs stored in the ROM 200A and the ROM 220B.

The motion control circuit 210, by sending a control signal S31 to a motor drive circuit 211 according to target pulse signal S30, causes the output shaft of the motor 90 of the elevator-plate drive unit 34 to rotate by a predetermined angle corresponding to the number of pulses of the target pulse signal S30, and also controls the motor 90, based on the rotation information signal S2 supplied by the encoder 186. Above-described first elevator-plate position information S3 and second elevator-plate position information S4 supplied by the position sensors disposed on the upper and lower end portions of the guide frame components 30 and 31, and above-described count value information signal S5 are input to the parallel input-output interface 208, which sends these through the internal bus 203 to the microprocessor 202.

Based on first elevator-plate position information S3 and second elevator-plate position information S4, the microprocessor 202 sends a new target pulse signal S30 to the motion control circuit 210 as the occasion demands so that the rotation of the motor 90 of the elevator-plate drive unit 34 can be controlled with accuracy and, consequently, the elevator plate 33 is moved accurately to the target height position.

Further, if abnormal information is obtained, the microprocessor 202 sends an error signal S40 to a display unit (not shown) comprising an LED, which displays the abnormal status.

Actually in the microprocessor 202, for example, in an operation mode (hereinafter referred to as "a loading operation mode") in which the loading operation is executed by the movable pickup 32 (FIG. 2), the motor 90 of the elevator-plate drive unit 34 is driven by first sending the target signal S30 to the motion control circuit 210 according to the programs stored in the ROM 200A and the ROM 200B. For this reason, the microprocessor 202 causes the elevator plate 33 to be raised to a predetermined position (hereinafter referred to as "an escape position") slightly lower than the above-described housing and pull-out height position corresponding to the paper feed tray compartment 26A and the ink ribbon cartridge compartment 26B of the magazine 26 in which a paper feed tray 27 and an ink ribbon cartridge 28 to be pulled out have been housed.

The microprocessor 202 then causes the motor 124 of the loading unit 35 to be driven by sending the control signal S30 to the loading board 190 (FIG. 20), so the movable plate 122 (FIG. 12) of the loading unit 35 is moved to the above-described back-end loading position.

Further, the microprocessor 202 causes the motor 90 of the elevator-plate drive unit 34 to rotate for a predetermined number of rotations by sending the target pulse signal S30 to the motion control circuit 210. Thus, the microprocessor 202 causes the elevator plate 33 to be raised to the above-described housing and pull-out height position corresponding to the paper feed tray compartment 26A and the ink ribbon cartridge compartment 26B of the magazine 26 in which a paper feed tray 27 and an ink ribbon cartridge 28 to be pulled out have been housed. Therefore, the microprocessor 202 causes the paper feed tray engagement pawl 129A and the ink ribbon cartridge engagement pawl 129C of the engagement member 129 (FIGS. 12 and 13) of the loading unit 35 to engage with the lower end 27A of the paper feed tray 27 and the lower end 28A of the ink ribbon cartridge 28 to be pulled out according to a program.

The microprocessor 202 then causes the motor 124 of the loading unit 35 to rotate by sending control signal S10 to the loading board 190. Therefore, the microprocessor 202 causes the movable plate 122 of the loading unit 35 to be moved to the front-end loading position, so that the paper feed tray 27 and the ink ribbon cartridge 28 are pulled out onto the elevator plate 33.

The microprocessor 202 then causes the motor 90 of the elevator-plate drive unit 34 to rotate for a predetermined number of rotations by sending target pulse signal S30 to the motion control circuit 210. Therefore, the microprocessor 202 causes the elevator plate 33 to be moved to the loading height position.

Thereafter, the microprocessor 202 sends control signal S10 to the loading board 190, and then the loading board 190 causes the motor 124 of the loading unit 35 to rotate. Therefore, the microprocessor 202 causes the movable plate 122 of the loading unit 35 to be moved to the back-end loading position so that the paper feed tray 27 and the ink ribbon cartridge 28 are pushed into the paper feed tray insertion opening 24A and the ink ribbon cartridge insertion opening 24B of the video printer device 24.

Therefore, in the microprocessor 202, the paper feed tray 27 and the ink ribbon cartridge 28 to be pulled out according to a program can be loaded into the video printer device 24. Thereafter, the paper feed tray 27 and the ink ribbon cartridge 28 are to be maintained with this state.

Also, in an operation mode (hereinafter referred to as "a housing operation mode") in which the movable pickup 32 is housed and operated, the microprocessor 202 sends control signal S10 to the loading board 190, and then the loading board 190 causes the motor 124 of the loading unit 35 to rotate. Therefore, the microprocessor 202 causes the movable plate 122 of the loading unit 35 to be moved to the front-end loading position, so the paper feed tray 27 and the ink ribbon cartridge 28 loaded in the video printer device 24 are pulled out onto the elevator plate 33.

The microprocessor 202 then causes the motor 90 of the elevator-plate drive unit 34 to rotate for a predetermined number of rotations by sending target pulse signal S30 to the motion control circuit 210. Therefore, the microprocessor 202 causes the elevator plate 33 to be lowered to the above-described housing and pull-out height position corresponding to the paper feed tray compartment 26A and the ink ribbon cartridge compartment 26B of the magazine 26 (i.e., the paper feed tray compartment 26A and the ink ribbon cartridge compartment 26B of the magazine 26 into which the paper feed tray 27 and the ink ribbon cartridge 28 were loaded).

Further, the microprocessor 202 sends control signal S10 to the loading board 190, and then the loading board 190 causes the motor 124 of the loading unit 35 to drive. Therefore, the microprocessor 202 causes the movable plate 122 of the loading unit 35 to be moved to the back-end loading position.

Thereafter, the microprocessor 202, by sending the target pulse signal S30 to the motion control circuit 210, causes the elevator plate 33 to be lowered to the escape position of the above-described housing and pull-out height position corresponding to the paper feed tray compartment 26A and the ink ribbon cartridge compartment 26B of the magazine 26. Therefore, the microprocessor 202 causes the paper feed tray engagement pawl 129A and the ink ribbon cartridge engagement pawl 129C of the engagement member 129 (FIGS. 12 and 13) of the loading unit 35 to be separated from the paper feed tray 27 and the ink ribbon cartridge 28.

Therefore, the microprocessor 202 can cause the paper feed tray 27 and the ink ribbon cartridge 28 pulled out on the elevator plate 33 to be housed in a corresponding paper feed tray compartment 26A and a corresponding ink ribbon cartridge compartment 26B of the magazine 26, so that the paper feed tray 27 and the ink ribbon cartridge 28 which had been loaded into the video printer device 24 can be returned back to the magazine 26.

Further, in an operation mode (hereinafter referred to as "a paper discharge operation mode") in which the printing paper discharge unit 41 (FIG. 19) is caused to execute the paper discharge operation, the microprocessor 202 sends control signal S10 to the loading board 190, and the loading board 190 causes the motor 140 of the printing paper discharge unit drive means 40 (FIG. 18) to rotate. Therefore, the microprocessor 202 causes the engagement plate 153 of the printing paper discharge unit drive means 40 to move to the paper discharge front-end position, so the printing paper discharged on the inclinable tray 172 of the paper discharge tray unit 160 of the printing paper discharge unit 41 (FIG. 19) can be discharged outside the autochanger 20 through the paper discharge opening 33A of the elevator plate 33 and the chute 42.

The microprocessor 202 then sends control signal S10 to the loading board 190, and then the loading board 190 causes the motor 140 of the printing paper discharge unit drive means 40 to rotate. Therefore, the microprocessor 202 causes the engagement member 153 of the printing paper discharge unit 41 to be moved to the paper discharge operation back-end position, so that the paper discharge tray unit 161 of the printing paper discharge unit 41 is pushed back to its beginning position.

Further, the microprocessor 202 sends control signal S10 to the loading board 190, and then the loading board 190 causes the motor 140 of the printing paper discharge unit drive means 40 to rotate. Therefore, the microprocessor 202 causes the engagement member 153 of the printing paper discharge unit drive means 40 to be returned to the paper discharge operation starting-point position. Therefore, when the elevator plate 33 moves thereafter, the microprocessor 202 causes the engagement member 153 of the printing paper discharge unit drive means 40 to move freely up and down without contacting the lever component 154 of the printing paper discharge unit 41.

(2-2) Microprocessor Operation Procedure

The autochanger 20 has a normal mode in which the video printer device 24 is caused to execute various operations such as printing by operating the switch of the user operation panel 187 (FIG. 20), and an idling mode in which the video printer device 24 is caused to execute printing in sequence without having recourse to the switch operation of the user operation panel 187, for example, as in the case of a demonstration.

Figure 22:
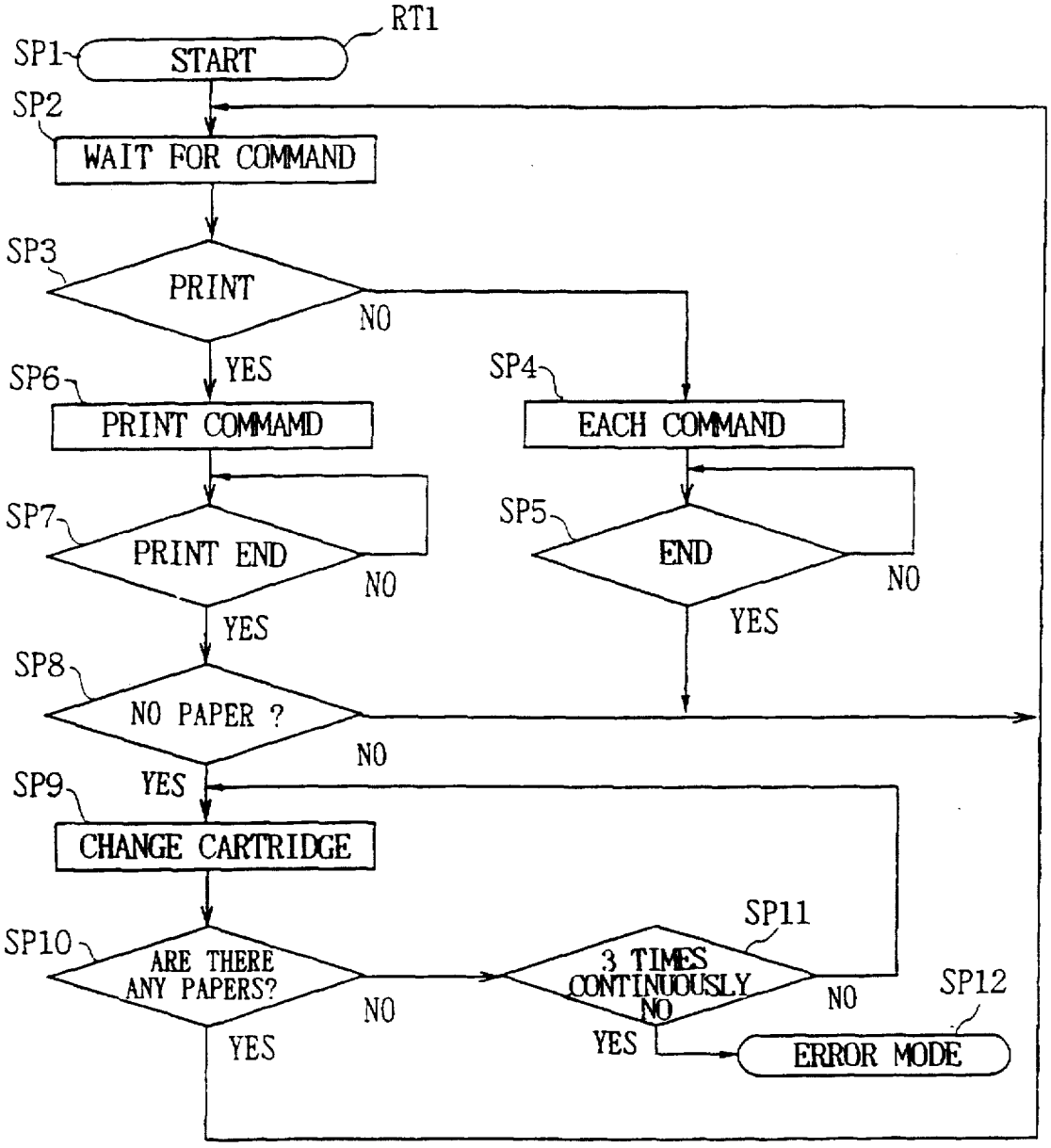
FIG. 22 is a flowchart showing the stand-by mode procedure.

When the normal mode is selected by the switch operation of the service operation panel 186 (FIG. 20), the microprocessor 202 will execute stand-by mode processing routine RT1 shown in FIG. 22 after the paper feed tray 27 and the ink ribbon cartridge 28 have been loaded into the video printer device 24.

In step SP1, stand-by mode processing routine RT1 is started and, in step SP2, the microprocessor 202 waits for operation command C2 to be input from switches operation on the user operation panel 187.

When operation command signal C2 is input at step SP2, the microprocessor 202 proceeds to step SP3 to determine if input operation command signal C2 is an operation command for causing the video printer device 24 to execute printing.

If a negative result is obtained at step SP3 (i.e., except for the case where the input operation command signal C2 is an operation command executing printing), the microprocessor 202 proceeds to step SP4. In step SP4, the microprocessor 202 sends a control signal based on the input operation command signal C2, to the video printer device 24, thereafter, proceeds to step SP5, to determine if the operation has been completed. Only if an affirmative result is obtained, the processing returns to step S2 to wait for the next operation command signal C2.

On the contrary, if an affirmative result is obtained in step SP3 (i.e., in case where the input operation command signal C2 is an operation command signal executing printing), the microprocessor 202 proceeds to step SP6 to send an operation command for causing printing to be executed to the control circuit 183 (FIG. 21) of the video printer device 24 through the RS232C communication circuit 205 (FIG. 21), so printing is started.

Thereafter, the microprocessor 202 proceeds to step SP7 to wait for the completion of printing operation of the video printer device 24, based on the information obtained by communicating with the control circuit 183 of the video printer device 24. When the microprocessor 202 determines that the printing operation has been completed, it proceeds to step SP8, in which it is determined if a sheet of printing paper remains in the paper feed tray 27 loaded in the video printer device 24, based on information obtained by communication with the control circuit 183 of the video printer device 24.

If a negative result is obtained at step SP8, the microprocessor 202 determines that a sheet of printing paper is in the paper feed tray 27 loaded in the video printer device 24 and return to step SP2. In step SP2, the microprocessor 202 waits for the next operation command signal C2 again.

If an affirmative result if obtained in step SP8, the microprocessor 202 determines that there is no sheet of printing paper in the paper feed tray 27 loaded in the video printer device 24 and proceeds to step SP9. In step SP9, the microprocessor 202 sends target pulse signal S30 to the motion control circuit 210 (FIG. 21) and control signal S10 to the loading board 190. Therefore, the microprocessor 202 causes the movable pickup 32 to execute the above-described housing operation and loading operation in sequence, so that the paper feed tray 27 and the ink ribbon cartridge 28 loaded in the video printer device 24 are changed to another paper feed tray 27 and ink ribbon cartridge 28 housed in the magazine 26.

In step SP10, the microprocessor 202 determines if there is a sheet of printing paper in the paper feed tray 27 newly loaded in the video printer device 24, based on information obtained by communication with the control circuit 183 of the video printer device 24. If an affirmative result is obtained, the processing returns to step SP2, in which the microprocessor 202 waits for new operation command signal C2.

On the contrary, if a negative result is obtained in step SP10, the microprocessor 202 proceeds to step SP11 and determine if the changing operation of the paper feed tray 27 and the ink ribbon cartridge 28 has occurred three times in step SP9.

If a negative result is obtained in step SP11 (i.e., in case where the paper feed tray change has occurred within three times), the microprocessor 202 returns to step SP9, in which the paper feed tray 27 and the ink ribbon cartridge 28 are changed.

On the contrary, if an affirmative result is obtained in step SP11 (i.e., a case where, in spite of the third-time change of the paper feed tray, printing paper has not been housed in the paper feed tray 27 loaded in the video printer device 24), the microprocessor 202 proceeds to step SP12. In step SP12, the microprocessor 202 sends error signal S40 to the display unit, and after the occurrence of an error has been displayed, stand-by mode processing routine RT1 is ended.

Figure 23:
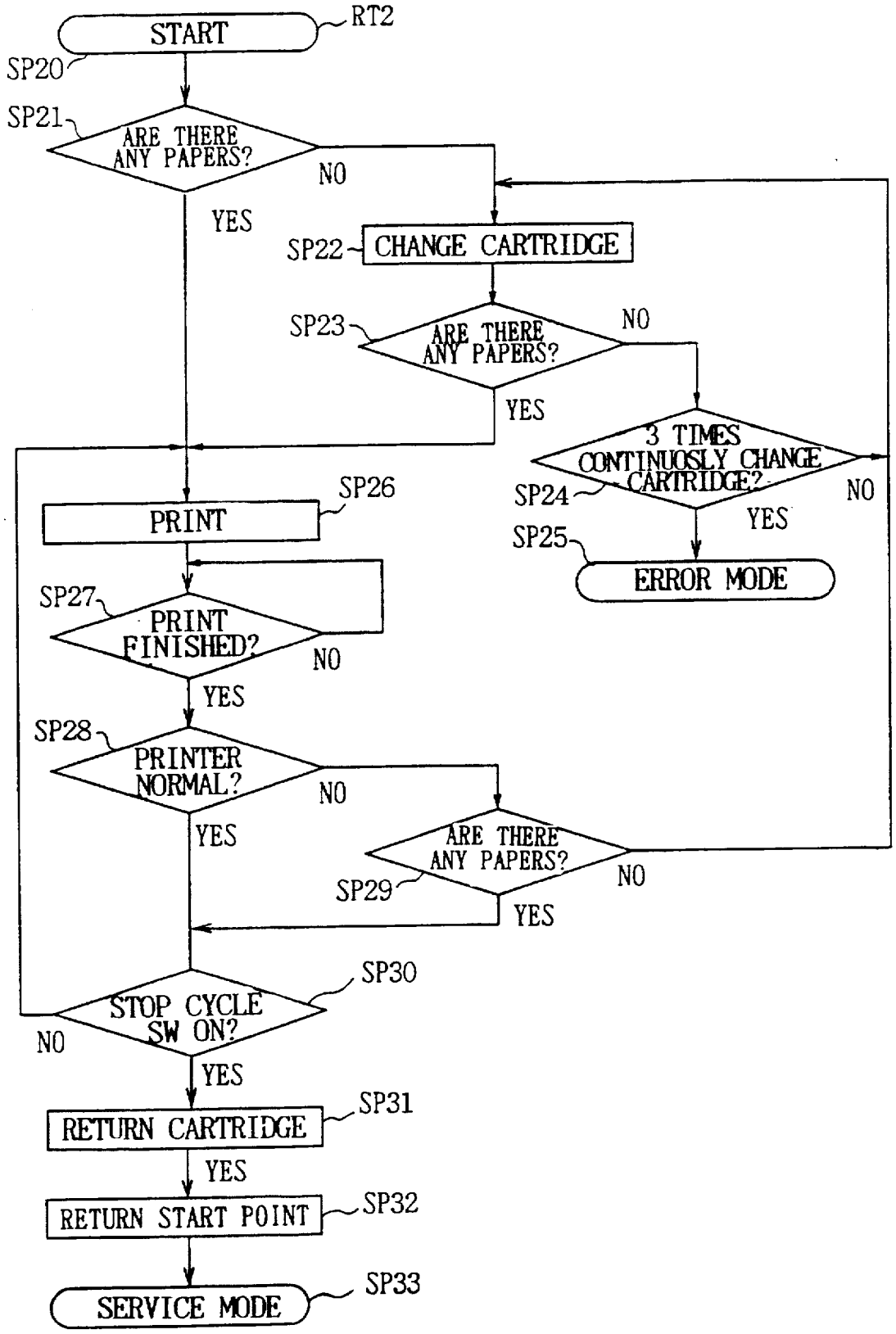
FIG. 23 is a flowchart showing the idling mode procedure.

While, if the idling mode is selected by the switch operation of the service operation panel 186 (FIG. 20), idling mode processing routine RT2 shown in FIG. 23 will be executed in the microprocessor 202 by switch operation on the service operation panel 186.

In step SP20, idling mode processing routine RT2 is started and, in step SP21, the microprocessor 202 determines if printing paper has been supplied to the video printer device 24, based on information obtained by communication with the control circuit 183 (FIG. 21) of the video printer device 24.

If a negative result is obtained in step SP21, the microprocessor 202 proceeds to step SP22. In step SP22, the microprocessor 202 sends target pulse signal S30 to the motion control circuit 210 and control signal S10 to the loading board 190. Therefore, the microprocessor 202 causes the movable pickup 32 to execute the above-described housing operation and loading operation in sequence, so that the paper feed tray 27 and the ink ribbon cartridge 28 loaded in the video printer device 24 are changed to another paper feed tray 27 and ink ribbon cartridge 28 housed in the magazine 26.

Then, the microprocessor 202 proceeds to step SP23, and determines if printing paper has been housed in the paper feed tray 27 changed in step SP22, based on information obtained by communication with the control circuit 183 (FIG. 21) of the video printer device 24.

If a negative result is obtained in step SP23, the microprocessor 202 proceeds to step SP24 and determine if the changing operation of the paper feed tray 27 and the ink ribbon cartridge 28 in step SP22 has occurred three times.

If a negative result is obtained in step SP24 (i.e., in case where the paper feed tray change has occurred within three times), the microprocessor 202 returns to step SP22. In step SP22, the paper feed tray 27 and the ink ribbon cartridge 28 are changed again.

On the contrary, if an affirmative result is obtained in step SP24 (i.e., a case where, in spite of the third-time change of the paper feed tray, printing paper has not been housed in the paper feed tray 27 loaded in the video printer device 24), the microprocessor 202 proceeds to step SP25. In step SP25, the microprocessor 202 sends error signal S40 (FIG. 21) to the display unit, and after the occurrence of error has been displayed, idling mode processing routine RT2 is ended.

Further, if an affirmative result is obtained in steps SP21 and SP23, the microprocessor 202 proceeds to step SP26, in which the video printer device 24 is caused to execute a printing operation by communication with the control circuit 183 (FIG. 21) of the video printer device 24. Then, the microprocessor 202 proceeds to step SP27 and determines if this printing operation is completed.

If confirming that the printing operation of the video printer device 24 is completed at step SP27, the microprocessor 202 proceeds to step SP28 and determine if the video printer device 24 is normal or abnormal, based on information with the control circuit 183 of the video printer device 24.

If a negative result is obtained at step SP28, the microprocessor 202 proceeds to step SP29 and determine if the cause of an abnormality is due to a shortage of printing paper by determining whether or not printing paper remains in the paper feed tray 27 housed in the video printer device 24.

On the contrary, if a negative result is obtained at step SP29 (i.e., it is determined that the cause of the abnormality is because of the shortage of printing paper), the microprocessor 202 returns to step SP22, in which the paper feed tray 27 and the ink ribbon cartridge 28 are changed.

If an affirmative result is obtained at step SP29, the microprocessor 202 proceeds to step SP30 and determine if an operation command (hereinafter referred to as an idling mode stop command) such as for stopping this idling mode is input or not during a period of time from the start of idling processing routine RT2 to this time.

If a negative result is obtained at step SP30 (i.e., it is determined that the idling mode stop command has not been input), the microprocessor 202 returns to step SP26. In step SP26, a loop of SP26-SP27-SP28-SP30-SP26 is repeated until an affirmative result is obtained at step SP28 or SP30. Therefore, the video printer device 24 is caused to execute the printing operation repeatedly by the microprocessor 202.

On the contrary, if an affirmative result is obtained at step SP30 (i.e., it is determined that the idling mode stop command was input), the microprocessor 202 returns to step SP31. In step SP31, the microprocessor 202 causes the movable pickup 32 to execute the above-described housing operation by sending drive signal S1 to the motor 90 of the elevator-plate drive unit 34 and control signal S10 to the loading board 190. In step SP32, the microprocessor 202 causes the elevator plate 33 to move to the above-described elevator-plate starting-point position by sending control signal S1 to the motor 90 of the elevator-plate drive unit 34. Thereafter, the microprocessor 202 advances to step SP33 and ends idling mode processing routine RT2.

(3) Operation of First Embodiment

Figure 24:
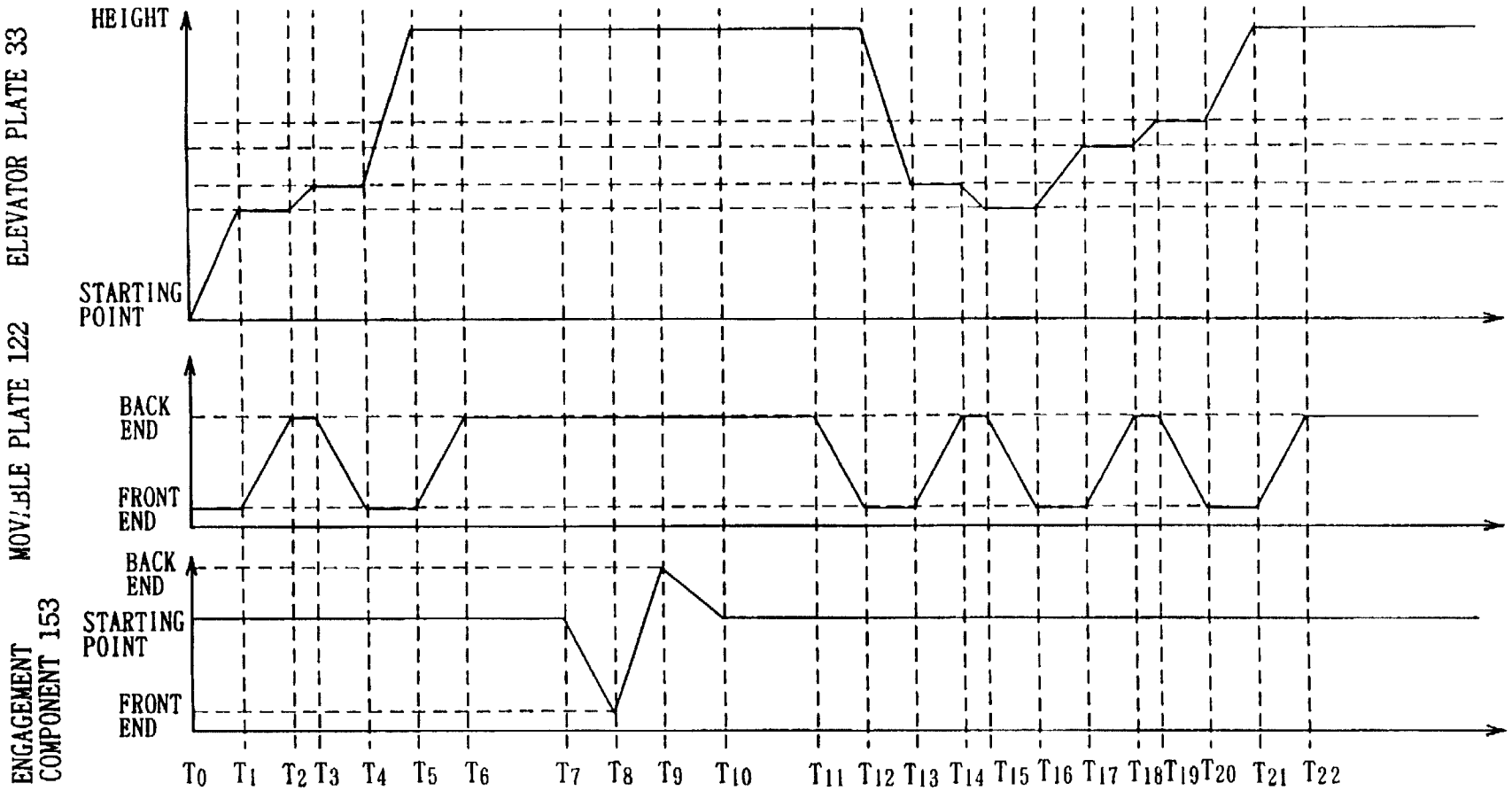
FIG. 24 is a timing chart explaining the operation of an autochanger in a normal mode.

In the construction described above, if the normal mode is selected in the initial state in which the paper feed tray 27 and the ink ribbon cartridge 28 have not been loaded into the video printer device 24, the elevator plate 33 is at the elevator-plate starting-point position, and the movable plate 122 (FIG. 12) of the loading unit 35 is at the front-end loading position, the microprocessor 202 first sends target pulse signal S30 to the motion control circuit 210, as shown in FIG. 24, so that the elevator plate 33 is then caused to be raised to the above-described escape position (time T0 to T1) of the housing and pull-out height position corresponding to a first paper feed tray compartment 26A and a first ink ribbon cartridge compartment 26B of the magazine 26 in which a first paper feed tray 27 and a first ink ribbon cartridge 28 which are to be pulled out have been contained.

Then, the microprocessor 202 sends control signal S10 to the loading board 190 (FIG. 20), and the movable plate 122 (FIG. 12) of the loading unit 35 is then moved to the above-described back-end loading position (time T1 to T2).

The microprocessor 202 further sends target pulse signal S30 to the motion control circuit 210 (FIG. 21), and the elevator plate 33 is then raised to the housing and pull-out height position corresponding to the first paper feed tray compartment 26A and the first ink ribbon cartridge compartment 26B of the magazine 26 in which the first paper feed tray 27 and the first ink ribbon cartridge 28 which are to be pulled out have been contained. Therefore, the microprocessor 202 causes the paper feed tray engagement pawl 129A and the ink ribbon cartridge engagement pawl 129C of the engagement member 129 (FIG. 13) of the loading unit 35 to engage with the lower end 27A of the first paper feed tray 27 and the lower end 28A of the first ink ribbon cartridge 28 to be pulled out (time T2 to T3).

The microprocessor 202 sends control signal S10 to the loading board 190 (FIG. 20) and the movable plate 122 (FIG. 12) of the loading unit 35 is then moved to the front-end loading position, so that the first paper feed tray 27 and the first ink ribbon cartridge 28 to be pulled out can be pulled out of the magazine 26 to a predetermined position on the elevator plate 33 (time T3 to T4).

The microprocessor 202 further sends target pulse signal S30 to the motion control circuit 210, and the elevator plate 33 is then raised to the above-described loading height position (time T4 to T5).

The microprocessor 202 further sends control signal S10 to the loading board 190 (FIG. 20) and the movable plate 122 (FIG. 12) of the loading unit 35 is then moved to the back-end loading position (time T5 to T6), so that the first paper feed tray 27 and the first ink ribbon cartridge 28 pulled out on the elevator plate 33 can be pushed from the paper feed tray insertion opening 24A and the ink ribbon cartridge insertion opening 24B of the video printer device 24 into the video printer device 24. In this manner, the first paper feed tray 27 and the ink ribbon cartridge 28 can be loaded into the video printer device 24.

Thereafter, the microprocessor 202 moves to the above-described idling mode with respect to FIG. 23 (time T6 to T7), while maintaining this state.

At this time, the microprocessor 202 causes the engagement member 153 of the printing paper discharge unit drive means 40 to move from the paper discharge operation starting-point position to the above-described paper discharge operation front-end position (time T7 to T8) by sending control signal S10 to the loading board 190 (FIG. 20) as the occasion demands. Thereafter, by sending control signal S10 to the loading board 190 again, the engagement member 153 of the printing paper discharge unit drive means 40 (FIG. 18) is moved to the paper discharge operation back-end position (time T8 to T9). By sending control signal S10 to the loading board 190 again, the engagement member 153 of the printing paper discharge unit drive means 40 is moved to the paper discharge operation starting-point position (time T9 to T10). In this manner, the printing paper discharged on the inclinable tray 172 of the printing paper discharge unit 41 (FIG. 18) is discharged outside the autochanger 20.

Further, the microprocessor 202 moves to the idling mode again (time T10 to T11) after completion of this paper discharge operation, and if, based on information obtained by communication with the control circuit 183 (FIG. 20) of the video printer device 24, the microprocessor 202 determines that there is no printing paper in the first paper feed tray 27 loaded in the video printer device 24, it sends control signal S10 to the loading board 190 (FIG. 20), so that the movable plate 122 (FIG. 12) of the loading unit 34 is moved to the front-end loading position. Therefore, the microprocessor 202 causes the first paper feed tray 27 and the first ink ribbon cartridge 28 loaded in the video printer device 24 to be pulled out onto the elevator plate 33 (time T11 to T12).

The microprocessor 202 then sends target pulse signal S30 to the motion control circuit 210 (FIG. 21), so that the elevator plate 33 is then lowered to the housing and pull-out height position corresponding to the first paper feed tray compartment 26A and the first ink ribbon cartridge compartment 26B of the magazine 26 in which the first paper feed tray 27 and the first ink ribbon cartridge 28 have been housed in advance (time T12 to T13). Thereafter, the first paper feed tray 27 and the first ink ribbon cartridge 28 are moved into the magazine 26 by moving the movable plate 122 (FIG. 12) of the loading unit 35 to the back-end loading position by sending control signal S10 to the loading board 190 (FIG. 20)(time T13 to T14).

Further, the microprocessor 202, by sending target pulse signal S30 to the motion control circuit 210 (FIG. 21), causes the elevator plate 33 to be lowered to the escape position of the above-described housing and pull-out height position. Therefore, the microprocessor 202 causes the paper feed tray engagement pawl 129A and the ink ribbon cartridge engagement pawl 129C of the engagement member 129 (FIG. 13) of the loading unit 35 to be disengaged from the first paper feed tray 27 and the first ink ribbon cartridge 28 (time T14 to T15).

Thereafter, after the movable plate 122 (FIG. 12) of the loading unit 35 has been moved to the front-end loading position by sending control signal S10 to the loading board 190 (FIG. 20)(time T15 to T16), the microprocessor 202, by sending target pulse signal S30 to the motion control circuit 210 (FIG. 21), causes the elevator plate 33 to be lowered to the escape position of the housing and pull-out height position corresponding to a new second paper feed tray compartment 26A and a new second ink ribbon cartridge compartment 26B of the magazine 26 in which a new second paper feed tray 27 and a new second ink ribbon cartridge 28 have been housed (time T16 to T17).

The microprocessor 202 then causes the movable plate 122 (FIG. 12) of the loading unit 35 to move to the back-end loading position by sending the control signal S10 to the loading board 190 (FIG. 20)(time T17 to T18).

Further, the microprocessor 202, by raising the elevator plate 33 to the housing and pull-out height position corresponding to the second paper feed tray compartment 26A and the second ink ribbon cartridge compartment 26B of the magazine 26 by sending target pulse signal S30 to the motion control circuit 210 (FIG. 21), causes the paper feed tray engagement pawl 129A and the ink ribbon cartridge engagement pawl 129C of the engagement member 129 (FIG. 13) of the loading unit 35 to engage with the lower end 27A of the second paper feed tray 27 and the lower end 28A of the second ink ribbon cartridge 28 (time T18 to T19).

Further, the microprocessor 202 sends control signal S10 to the loading board 190 and the movable plate 122 (FIG. 12) of the loading unit 35 is then moved to the front-end loading position, so that the second paper feed tray 27 and the second ink ribbon cartridge 28 are pulled out onto the elevator plate 33 (time T19 to T20).

After the elevator plate 33 has been raised to the loading height position (time T20 to T21) by sending target pulse signal S30 to the motion control circuit 210 (FIG. 21), the microprocessor 202 sends control signal S10 to the loading board 190, and then the movable plate 122 of the loading unit 35 is moved to the back-end loading position (time T21 to T22). Therefore, the microprocessor 202 loads the second paper feed tray 27 and the second ink ribbon cartridge 28 from the paper feed tray insertion opening 24A and the ink ribbon cartridge insertion opening 24B of the video printer device 24 into that video printer device 24, and then ends the change of the paper feed tray 27 and the ink ribbon cartridge 28.

In this way, the microprocessor 202 repeats the same operations (time T6 to T22) and causes the video printer device 24 to execute printing in sequence, based on the operation of the user operation panel 187.

(4) Effects of First Embodiment

According to the above-described construction, the movable pickup 32 (FIG. 2) capable of conveying the paper feed tray 27 and the ink ribbon cartridge 28 in the upward and downward directions and the forward and backward directions of the autochanger 20 is provided, the paper feed tray 27 and the ink ribbon cartridge 28 housed in the magazine 26 or loaded in the video printer device 24 are pulled out onto the elevator plate 33 by means of the movable pickup 32, the paper feed tray 27 and the ink ribbon cartridge 28 pulled out are conveyed to the predetermined height positions corresponding to the paper feed tray insertion opening 24A and the ink ribbon cartridge insertion opening 24B of the video printer device 24 and then the paper feed tray 27 and the ink ribbon cartridge 28 pulled out on the elevator plate 33 are loaded into the video printer device 24 or housed in the magazine 26. Accordingly, the paper feed tray 27 and the ink ribbon cartridge 28 can be changed without having recourse to intervention by an operator, so there can be realized an autochanger by means of which the video printer device 24 can be operated continuously without having recourse to intervention by an operator for a long period of time.

Further, the paper feed tray 27 and the ink ribbon cartridge 28 can be maintained with the same position relationship as that in the state that the magazine 26 is loaded in the video printer device 24, so that the complicated position matching is not necessary during conveyance between the video printer device 24 and the magazine 26. Therefore, the autochanger 20 can be constituted easily.

Further, the magazine 26 is so constructed that a plurality of magazine units 60 (FIGS. 4 and 5) are successively stacked, so that the magazine 26 having the desired number of stages can be constructed. Therefore, the autochanger which can contain a large number of paper feed trays 27 and the ink ribbon cartridges 28 can be realized.

Further, the printed printing paper, which is discharged into the paper discharge compartment 24C based on the driving power given from the printing paper discharge unit drive means 40 (FIG. 18) of the movable pickup 32 (FIG. 2), is discharged to the outside of the autochanger 20 through the paper discharge opening 33A of the elevator plate 33 and the chute 42, so that the autochanger which can continuously drive the video printer device 24 without having recourse to intervention by an operator for a long period of time.

Further, the engagement member 129 (FIG. 13) of the loading unit 35 is made from the elasticity material and the paper feed tray 27 and the ink ribbon cartridge 28 loaded in the video printer device 24 are supported while urging by the engagement member 129, so that the paper feed tray 27 and the ink ribbon cartridge 28 can be positioned in the video printer device 24 at the autochanger 20 side.

Furthermore, the screws 119BX, 119BY are put tightly into each through hole 30B, 31B of the guide frame components 30, 31 through the adjuster screws 119AX, 119AY, so that the elevator plate 33 can be fixed to the guide frame components 30, 31. Therefore, the trouble in the conveyance can be prevented previously.

(5) Other Embodiments (5-1) The embodiment discussed above have dealt with the case where the video printer device 24 is disposed upward of the magazine 26. However, the present invention is not limited to this, but the video printer device 24 can also be disposed in various positions such as the down, left, and right positions of the magazine 26.

In this case, for example, if the video printer device 24 is disposed on the left side or right side of the magazine 26, the autochanger is constructed so that the movable pickup 32 can be moved in the forward and backward directions, left and right directions, and upward and downward directions of the autochanger.

(5-2) Also, the embodiment discussed above have dealt with the case where a single video printer device 24 has been employed. However, the present invention is not limited to this, but two or more video printer devices 24 can also be employed. In such a case, if the first video printer device 24 fails, the second or other video printer device can be used as a back-up device. Therefore, the device can be operated more reliably without having recourse to intervention by a person for a long period of time, so overall reliability of the device can be enhanced.

(5-3) Further, the embodiment discussed above have dealt with the case where the paper feed tray 27 and the ink ribbon cartridge 28 are conveyed together by means of the movable pickup 32. However, the present invention is not limited to this, but the movable pickup 32 can be constructed such that the paper feed tray 27 and the ink ribbon cartridge 28 can be conveyed separately, and the paper feed tray 27 and/or the ink ribbon cartridge 28 can be changed by means of that movable pickup 32.

In such a case, there can be realized an autochanger by means of which printing is performed on a sheet of desired printing paper selected by a user, by preparing various kinds of sheets of printing paper different in paper quality and size.

(5-4) Further, the embodiment discussed above have dealt with the case where the magazine 26 is elastically pushed against the magazine fixing table 25 by means of the elastic force resulting from the combination of the generally U-shaped frame component 65 (FIG. 6) and the generally U-shaped plate spring 67 (FIG. 6). However, the present invention is not limited to this, but various elastic means such as a coil spring can also be employed as means for applying an elastic force to the magazine 26, as long as the magazine 26 can be pushed elastically against the magazine fixing table 25.

Figure 25:
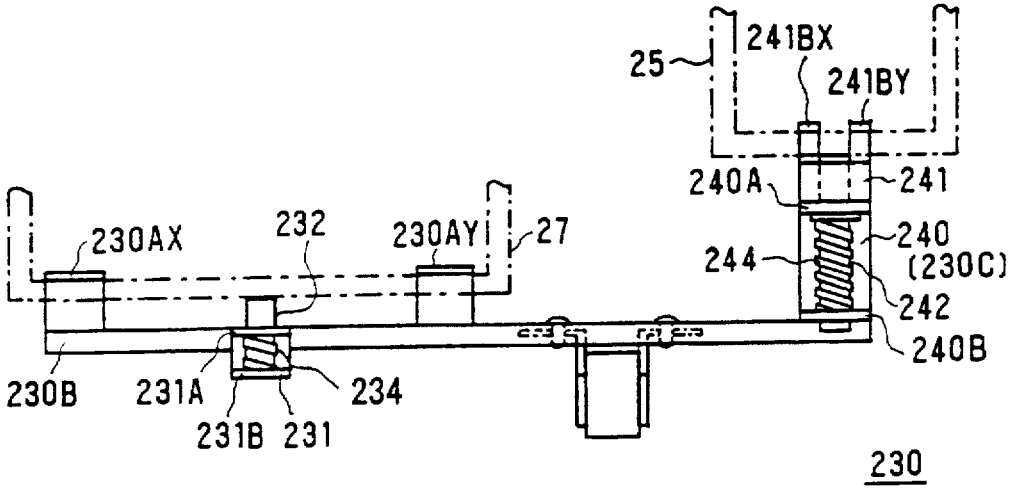
FIG. 25 is a top view showing another embodiment of the engagement member of a loading unit.

(5-5) Further, the embodiment discussed above have dealt with the case where the engagement member 129 of the loading unit 35 shown in FIG. 13 has been employed in the above-described embodiment. However, the present invention is not limited to this, but an engagement member 230 such as that shown in FIGS. 25, and 26 can also be employed.

More particularly, the engagement member 230 has L-shaped paper feed tray engagement pawls 230AX and 230AY at its longitudinal end opposing the paper feed tray 27. The engagement member 230 engages with the paper feed tray 27 by hanging paper feed tray engagement pawls 230AX and 230AY on the lower end of the front wall 27A of the paper feed tray 27.

In this case, a generally U-shaped, pin holding component 231 is installed in a fixed manner on the front of the engagement member 230 between paper feed tray engagement pawls 230AX and 230AY, and also a cylindrical pin 232 is inserted through the through holes (not shown) coaxial formed in the back wall 231A of the pin holding component 231 and in the main engagement member 230B.

A E ring 233 is installed on the pin 232 and a coil spring 234 is interposed between the E ring 233 and the front wall 231B of the pin holding component 231. Because of the elastic force of the coil spring 234, the pin 232 has an elastic force in the backward direction of the autochanger 20.

Figure 26:
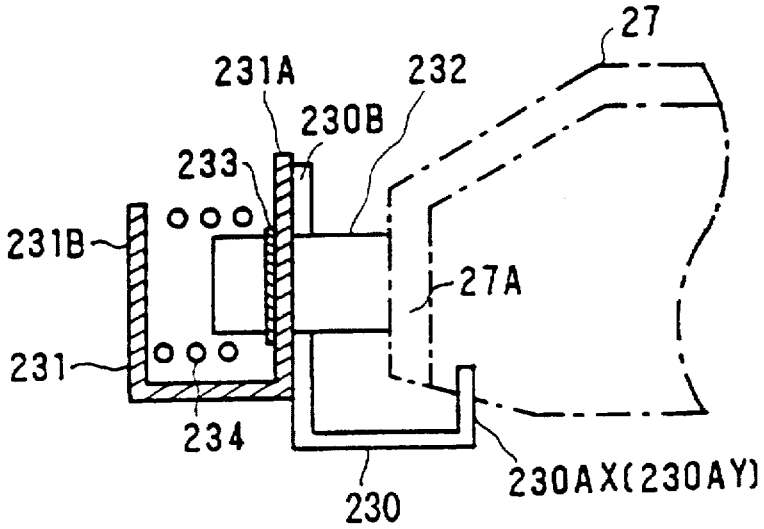
FIG. 26 is a cross-sectional view showing another embodiment of the engagement member of the loading unit.

As will be seen from FIG. 26, since, in the engagement member 230, a force can be applied from the pin 232 to the paper feed tray 27 in the state in which the paper feed tray engagement pawls 230AX and 230AY have been hung on the lower end of the front wall 27A of the paper feed tray 27, the engagement member 230 can reliably engage with the paper feed tray 27 and, with this state, the paper feed tray 27 can be positioned reliably within the paper feed tray insertion opening 24A of the video printer device 24.

Figure 27:
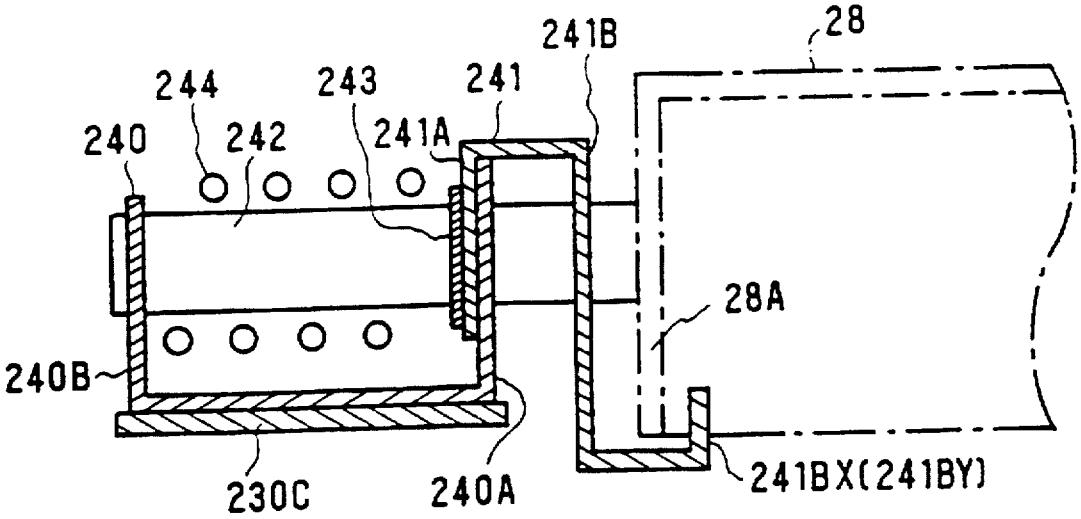
FIG. 27 is a cross-sectional view showing another embodiment of the engagement member of the loading unit.

In addition to the above construction, as shown in FIG. 27, the engagement member 230 is further formed with a bent section 230C, and a generally U-shaped pin holding component 240 is installed in a fixed manner on the upper surface of the bent section 230C. The bent section 230C is formed by bending the longitudinal other end of the engagement member 230 opposing the ink ribbon cartridge 28 in parallel with the ink ribbon cartridge 28 housed in the magazine 26 and in the shape of the letter L.

A generally U-shaped pawl component 241 is installed on the front surface of the back wall 240A of the pin holding component 240, and the pawl component 241 is formed at the lower portion thereof with generally L-shaped ink ribbon cartridge engagement pawls 241BX and 242BY.

Further, a cylindrical pin 242 is inserted through the through holes (not shown) coaxial formed in the front and back walls 240B and 240A of the pin holding component 240 and in the front and back walls 241A and 241B of the pawl component 241, and the E-ring 243 is installed on the pin 242.

Further, a coil spring 244 is interposed between the E-ring 243 and the front wall 240B of the pin holding component 240. Because of the elastic force of the coil spring 244, the pin 242 has an elastic force in the backward direction of the autochanger 20.

As will be seen from FIG. 27, since, in the engagement member 230, a force can be applied from the pin 242 to the ink ribbon cartridge 28 in the state in which ink ribbon cartridge engagement pawls 241BX and 241BY have been hung on the lower end of the front wall 28A of the ink ribbon cartridge 28, the engagement member 230 can reliably engage with the ink ribbon cartridge 28 and, with this state, the ink ribbon cartridge 28 can be positioned reliably within the ink ribbon cartridge insertion opening 24B of the video printer device 24.

(5-5) The embodiment discussed above have dealt with the case where the magazine unit 60 is composed of a generally U-shaped, paper feed tray compartment forming portion 60A and a generally N-shaped, ink ribbon cartridge compartment forming portion 60B. However, the present invention is not limited to this, but if a plurality of magazine units 60 is stacked to form the magazine 26, other types of the construction can be applied to the construction of the magazine unit.

(5-6) The embodiment discussed above have dealt with the case where the mechanical flag 71 is constituted as shown in FIG. 7. However, the present invention is not only limited to this, but if the state changes from the initial state set when the paper feed tray 27 contained in the paper feed tray compartment 26A of the magazine 26 is conveyed, other types of the construction can be applied to the construction of the mechanical flag.

(5-7) The embodiment discussed above have dealt with the case where the mechanical flag 71 is provided only at the gateway of the paper feed tray compartment 26A side of the magazine 26. However, the present invention is not only limited to this, but the mechanical flag can be provided also at the ink ribbon cartridge compartment 26B side, or can be provided at both of the paper feed tray compartment 26B side and the ink ribbon cartridge compartment 26B side.

(5-8) The embodiment discussed above have dealt with the case where the generally U-shaped supporting component 66 as shown in FIGS. 6 and 7 is fixed to the frame component 65, so that the top of the magazine 26 is fixed at the determined position. However, the present invention is not only limited to this, but other construction and installation position can be applied to the construction of the supporting component 66 and the installation position of the supporting component.

(5-9) The embodiment discussed above have dealt with the case where the printing paper discharge unit is constituted as shown in FIG. 18. However, the present invention is not only limited to this, but if the printed printing paper discharged into the video printer device 24 can be discharged as the occasion demands, other construction can be applied to the construction of the printing paper discharge unit 41.

(6) According to this invention, the autochanger for changing the paper feed tray and the ink ribbon cartridge which are loaded in the video printer device as the occasion demands, comprises: a magazine having a plurality of tray compartments corresponding to the shape of the paper feed tray and/or a plurality of cartridge compartments corresponding to the ink ribbon cartridge; and conveyance means for conveying the paper feed tray and/or the ink ribbon cartridge between the video printer device and the magazine, so that the paper feed tray and/or the ink ribbon cartridge of the video printer device can be changed as the occasion demands. Therefore, the autochanger which can continuously drive the video printer device without having recourse to intervention by an operator for a long period of time can be realized.

Further, according to this invention, in the autochanger for changing the paper feed tray and the ink ribbon cartridge which are loaded in the video printer device as the occasion demands, the paper feed tray and the ink ribbon cartridge can be contained in the magazine with the same position relationship as when the paper feed tray and the ink ribbon cartridge are loaded in the video printer device, so that the complicated processing of position determination during conveyance between the video printer device and the magazine is not necessary. Therefore, the autochanger which can continuously drive without having recourse to intervention by an operator for a long period of times can be realized with simple construction.

Further, according to this invention, the autochanger for changing the paper feed tray and the ink ribbon cartridge loaded in the video printer device as the occasion demands, comprises: a magazine having a plurality of tray compartments for containing paper feed tray and a plurality of cartridge compartments for containing the ink ribbon cartridge; and conveyance means for conveying the paper feed tray and the ink ribbon cartridge between the magazine and the video printer device. At the same time, a plurality of projections of a first magazine unit are engaged with a plurality of engagement holes of a second magazine unit, out of a plurality of magazine units of which a plurality of projections are formed at the top surface and a plurality of engagement holes are included at the bottom surface, to form the magazine units of which a plural stages are stacked. Therefore, the paper feed tray and/or the ink ribbon cartridge of the video printer device can be changed as the occasion demands, and simultaneously, the magazine having the desired number of stages can be formed, so that the autochanger, which can continuously drive the video printer device without having recourse by an operator for a long period of times, and in which the magazine can maintain the paper feed tray and the ink ribbon cartridge, can be realized.

Further, according to this invention, the autochanger for changing the paper feed tray and the ink ribbon cartridge which are loaded in the video printer device as the occasion demands, comprises: a magazine having a plurality of tray compartments for containing paper feed tray and a plurality of cartridge compartments for containing the ink ribbon cartridge; conveyance means for conveying the paper feed tray and the ink ribbon cartridge between the magazine and the video printer device; and discharge means, which is allocated in a paper discharge compartment of the video printer device discharging printed sheets of printing paper, for discharging sheets of printing paper into the outside of the video printer device via a chute, by conveying sheets of printing paper discharged into a paper discharge compartment from the paper discharge outlet of the video printer device to slide it into the chute provided in the conveyance means, based on a driving power which is supplied from the conveyance means when the printed sheet of printing paper of the video printer device is discharged to the paper discharge compartment of the video printer device in the state that the conveyance means is positioned at the predetermined position corresponding to the video printer device. Therefore, the paper feed tray and the ink ribbon cartridge loaded in the video printer device can be changed as the occasion demands, and at the same time, the printed printing paper which is discharged into the paper discharge compartment of the video printer device can be discharged to the outside of the device, so that the autochanger which can continuously drive the video printer device without having recourse by an operator for a long period of times can be realized.

Further, according to this invention, the autochanger for changing the paper feed tray and the ink ribbon cartridge which are loaded in the video printer device as the occasion demands, comprises: a magazine having a plurality of tray compartments for containing paper feed tray and a plurality of cartridge compartments for containing the ink ribbon cartridge; and conveyance means for conveying the paper feed tray and the ink ribbon cartridge between the magazine and the video printer device. Therefore, the paper feed tray and the ink ribbon cartridge loaded in the video printer device can be changed as the occasion demands, so that the autochanger which can continuously drive the video printer device without having recourse by an operator for a long period of times can be realized.

Further, the conveyance means comprises: the engagement means for engaging and supporting the paper feed tray and the ink ribbon cartridge during conveyance of the paper feed tray and the ink ribbon cartridge; first urging means, which is provided in the engagement means, for urging the paper feed tray loaded in the video printer device to the video printer device; and second urging means, which is provided in the engagement means, for urging the ink ribbon cartridge loaded in the video printer device to the video printer device. Therefore, the paper feed tray and the ink ribbon cartridge loaded in the video printer device can be positioned.

Further, according to this invention, the autochanger for changing the paper feed tray and/or the ink ribbon cartridge which are loaded in the video printer device as the occasion demands, comprises: the magazine for containing the paper feed tray and the ink ribbon cartridge; and the conveyance means for conveying the paper feed tray and the ink ribbon cartridge between the magazine and the video printer device, so as to control to drive the conveyance means based on the output signal of the video printer device. Therefore, the existing video printer device can be used, and the autochanger, which can continuously drive without having recourse by an operator for a long period of times, can be realized by using the existing video printer device.

Further, according to this invention, the autochanger for changing the paper feed tray and the ink ribbon cartridge which are loaded in the video printer device as the occasion demands, comprises: the magazine having a plurality of tray compartment for containing the paper feed tray and a plurality of cartridge compartment for containing the ink ribbon cartridge; conveyance means for conveying the paper feed tray and the ink ribbon cartridge between the magazine and the video printer device; and guide frame for guiding the conveyance means between the magazine and the video printer device. Therefore, the paper feed tray and the ink ribbon cartridge loaded in the video printer device can be changed as the occasion demands, so that the autochanger, which can continuously drive the video printer device without having recourse by an operator, can be realized.

Furthermore, in the conveyance of the autochanger, fixing screws are put through the through holes, which are formed through the guide frame, through adjuster screws, to fix the conveyance means to the guide frame by the fixing screw means. Therefore, the occurrence of trouble during conveyance can be previously prevented, so that the autochanger, which can continuously and surely drive the video printer device without having recourse by an operator, can be realized.

[2] Second Embodiment (1) Whole Construction of Image Recording Device

Figure 28:
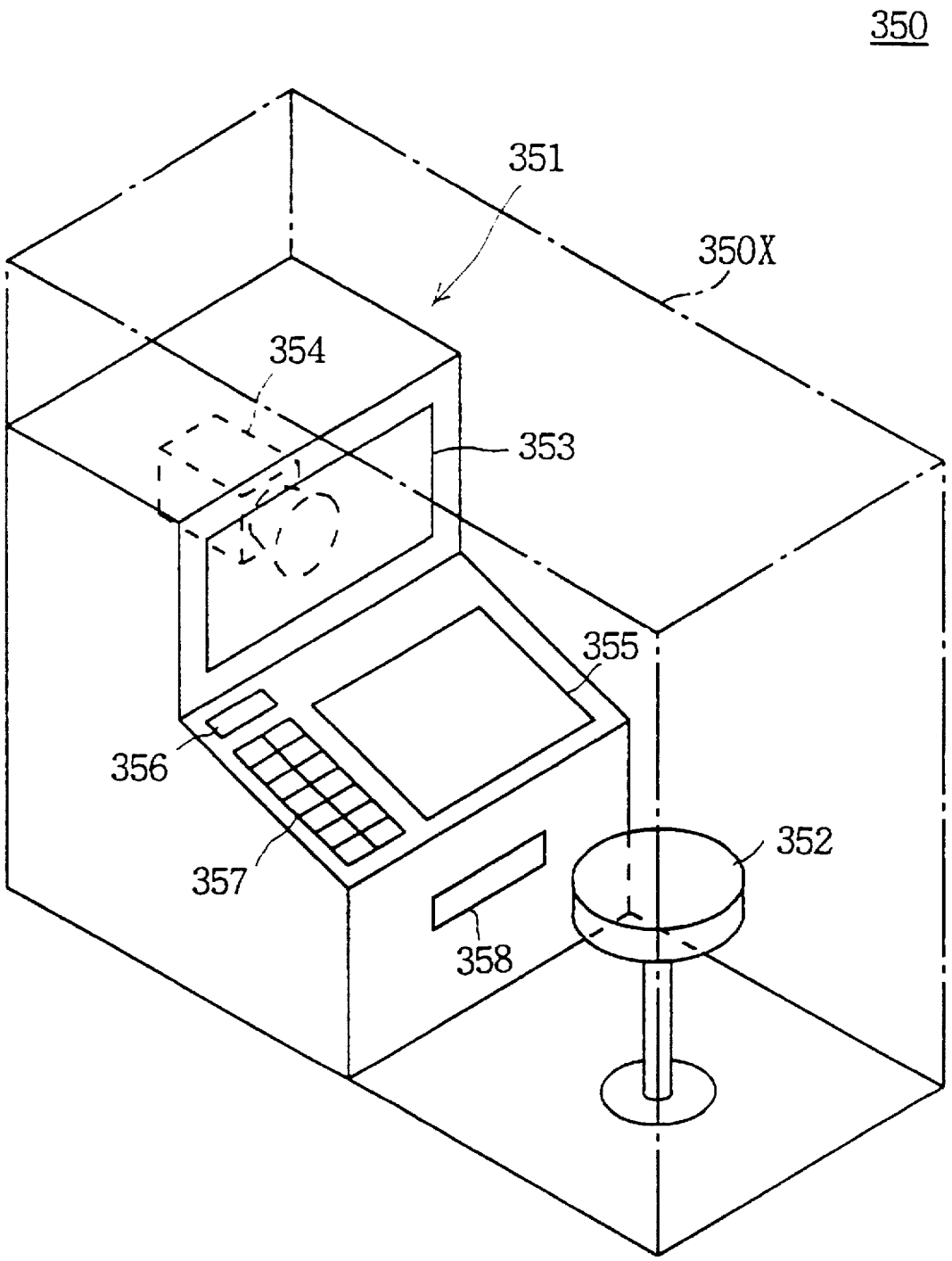
FIG. 28 is a schematic perspective view showing the construction of an image recording device according to the present invention.

FIG. 28 generally shows an image recording device 350, in which a printer device 351 having an autochanger 320 (FIGS. 29 and 30) of which construction is same as the autochanger 20 (FIGS. 2 to 24) described above is provided at one side in the booth 350X, and also, a seat 352 which is adjustable in the height is provided at other side.

In the printer device 351, a half mirror 353 and a video camera 354 which is positioned behind the mirror are provided in a main housing such that they confronts the seat 352. Simultaneously, a monitor 355, a coin counter 356, and an operation panel unit 357 are provided on the front operation table of the main housing, and moreover, a discharge outlet 358 is provided at the lower part of the front plane of the operation table.

Thus, in case that a photograph of the face is photographed, after user comes in the booth and adjusts the height of the seat 352 to the desired height, user can take a seat such as to confront with the printer device 351. In the state that user is taking a seat, the face or the chest of user is reflected by the half mirror 353, which is the object to be photographed by the video camera 354 provided via the half mirror 353. The image photographed by the video camera 354 is displayed on the monitor 355. In this case, the display image is reflected as the positive image (or inverted image).

The operation switches corresponding to a plurality of setting modes (for example, type of the image recording medium to be printed (singular or plural), enlargement or reduction of the image, inversion of the image, inputting of the caption (character), etc.) are allocated in the operation panel unit 357, respectively. User operates the operation switches of the operation panel unit 357 to select the desired setting mode.

Figure 29:
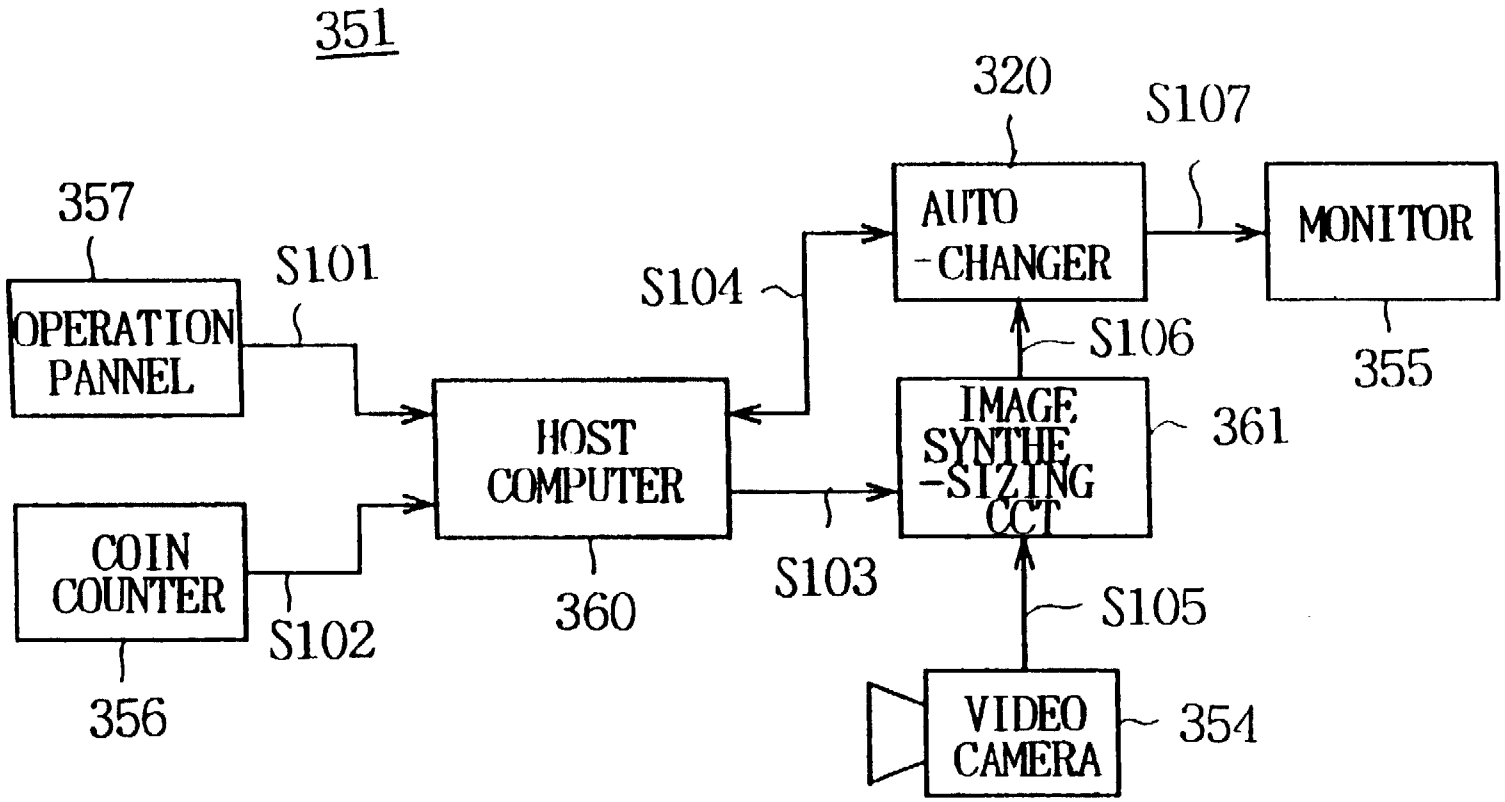
FIG. 29 is a block diagram showing the printing apparatus according to the present invention.

As shown in FIG. 29, when user selects the setting mode by using the operation panel unit 357, the control signal S104 is supplied to the autochanger 320 based on the operation input signal S101, so that a host computer 360 determines whether or not the type of the paper feed tray 27 (FIG. 2) and the ink ribbon cartridge 28 which are loaded in the video printer device 24 (FIG. 2) of the autochanger 320 corresponds to the selected setting mode. If it corresponds, the number of remained sheets of paper of the image recording medium contained in the paper feed tray 27 is determined, and the fee corresponding to the setting mode selected based on the determined result is displayed on the monitor 355 (or operation panel 357). When the user puts the money in the coin counter 356, the autochanger 320 becomes in the standing by state for photographing. Then, when the user operates the operation switch, the video signal S105 output from the video camera 54 is image synthesized in the image synthesizing circuit 361 by the command signal S103. Therefore, the image synthesizing signal S106 is supplied to the autochanger 320 to start photographing.

In this case, when user comes in the booth, the host computer 360 makes the video camera 354 to be the operation state. Then, the host computer 360 stores the photographed result in the image memory (not shown) provided in the video printer device 24 at the timing specified by user based on the user's operation, and displays the monitor image by supplying the monitor image signal S107 to the monitor 355. Therefore, the image information which is suitable to the type of image recording medium selected by user can be input to the autochanger 320.

Thereafter, when the photographing is completed, the host computer 360 displays on the monitor 355 the inquiry whether or not the image being displayed on the monitor 355 has been printed. User can confirm by the display of the monitor 355 that the photographing has been completed, and can confirm by displaying the image stored in the image memory described above in case of the continuous photographing of a plurality of sheets.

Here, when user prints out, the host computer 360 prints out the image stored in the image memory (background or characters (for example, name, date, or message) are synthesized in the image synthesizing circuit 361) to the image recording medium corresponding to the selected setting mode, and the image recording medium is discharged from the discharge outlet 358 (FIG. 28).

(2) Construction of Autochanger

Figure 30:
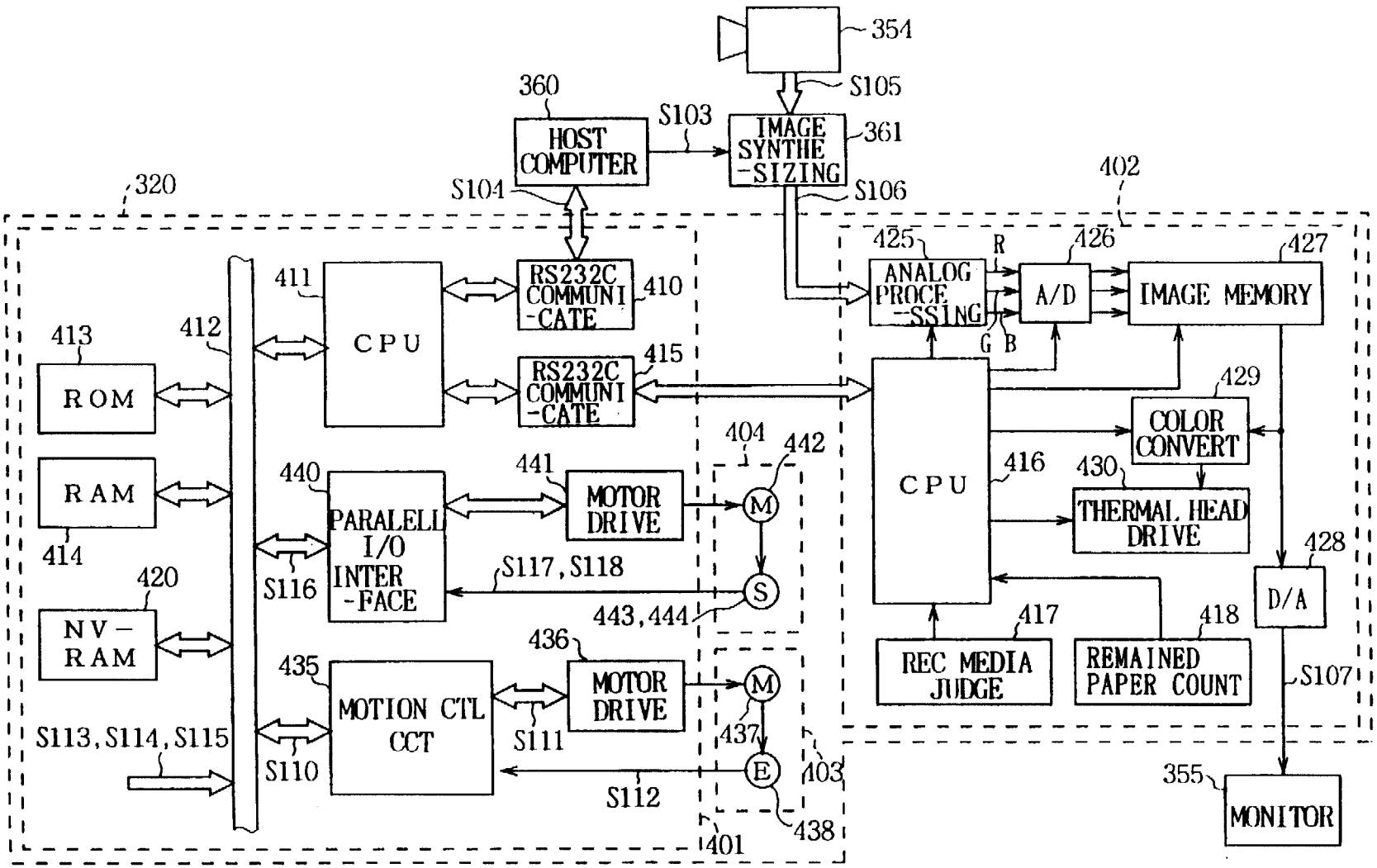
FIG. 30 is a block diagram showing the autochanger according to the present invention.

As shown in FIG. 30, an autochanger 320 has a controller 401, an image processing unit 402, a elevator-plate drive unit 403, and a loading unit 404.

The controller 401 has a central processing unit (CPU) 411 for transferring information between the CPU and the host computer 360 via a RS232C communication circuit 410. The CPU 411 executes a program stored in a ROM 413 via an inner bus 412 by utilizing a RAM 414, so that various information is processed to calculate and supplied to the RS232C communication circuit 415 to convert it into the data format for RS232C communication, thereafter it is output to a CPU 416 of the image processing unit 402 provided in the video printer device 24. Also, the CPU 411 of the controller 401 converts the information, which is composed of the data format for RS232C communication, supplied from the CPU 416 of the image processing unit 402 into the data format in the controller 401 at the RS232C communication circuit 415, and inputs it. Therefore, the CPU 411 of the controller 401 executes the calculation processing of the information relating to the image, while communicating with the CPU 416 of the image processing unit 402.

In this embodiment, a media judging means (not shown) comprising a light emitting element and a sensor for sensing the reflected light of the beam emitted from the light emitting element are provided in the ink ribbon cartridge insertion opening 24B of the video printer device 24 (FIG. 2). A recording media judging circuit 417 is constituted including the media judging means, and a bar code put on the ink ribbon cartridge 28 is read out by the media judging means.

Each ink ribbon cartridge 28 has a spool (not shown) for winding the ink ribbon corresponding to the image recording medium (hereinafter, referred to as "ink ribbon simply"), and the bar code is provided around the spool. After the maintenance personnel set the image recording medium and the ink ribbon corresponding to the image recording medium (hereinafter, these are referred to as one recording media) to each magazine 26 (FIG. 2) respectively, when the setting mode is selected, the paper feed tray 27 and the ink ribbon cartridge 28 are pulled out of each magazine 26, and are conveyed to and loaded in the video printer device 24, the media judging means reads the bar code rotating in accordance with the rotation of the spool provided in the ink ribbon cartridge 28, so that the type of the image recording medium set in the paper feed tray 27 can be judged.

In this way, the type information of the loaded image recording medium which is judged by the media judging means is supplied to the CPU 416 of the image processing unit 402 as the judged output of the recording media judging circuit 417.

Further, a sensor for detecting the amount of used ink ribbon is provided in the ink ribbon cartridge insertion opening 24B of the video printer device 24. A remained paper counting circuit 418 is constituted including a used amount detecting means which can detect the amount of used ink ribbon when the ink ribbon cartridge 28 is set based on the detected output.

The used amount detecting means comprises a pair of optical sensors, and the mark provided for each predetermined interval on the ink ribbon passes the described optical sensor in accordance with the winding operation of the ink ribbon, to output the detected signal. The detected signal is counted at the remained paper counting circuit 418, and the amount of the used ink ribbon is detected. In addition, as described above, the paper feed tray 27 and the ink ribbon cartridge 28 are loaded together to the video printer device 24. In this embodiment, by utilizing this relationship, the amount of the used image recording medium set to the paper feed tray 27 can be detected based on the amount of the used ink ribbon.

Therefore, the media judging means and the used amount detecting means of the video printer device 24 supplies the judged result and the detected result to the CPU 416 of the image processing unit 402, as the address information, that which paper feed tray compartments 26A and ink ribbon cartridge compartments 26B a plurality of recording media are respectively set to, and the used amount information showing the used amount of each recording media (hereinafter, referred to as "recording media setting information"). The CPU 416 transmits the recording media setting information to the CPU 411 of the controller 401 via the RS232C communication circuit 415.

Further, the CPU 411 of the controller 401 can write the recording media setting information into a NV-RAM 420 having a non-volatile memory construction based on the control command signal S104 output from the host computer 360. Therefore, maintenance personnel or user operates the operation switch on the operation panel 357 (FIG. 28), so that the recording media setting information can write in or read from the NV-RAM 420, and the recording media setting information can be maintained even if the power source is turned off.

In this embodiment, after the video signal S106 obtained by image synthesizing processing the video signal S105 at the image synthesizing circuit 361 is divided into three primary colors R, G, and B at an analog processing circuit 425 of the image processing unit 402 under the control of the CPU 416, they are converted into three primary image data at an analog-to-digital converting circuit 426 to store them in the image memory 427 having frame memory construction.

Therefore, the image data stored in the image memory 427 is read out under the control of the CPU 416, and is converted into the video signal S107 at a digital-to-analog converting circuit 428 to supplied it to the monitor 355. Thereby, the image of face photographed by the video camera 354 can be shown to user.

Further, in this way, the image data read from the image memory 427 under the control of the CPU 416 is supplied to a thermal head drive circuit 430 consisting the video printer device 24 via the color converting circuit 429, so that the image having the color corresponding to the color specification information supplied from the CPU 416 can be printed on the image recording medium.

The CPU 411 of the controller 401 searches that which compartments 26A, 26B the desired type of the recording media is set to, based on the recording media setting information read from the NV-RAM 420 in the state that each recording media is set to the magazine 26. Then, the CPU 411 reads the program stored in the ROM 413, and supplies the target pulse signal S110 having the predetermined pulse number (hereinafter, referred to as "target pulse signal" simply) obtained based on the program to a motion control circuit 435.

At this time, the motion control circuit 435 outputs the control signal S111 to the motor drive circuit 436 based on the target pulse signal S110, so that the output axis of the motor 437 of the elevator-plate drive unit 403 is rotated by the predetermined angle in accordance with the pulse number of the target pulse signal S110. As a result, the elevator plate 33 is moved upward and downward of the autochanger 320 along with the guide frame components 30, 31 (FIG. 2).

At this time, the motion control circuit 435 elevates the elevator plate 33 to the target position by feeding back the rotating position information S112 of the motor 437 from the encoder 438 installed in the motor 437 of the elevator plate driving unit 403.

In this embodiment, to the CPU 411 of the controller 401, the output S113 (hereinafter, referred to as "first elevator plate starting-point position) of the position sensor (not shown) for detecting the existence of the reference portion, which is set in the elevator plate 33 at the starting position in the up and down movement set at the lower part of the guide frame components 30, 31, and the output S114 (hereinafter, referred to as "second elevator plate position information") of the position sensor (not shown) for detecting the existence of the reference portion, which is set in the elevator plate 33 at the loaded height position set at the upper part of the guide frame components 30, 31 are supplied via the inner bus 74.

Further, the reference plate (not shown) in which the generally U-shape cutout is sequentially formed corresponding to the position of height of each paper feed tray 26A (FIG. 3) of the magazine 26 is installed in the guide frame components 30, 31, and simultaneously, the light emitting element (not shown) and the light receiving element (not shown) are provided via the reference plate in the elevator plate 33 such as to confront each other. In this case, the light emitting element supplies the output to the counter circuit (not shown), and the counter circuit successively counts the pulse number occurred in the output of the light receiving element every time when the light beam emitted from the light emitting element passes each cutout on the reference plate in accordance with the movement of upward and downward of the elevator plate 33, to supply the counted result to the CPU 411 via the inner bus 412 as the count value information signal S115.

Therefore, the CPU 411 supplies the new target pulse signal S110 to the motion control circuit 435 based on the first and second elevator plate position information S113 and S114 and the count value information signal S115, so that the motor 437 of the elevator plate drive unit 403 is rotatively controlled accurately. As a result, the elevator plate 33 can be moved up and down to the height position of the compartments 26A, 26B of the magazine 26 having the desired type of the recording media for user accurately.

Further, the CPU 411 of the controller 401 receives the control signal S110 output from the motion control circuit 435, and supplies it to the motor drive circuit 441 via the bus 412 and the parallel input/output interface 440 as the control signal S116. As a result, the motor 442 of the loading unit 404 is driven, so that the moving plate 122 (FIG. 12) is successively moved from the predetermined position set at the front end of the elevator plate 33 (hereinafter, this position is referred to as "loading front end position") to the predetermined position set at the back end of the elevation plate 33 (hereinafter this position is referred to as "loading back end position"), or from the loading back end position to the loading front end position.

At this time, to the CPU 411, the output S117 (hereinafter, referred to as "first moving plate position information") of the position sensor 443 for detecting the existence of the reference portion set on the moving plate 112 at the loading back end position, and the output S118 (hereinafter, referred to as "second moving plate position information") of the position sensor 444 for detecting the existence of the reference portion set on the moving plate at the loading front end position are supplied via the parallel input/output interface 440.

Therefore, the CPU 411 controls to drive the motor 442 of the loading unit 404 based on the control signal S110 output from the motion control circuit 435 and the first and second moving plate position information S117 and S118. Thus, the paper feed tray 27 and the ink ribbon cartridge 28 are pulled out on the elevator plate 33 to the loading unit 404 surely. Moreover, the paper feed tray 27 and the ink ribbon cartridge 28 pulled out on the elevator plate 33 are surely contained in the paper feed tray compartment 26A and the ink ribbon cartridge compartment 26B of the predetermined magazine unit 26A, or are loaded in the video printer device 24.

Also, it is not shown, but the CPU 411 outputs the recording media setting information read out from the NV-RAM 420 to the monitor 355 (FIG. 29), so that the recording media setting information can be displayed on the monitor 355. Therefore, the maintenance personnel can check the display of the monitor 355 visually, so that the recording media can be changed with new recording media if few remained sheets of recording media is set in the magazine 26.

(3) Printing Procedure

Figure 32:
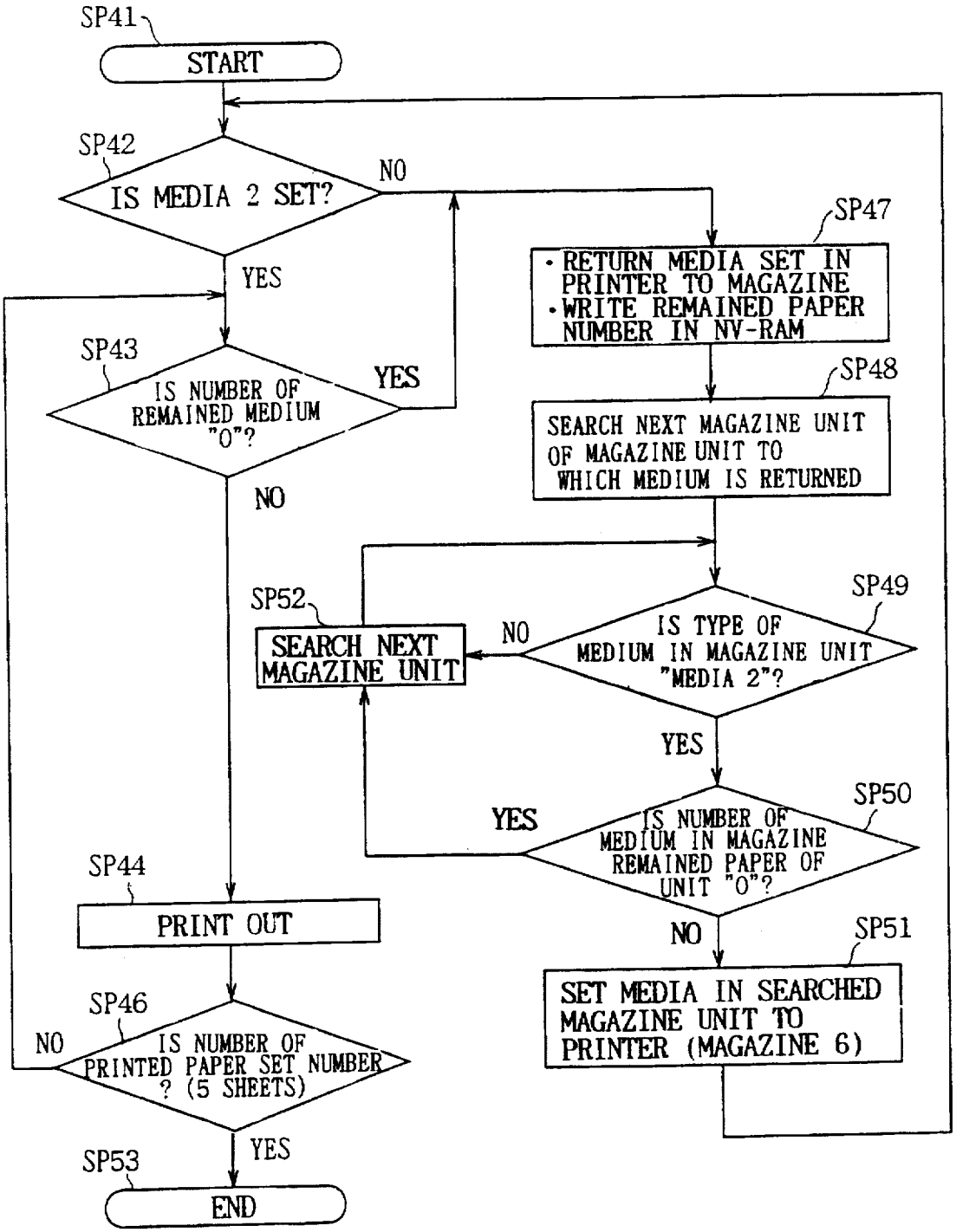
FIG. 32 is a flowchart showing the operation procedure by a CPU.

The CPU 411 of the controller 401 prints the picture of face to the recording media which is selected by user in the printing state suitable for the recording media, by executing the printing procedure shown in FIG. 32.

In this embodiment, as shown in FIG. 30, in the autochanger 320, the magazine 26 is constituted by stacking eleven magazine units 26A which are referred to as "Magazine 1", "Magazine 2", "Magazine 3", . . . , "Magazine 11" successively from the magazine unit 26A of the uppermost stage.

Further, FIG. 31 shows the recording state of the recording media setting information of the NV-RAM 420. In this embodiment, five types of recording media which are from "Media 1" to "Media 5" are contained in the magazine 26. Further, the recording media setting information of the NV-RAM 420 is memorized in the NV-RAM 420 like a table, such that the address information representing address position of Magazine 1 to Magazine 11, the media type information representing the five types of data of Media 1 to Media 5, and the used amount information representing the remained sheets of paper of media correspond one another. In this embodiment, the type information corresponding to Media 1 is set from Magazine 1 to Magazine 4, and the remained sheets of paper of zero, forty-two, and a hundred are respectively set as the used amount information. The type information corresponding to Media 2 is set from Magazine 5 to Magazine 7, and the remained sheets of paper of zero, seventy-eight, and a hundred are respectively set as the used amount information. The type information corresponding to Media 3 is set from Magazine 8 and Magazine 9, and the remained sheets of paper of sixty and a hundred are respectively set as the used amount information. The type information corresponding to Media 4 is set in Magazine 10, and the remained sheets of paper of ninety is set as the used amount information. The type information corresponding to Media 5 is set in Magazine 11, and the remained sheets of paper of a hundred is set as the used amount information.

Here, the printing procedure will be described with reference to the case that user specifies "Media 2" as the type of recording media which is the object to be printed, and specifies the number of printing to "5". In this case, the control command signal S104 in accordance with the specification of "Media 2" and "5" is input from the host computer 360 (FIG. 30) of the autochanger 320. Next, the CPU 411 which receives the signal via the RS232C communication circuit 410, as shown in FIG. 32, enters the printing procedure SP41.

Next, the CPU 411 outputs the control signal to the CPU 416 of the video signal processing unit 402 of the video printer device 24, to perform the step SP42 and step SP43 which will be described below. At step SP42, the CPU 416 receives the control signal and judges, at the media judging circuit (recording media judging circuit 417) described above, whether or not the "Media 2" is specified to the paper feed tray 27 and the ink ribbon cartridge 28 loaded in the video printer device 24. Next, the CPU 416 outputs the judged result to the CPU 411, and the CPU 411 judges whether or not the judged result matches with the type of specified "Media 2". At step SP42, if affirmative result is obtained, the CPU 411 proceeds to the next step SP43. At step SP43, the CPU 416 receives the control signal from the CPU 411 and detects the remained amount of the paper feed tray 27 and the ink ribbon cartridge 28 loaded in the video printer device 24 by the remained paper counting means 418 constituting the used amount detecting means. Next, the CPU 416 outputs the detected result to the CPU 411 to judge, based on the detected result, whether or not the remained sheets of paper of media which is loaded in the video printer device 24 is zero. At step SP43, if an affirmative result is obtained, the CPU proceeds to next step SP44.

At step SP44, the CPU 411 outputs the control signal which means that "Media 2" selected by user has been loaded in the video printer device 24 and the preparations for printing has been all set. In the image processing unit 402, the printing operation that the predetermined image is printed on "Media 2" is performed.

At step SP44 described above, after printing on one sheet of paper is completed, the CPU 411 proceeds to step SP45, and repeats the loop of step SP43, step SP44, and step SP45 until the specified number of sheets of paper are printed. When the setting number of sheets of paper set by user have been printed out, the procedure is terminated at step SP46.

While, when a negative result is obtained at step SP42 and step SP43, that is, this means that the "Media 2" is not set in the paper feed tray 27 and the ink ribbon cartridge 28 loaded in the video printer device, or the remained sheets of paper of recording media of paper feed tray 27 and the ink ribbon cartridge 28 loaded in the video printer device is zero. At this time, the CPU 411 proceeds to step SP47.

At this step SP47, the CPU 411 pulls out the paper feed tray 27 and the ink ribbon cartridge 28 loaded in the video printer device 24 onto the elevator plate 33 by the movable pickup 32, thereafter, elevates the elevator plate 33 to the height of the predetermined magazine unit 26A, and controls the paper feed tray 27 and the ink ribbon cartridge 28 to return into the magazine unit 26A by the movable pickup 32. At the same time, the CPU 411 receives the remained sheets of paper of recording media of the paper feed tray 27 and the ink ribbon cartridge 28 which are returned into the magazine unit 26A, and memorizes the number of the remained sheets of paper into the NV-RAM 420 as the used amount information which corresponds to the position address of the magazine unit 26A.

Next, the CPU 411 proceeds to step SP48, to search the memory data of the NV-RAM 420 corresponding to the next magazine unit 26A of the magazine unit 26A that the paper feed tray 27 and the ink ribbon cartridge 28 has been returned from the video printer device 24, at step SP47 described above, and proceeds to step SP49.

At step SP49, the CPU 411 judges, based on the memory data of the NV-RAM 420, whether or not the type of media corresponding to the magazine unit 26A which has been searched is the specified "Media 2". If the judged result is affirmative, the CPU 411 proceeds to step SP50. At step SP50, the CPU 411 judges, based on the memory data of the NV-RAM 420, whether or not the remained sheets of paper of media corresponding to the magazine unit 26A which has been searched is zero. If the judged result is affirmative, the CPU 411 proceeds to step SP51.

While, if either of the judged results at step SP49 and step SP50 described above is negative, the processing proceeds to step SP52. At step SP52, the memory data of the NV-RAM 420 corresponding to the next magazine unit 26A of the magazine unit 26A searched at step SP49 and step SP50 is searched, and the processing returns to step SP49 again. More specifically, in case that the loop composed of step SP48, step SP49, and step SP51 is explained in this embodiment, the loop is repeated until the magazine unit 26A (in this embodiment, Magazine 6) in which "Media 2" is contained and the recording media of which number of paper is not zero is contained is searched. If the number of loop exceeds the number of magazine unit 26A, it is judged that the no recording media satisfying the condition of step SP49 and step SP50 described above are contained in any magazine unit 26A, and then the error signal is output from the CPU 411 to the host computer 360.

The CPU 411 judges the position of the magazine unit 26A, where the specified recording media is contained, by the loop of step SP49, step SP50, and step SP52, based on the memory data of the NV-RAM 420, thereafter, proceeds to step SP51.

At step P51, the CPU 411 elevates the elevator plate 33 to the height of the magazine unit 26A searched at the above step, thereafter, pulls out the paper feed tray 27 and the ink ribbon cartridge 28 from the magazine unit 26A on the elevator plate by the movable pickup 32. Next, the CPU 411 elevates the elevation plate 33 to the height of the video printer device, thereafter, loads the paper feed tray 27 and the ink ribbon cartridge 28 in the video printer device 24 by the movable pickup 32.

When the control of step SP51 is terminated, the CPU 411 controls the processing to return to step SP42 again. Here, the reason why the processing returns to step SP42 again will be explained hereinafter. As described above, the recording media which is newly loaded in the video printer device 24 at steps SP47 to SP52 has been selected based on the memory data of the NV-RAM 420. Thereby, if the data input to the NV-RAM 420 by the maintenance personnel is not correct for example, it can be thought that the type of the recording media contained in the magazine unit 26A actually is different from the type of the recording media memorized in the NV-RAM 420. Therefore, the processing returns to step SP42 again, to determine whether or not the type of the recording media newly loaded in the video printer device matches with the type of recording media specified by user, so as to be able to print on the recording media specified by user without mistakes.

(4) Operation of Second Embodiment

According to the above constitution, in the printer device 351, when the maintenance personnel sets various types of recording media in each corresponding compartment 26A, 26B of each magazine 26, and selects and inputs the operation panel unit 357, the control command signal S104 is supplied to the CPU 411 of the autochanger 320 via the host computer 360 from the operation panel unit 357. Therefore, the address information, that which compartments 26A, 26B each of the various types of recording media is respectively set in, is stored in the NV-RAM 420.

Further, at maintenance, when the maintenance personnel operates the operation panel unit 357 to input the command for confirming the used amount of each recording media, the mode selection signal S101 is supplied from the operation panel unit 357 to the host computer 360. The host computer 360 supplies the control command signal S104 to the CPU 411 of the autochanger 320 based on the mode selection signal S101.

The CPU 411 reads the used amount of respective recording media which are respectively set in each compartment 26A, 26B of the magazine 26 from the NV-RAM 420 based on the control command signal S104, and outputs the data to the host computer 360. The host computer outputs the data based on the used amount to the image synthesizing circuit 361. The image synthesizing circuit 361 produces the predetermined character signal based on the received data to output it to the image processing unit 402 as the image synthesizing signal S106. The CPU 416 of the image processing unit which has received the image synthesizing signal S106 outputs the video signal S107 based on the signal to the monitor 355, so as to display the used amount of each recording media.

While, in normal mode, when user comes in the booth 350X and puts coins into the coin counter 356, the coin throw signal S102 is supplied from the coin counter 356 to the host computer 360, and the host computer 360 is driven based on the coin drop signal S102, to output the image synthesizing signal S103 to the image synthesizing circuit 361, and to output the control command signal S104 to the autochanger 320.

The image synthesizing circuit 361 synthesizes the image of background or characters, which is set previously, with the video signal S105 supplied from the video camera 354, and outputs the synthesized image to the image processing unit 402 of the autochanger 320 as the image synthesizing signal S106.

At this time, the CPU 416 outputs the image based on the image synthesizing signal S106 to the monitor 355 as the video signal S107. As a result, the face image that the image of background or characters is added to user's face is displayed on the monitor 355.

Thereafter, when user selects and inputs the desired type of recording media by operating the operation panel unit 357 while seeing and confirming the display of the monitor 355, the mode selection signal S101 is supplied from the operation panel unit 357 to the CPU 411 of the autochanger 320 as the control command signal S104 in the host computer 360.

At this time, if the selected recording media is not set in the paper feed tray 27 and the ink ribbon cartridge 28 loaded in the video printer device 24, the CPU 411 reads out the address information described above stored in the NV-RAM 420 based on the control command signal S104 output from the host computer 360, to search the compartments 26A, 26B of the magazine 26 in which the recording media selected out of the magazine 26 in set, and to output the control signal S110 and S116 to the elevator plate drive unit 403 and the loading unit 404 respectively.

Successively, the CPU 411 drives and controls the elevator plate drive unit 403 and the loading unit 404, so that the paper feed tray 27 and the ink ribbon cartridge 28 loaded in the video printer device 24 are pulled out on the elevator plate 33. Then, the CPU 411 conveys and loads them to the compartments 26A, 26B of the magazine 26 corresponding to the recording media set in the paper feed tray 27 and the ink ribbon cartridge 28.

Thereafter, the CPU 411 drives and controls the elevator plate 33 and the loading unit 404, so that the elevator plate 33 is conveyed to the compartments 26A, 26B of the magazine 26 that the desired type of recording media is set, and the paper feed tray 27 and the ink ribbon cartridge 28 corresponding to the compartments 26A, 26B are pulled out on the elevator plate 33 to convey and load them into the video printer device 24.

While, when user selects and inputs the enlargement or reduction of the image, the inversion of the image, or the number of sheets of paper by operating the operation panel unit 357, the mode selection signal S101 in accordance with this are supplied from the operation panel unit 357 to the host computer 360, and the host computer 360 outputs the image synthesizing command signal S103 based on the mode selection signal S101 to the image synthesizing circuit 361. At this time, the image synthesizing circuit produces the video signal in accordance with the mode selection signal S101 to output it to the image processing unit 402 as the image synthesizing signal S106. The CPU 416 which receives the image synthesizing signal S106 outputs the monitor video signal S107 in accordance with the image synthesizing signal S106 to the monitor 355. Therefore, the enlarged image, the reduced image, the inverted image, and the number of sheets of paper to be printed which are specified by user are displayed on the monitor 355.

Thereafter, when user operates the operation panel unit 357 to input the command for starting printing, the mode selection signal S101 in accordance with this is supplied from the operation panel unit 357 to the host computer 360, and the host computer 360 outputs the control command signal S104 in accordance with the mode selection signal S101 to the CPU 411 of the autochanger 320 and the video printer device 24 of the autochanger 320, so that the video printer device 24 prints the image in accordance with the image synthesizing signal S106 on the selected image recording medium. Therefore, the image of user's face is printed on the selected image recording medium, and is discharged from the discharge outlet 358 (FIG. 28).

(5) Effects of Second Embodiment

According to the above construction, various types of recording media are contained in each compartments 26A, 26B of the magazine 26 as the object to be printed, and the address information, that which compartments 26A, 26B in the magazine 26 the plural types of recording media are contained in, is stored in the NV-RAM 420. In this state, the address information described above is read out from the NV-RAM 420 based on the control signal S104 supplied from the host computer 360 in accordance with the user's operation, and the autochanger 320 is driven and controlled based on the address information, so that the desired types of recording media is supplied to the video printer device 24 to enable printing. As a result, the printing apparatus 351 in which the desired types of recording media is selectively printed out from the various types of recording media can be realized.

(6) Other Embodiment (6-1) The embodiment discussed above has dealt with the case where user operates the specified operation switch of the operation panel unit 357 to start the photographing in the image recording device 350. However, this invention is not limited to this, but user can put the specific fee into the coin counter 356 to start the photographing.

(6-2) The embodiment discussed above has dealt with the case where the photographed result by the video camera 354 in the image recording device 350 is stored in the image memory, which is provided in the video printer device 24, at the timing specified by user in accordance with the operation of user. However, this invention is not limited to this, but the timing that the photographed result is stored in the image memory can automatically adjust with the previously set time interval.

(6-3) The embodiment discussed above has dealt with the case where in the image recording device 350, before photographing, the setting mode is selected and the predetermined fee is put into the coin counter 355 by user. However, this invention is not only limited to this, but they can be performed after photographing.

In this case, user can correct or change the setting mode, and all or a part of the paid fee can be returned.

(6-4) The embodiment discussed above has dealt with the case where in the image recording device 350, the recording media discharge outlet 358 is provided in the booth. However, this invention is not only limited to this, but it can be provided in the outside of the booth. In this case, the instruction to wait outside the booth is given to user by, for example, displaying the message on the monitor 355.

(6-5) The embodiment discussed above has dealt with the case where in the image recording device 350, when making the video camera 354 to be in the photographing starting state, immediately after user comes in the booth 350X, the photographing can be started by sensing user by the predetermined sensor (not shown) provided in the video camera 354, or the photographing can be started by putting the specific fee into the coin counter 356 by user.

(6-6) The embodiment discussed above has dealt with the case where in the image synthesizing circuit 361 of the printer device 351, the image in accordance with the image information is synthesized with the image of background or characters (for example, name, date, message, or the like). However, this invention not only limited to this, but such synthesizing of the image can be performed in the video printer device 24 of the autochanger 320.

(6-7) The embodiment discussed above has dealt with the case where the video camera 354 is connected to the image synthesizing circuit 361 in the printing apparatus 351. However, this invention is not only limited to this, but the video image reproducing device (not shown) such as a VTR or a video disc can be connected, instead of the video camera 354, or in addition to the video camera 354. In this case, the image in accordance with the reproducing signal output from the video image reproducing device can be printed on the image recording medium of the recording media selected by operation of user.

(6-8) The embodiment discussed above has dealt with the case where the video printer device 24 is provided in the autochanger 320. However, this invention is not only limited to this, but it can be provided independently from the autochanger 320.

(6-9) The embodiment discussed above has dealt with the case where the determination of the type of recording media and the used amount are performed by the media judging device provided in the video printer device 24. However, this invention is not only limited to this, but user can set if necessary. In this case, user takes out the recording media from each compartment 26A, 26B of the magazine 26 and checks it visually, so that the types of recording media and the used amount are determined.

(6-10) In the embodiment discussed above, a touch panel for selecting the desired type of recording media from a plurality of recording media can be provided on the monitor 355 of the printing apparatus 351.

(6-11) In the embodiment discussed above, the controller 401 of the autochanger 320 can be provided in the external equipment (not shown) provided independently from the autochanger 320.

(6-12) The embodiment discussed above has dealt with the case where the media judging device is provided in the ink ribbon cartridge insertion opening 24B of the video printer device 24, and the type of recording media is judged by using the media judging device. However, this invention is not only limited to this, but the media judging device (not shown) can be provided in the paper feed tray insertion opening 24A of the video printer device 24, and for example, the identifying means (not shown) such as bar code for indicating the type of recording media on the paper feed tray 27 can be provided. In this case, the media judging device reads the identifying means, so that the type of recording media set in the paper feed tray 27 is judged.

(6-13) In this case, if the information relating to the type of recording media, which is judged by the media judging device provided in the ink ribbon cartridge insertion opening 24B or the paper feed tray insertion opening 24A described above, is different from the recording media setting information stored in the NV-RAM 420, the recording media can be removed from the magazine 26, or that can be displayed on the monitor 355.

(6-14) A mirror (not shown) can be used instead of the half mirror 353 in the above embodiment. In this case, the video camera 354 can be set in the neighboring portion of the mirror.

(6-15) The embodiment discussed above has dealt with the case where the image synthesizing circuit 361 is provided between the video camera 354 and the image processing unit 402. However, this invention is not only limited to this, but it can be provided in the image processing unit 402.

In this case, the analog signal from the video camera 354 is directly input to the image processing unit 402, and after the predetermined processing, the signal is memorized in the image memory 427 once. When the predetermined image is synthesized (or processed), the video signal memorized in the image memory 427 is read out to be inputted to the image synthesizing circuit 361, and after the image synthesizing is performed, it is stored in the image memory to re-write, or it is displayed on the monitor directly.

(6-16) The embodiment discussed above has dealt with the case where the monitor 355 is provided in the different position of eyes from that of the video camera 354. However, the monitor and the video camera can be positioned at the same position of eyes.

In this case, a half mirror is positioned with an inclination of 45 degrees between the subject and the video camera 354, and the monitor is provided in the direction that the half mirror inclines. Therefore, the position of eyes of the video camera is matched with that of the monitor so as to prevent the difference of the position of eyes of subject due to seeing the monitor.

(7) According to this invention as described above, the desired type of recording media selected by the user's operation from a plurality of recording media is pulled out of the containing means to be conveyed to the video printer, so that the recording media can be supplied to the video printer device. As a result, the printing apparatus which can selectively print the desired type of recording media from a plurality of recording media can be realized.

Further, according to this invention as described above, the data relating to the type of each recording media contained in each containing portion of the containing means is memorized in the memory means, the data in the desired type of recording media selected by user's operation from a plurality of recording media is read, and the recording media conveyance means is controlled to drive based on the data, so that the selected recording media can be supplied from the containing means to the video printer device. As a result, the printing apparatus which can selectively print the desired type of recording media from a plurality of recording media can be realized.

Industrial Applicability

A printing apparatus and the autochanger according to this invention is applicable to a vending machine for general consumers which photographs the user and prints it immediately. The printing apparatus and the autochanger according to this invention is also applicable to a printing apparatus for traders who can print the pictures in a tourist resort or a concert to sell it on that day.

Further, the printing apparatus and the autochanger according to this invention is also applicable to a printing apparatus for a printing office which prints a picture of an idol, etc.

Furthermore, the printer device and the autochanger according to this invention is also applicable to a printing apparatus of a postcard such as a New Year's card or a picture postcard.

We claim:

1. An autochanger comprising at least one paper feed tray;

at least one ink ribbon cartridge;

a video printing device;

a magazine having a plurality of tray compartments of which each can be associated with said paper feed tray and a plurality of cartridge compartments of which each can be associated with said ink ribbon cartridge; and conveyance means for conveying said paper feed tray and said ink ribbon cartridge between said video printing device and said magazine.

2. The autochanger according to claim 1, wherein said magazine is formed of a plurality of vertically attached magazine units where a plurality of engagement members are formed on an upper surface thereof and a plurality of engagement receiving members are provided on a bottom surface thereof, so that an engagement member of a lower magazine unit can engage an engagement receiving member of a magazine unit thereabove.

3. The autochanger according to claim 2 wherein said magazine has an upper portion and an uppermost stage, further comprising position fixing means respectively engaged with said respective engagement members of said magazine provided at said uppermost stage for fixing said upper portion to an outer frame.

4. The autochanger according to claim 2 wherein said magazine has an uppermost stage and a lower stage, further comprising elasticity means positioned between the upper surface of said magazine at said uppermost stage and an outer frame of said autochanger, for urging said magazine toward said lower stage.

5. The autochanger according to claim 1, wherein said magazine includes conveyance confirming means for judging whether or not said paper feed tray contained in each said paper feed tray compartment and said ink ribbon cartridge contained in each said cartridge compartment are conveyed.

6. The autochanger according to claim 1, wherein said conveyance means comprising:

engagement supporting means for engaging and supporting said paper feed tray and said ink ribbon cartridge in conveyance of said paper feed tray and said ink ribbon cartridge;

first urging means provided in said engagement supporting means for urging said paper feed tray toward said video printing device; and second urging means provided in said engagement supporting means for urging said ink ribbon cartridge toward said video printing device.

7. The autochanger according to claim 1 wherein said video printing device comprise a paper discharge compartment, further comprising discharge means for discharging a printed printing paper outside said video printing device from said paper discharge compartment, and a chute for discharging the printed printing paper outside said autochanger, when the printed printing paper of said video printing device is discharged from said video printing device.

8. The autochanger according to claim 1 wherein said video printing device comprises a paper discharge compartment, a chute, and a paper discharge opening, further comprising discharge means positioned in said paper discharge compartment to which a printed printing paper is discharged, for discharging said printing paper outside said video printing device through said chute, by discharging said printing paper from said paper discharge opening, based on driving power which is supplied from said conveyance means when the printed printing paper of said video printing device is discharged into said paper discharge compartment in a state that said conveyance means is positioned at the predetermined position with respect to said video printing device.

9. The autochanger according to claim 1, wherein said conveyance means includes:

first conveyance means for conveying said paper feed tray or said ink ribbon cartridge toward a first direction parallel to a direction in which the paper feed tray or the ink ribbon cartridge are stacked; and second conveyance means for conveying said paper feed tray or said ink ribbon cartridge toward a second direction parallel to a direction in which the paper feed tray or the ink ribbon cartridge is discharged from and loaded to said video printing device.

10. The autochanger according to claim 9, wherein said first conveyance means having an elevator plate which has said second conveyance means thereon and elevates said elevator plate up and down by an elevator plate drive unit having a driving motor to drive said elevator plate.

11. The autochanger according to claim 9, wherein said second conveyance means having engagement means to be engaged with said paper feed tray or said ink ribbon cartridge so as to convey said paper feed tray or said ink ribbon cartridge forward and backward when said paper feed tray or said ink ribbon cartridge is engaged by said engagement means.

12. An autochanger comprising:

at least one paper feed tray;

at least one ink ribbon cartridge;

a video printing device;

a magazine having a plurality of tray compartments of which each can be associated with said paper feed tray and a plurality of cartridge compartments of which each can be associated with each said ink ribbon cartridge, in which said paper feed tray and said ink ribbon cartridge have a given position relationship with respect to each other and said tray compartment and said cartridge compartment have a position relationship with respect to each other that is the same as said given position relationship; and conveyance means for conveying said paper feed tray and said ink ribbon cartridge between said video printing device and said magazine.

13. The autochanger according to claim 12, wherein said conveyance means conveys said paper feed tray and said ink ribbon cartridge simultaneously between said video printing device and said magazine.

14. The autochanger according to claim 12, wherein said conveyance means comprising:

first conveyance means having an elevator plate for supporting said paper feed tray and said ink ribbon cartridge simultaneously, for conveying said elevator plate up and down; and second conveyance means having engagement means provided on said elevator plate for engaging said paper feed tray with said ink ribbon cartridge simultaneously, for conveying said paper feed tray and said ink ribbon cartridge forward and backward.

15. An autochanger, comprising:

at least one paper feed tray;

at least one ink ribbon cartridge;

a video printing device;

a magazine having a plurality of tray compartments each corresponding to said paper feed tray and a plurality of cartridge compartments each corresponding to said ink ribbon cartridge;

conveyance means for conveying said paper feed tray and said ink ribbon cartridge between said video printing device and said magazine; and control means for controlling said conveyance means to supply said paper feed tray or said ink ribbon to said video printing device or to discharge said paper feed tray or said ink ribbon cartridge from said video printing device, in accordance with an operation control signal form outside by an operator, and for outputting a control signal for controlling printing operation of said video printing device.

16. The autochanger according to claim 15, wherein said conveyance means comprising:

first conveyance means for conveying said paper feed tray or said ink ribbon cartridge up and down; and second conveyance means for conveying said paper feed tray or said ink ribbon cartridge front and back, and said control means supplies a predetermined control signal to said first conveyance means to convey said paper feed tray or ink ribbon cartridge to a predetermined height, thereafter supplies a predetermined control signal to said second conveyance means to convey said paper feed tray or ink ribbon cartridge forward and backward.

17. The autochanger according to claim 15, wherein:

said video printing device has remained amount detecting means for detecting a remained amount of printing paper and ink ribbon loaded in said video printing device;

said control means, when said remained amount detecting means detects that said printing paper and/or said ink ribbon has run out, conveys said paper feed tray and/or ink ribbon cartridge loaded in said video printing device to said magazine, and controls said conveyance means to supply another paper feed tray and/or ink ribbon cartridge contained in said magazine from said magazine to said video printing device.

* * * * *